US005341191A

United States Patent [19]

Crookston et al.

[11] Patent Number: 5,341,191

[45] Date of Patent: Aug. 23, 1994

[54] MOLDED CASE CURRENT LIMITING CIRCUIT BREAKER

[75] Inventors: Ronald W. Crookston, Trafford; Douglas C. Marks, Murrysville; Richard E. White, III, Brighton Township, Beaver County; Andrew J. Male, Export; Yun-Ko N. Chien, Murrysville; Steven Castelein, Sewickley; William E. Beatty, Jr., Brighton Township, Beaver County; Alfred E. Maier; John G. Salvati, both of Beaver Falls, all of Pa.

[73] Assignee: Eaton Corporation, Cleveland, Ohio

[21] Appl. No.: 779,441

[22] Filed: Oct. 18, 1991

[51] Int. Cl.[5] ..... H01H 75/00

[52] U.S. Cl. ..... 335/16; 335/147; 200/147 R

[58] Field of Search ..... 335/16, 147, 195; 200/144 R, 147 R

[56] References Cited

U.S. PATENT DOCUMENTS

| | | | |
|---|---|---|---|
| 2,830,158 | 7/1955 | Coleman . | |
| 3,158,698 | 9/1961 | Campbell . | |
| 3,569,947 | 3/1971 | Radus . | |
| 3,783,423 | 1/1974 | Mater et al. . | |
| 3,798,580 | 3/1974 | Cellerini . | |
| 4,181,836 | 1/1980 | Miracle . | |
| 4,291,291 | 9/1981 | Merchant . | |
| 4,405,846 | 9/1983 | Belttary . | |
| 4,431,877 | 2/1984 | Heft et al. . | |
| 4,551,597 | 11/1985 | Maier . | |
| 4,581,511 | 4/1986 | Leone . | |
| 4,603,313 | 7/1986 | Shimp et al. . | |
| 4,616,112 | 10/1986 | Galloway et al. . | |
| 4,622,530 | 11/1986 | Ciarcia et al. . | |
| 4,635,012 | 1/1987 | Kohanawa et al. | 335/16 |
| 4,679,016 | 7/1987 | Ciarcia et al. . | |
| 4,716,265 | 12/1987 | Fujii et al. . | |
| 4,733,211 | 3/1988 | Castonguay et al. . | |
| 4,736,174 | 4/1988 | Castonguay et al. . | |
| 4,849,590 | 7/1989 | Becker et al. | 335/195 |
| 4,891,618 | 1/1990 | Paton . | |
| 4,916,419 | 4/1990 | Winter | 335/16 |
| 4,950,853 | 8/1990 | Crookston . | |

*Primary Examiner*—Lincoln Donovan
*Attorney, Agent, or Firm*—M. J. Moran

[57] ABSTRACT

A molded case circuit breaker having current limiting capabilities optimized for relatively smaller frame sizes. More specifically, one aspect of the invention relates to a two-piece carrier assembly for carrying the main and arcing contact arms which allows the main and arcing contacts to be blown open during short circuit conditions. The two-piece carrier assembly includes an inner carrier and an outer carrier pivotally connected together. The contact arms are carried by the inner carrier. When sufficient magnetic repulsion forces are exerted on the contacts due to a short circuit condition, the inner carrier pivots relative to the outer carrier to allow the contact arms to blow open. In order to control the amount of force required for blow open, a compression spring loaded cam assembly is provided. Another important aspect of the invention relates to a contact spring housing which relocates the contact springs away from the separable contacts to protect the springs from damage, for example, from heat due to contact separation. In order to improve the interruption time of the circuit breaker for relatively large overcurrents, such as a short circuit, a reverse current loop is provided which generates sufficient magnetic repulsion forces to blow open the separable contacts in a relatively short period of time. Within the restraints of the physical dimension of a relatively smaller breaker frame size, additional features have also been incorporated. More specifically, an improved rating plug assembly is provided with a one-piece plunger, relatively easier to manufacture than known designs which utilize two-piece plungers. Another aspect of the invention relates to an auxiliary cam plate for controlling the motion of the crossbar at the remote end in a four pole circuit breaker. The cam plate compensates for bending of the crossbar to improve the contact force in the remote pole. Lastly, a molded interphase barrier forms a gas barrier within the circuit breaker and maintains its position during assembly relatively better than known interphase barriers.

21 Claims, 34 Drawing Sheets

FIG.6
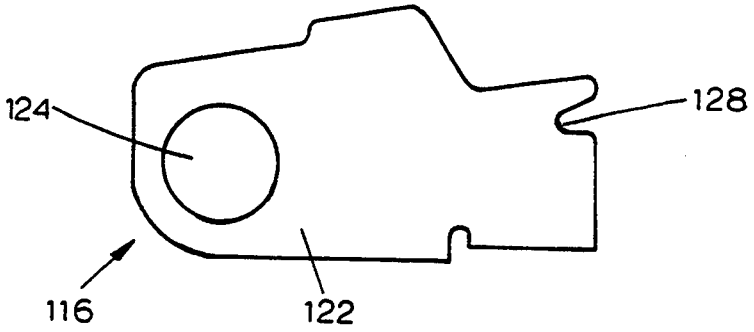
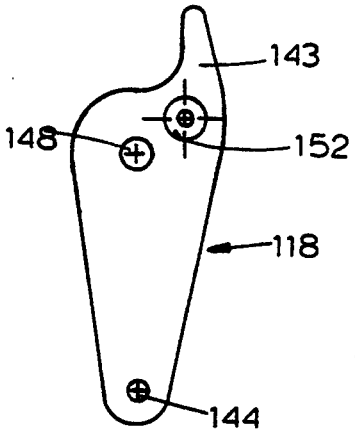
FIG.7
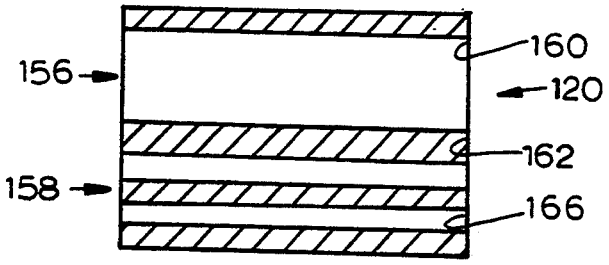
FIG.8
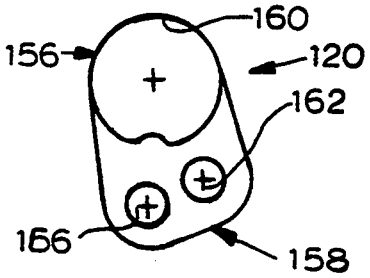
FIG.9
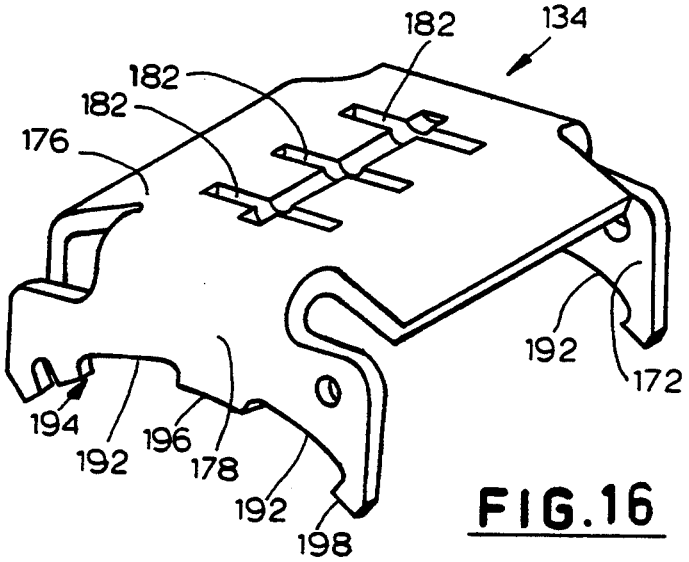
FIG.16

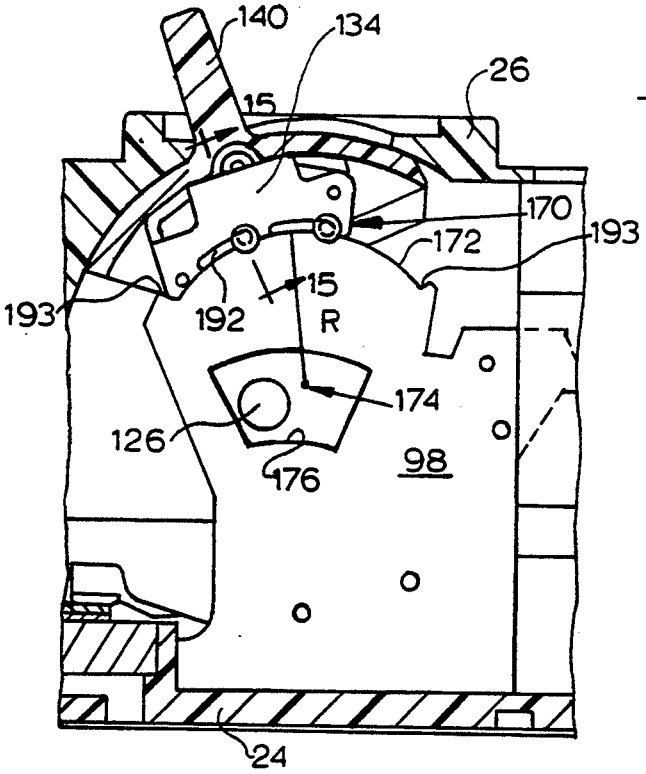
FIG.12
FIG.13
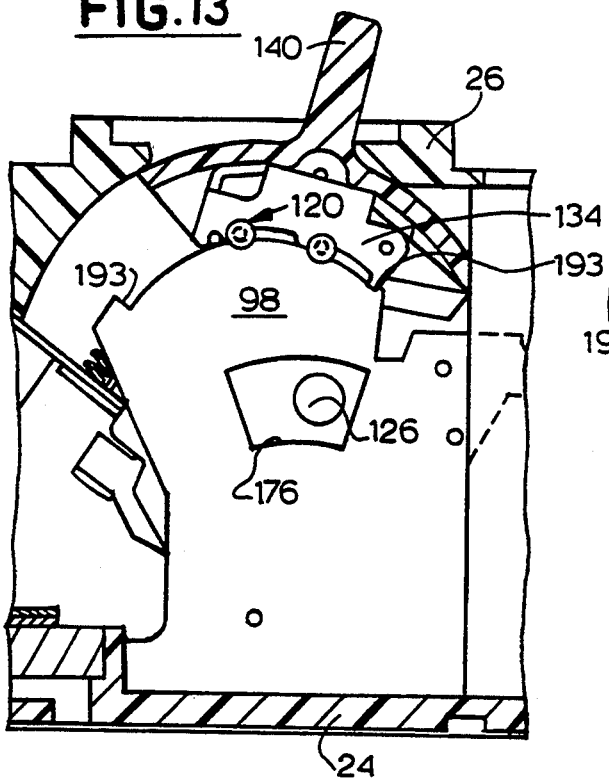
FIG.14
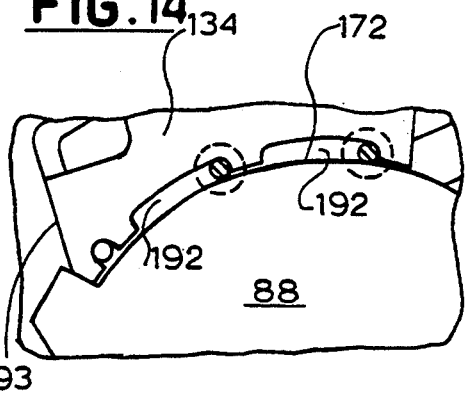
FIG.15
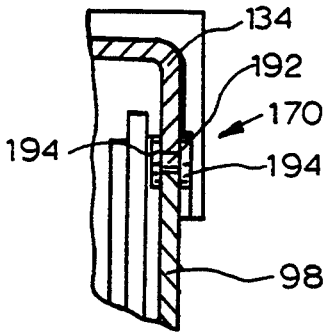

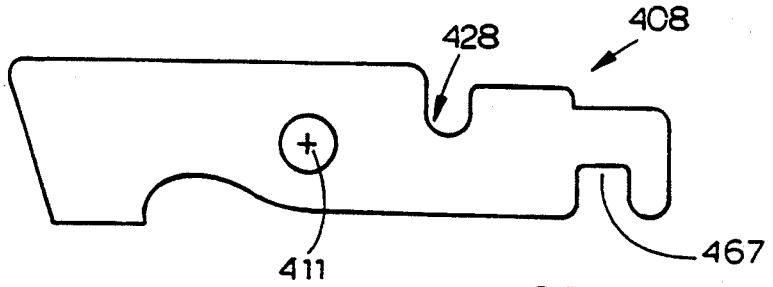
FIG.35
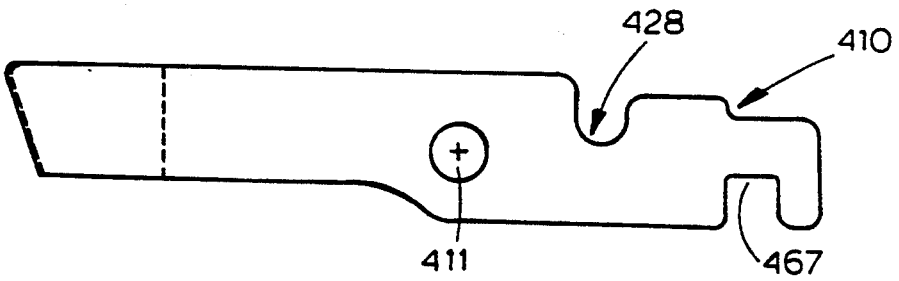
FIG.36
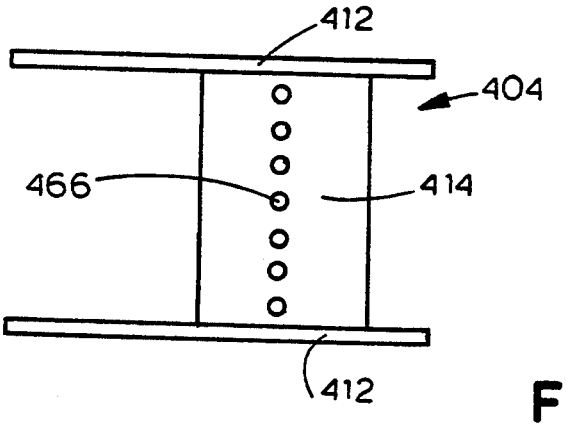
FIG.37
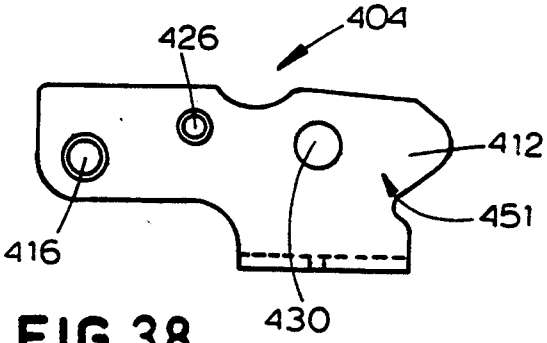
FIG.38
FIG. 39
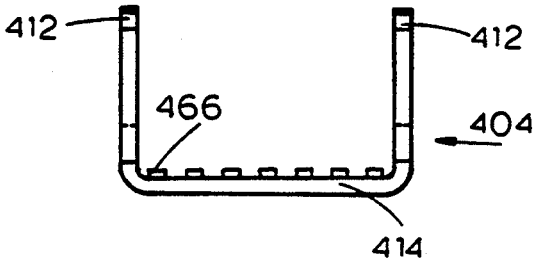

FIG. 47
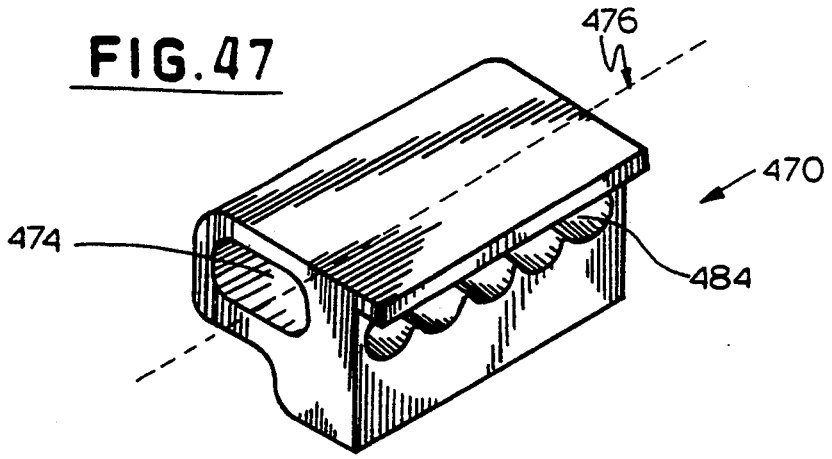
FIG. 48
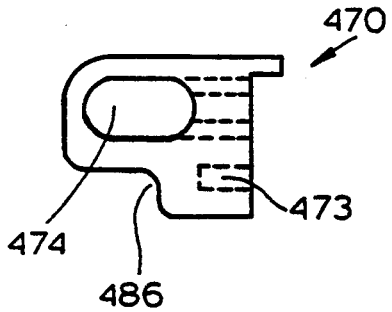
FIG. 49
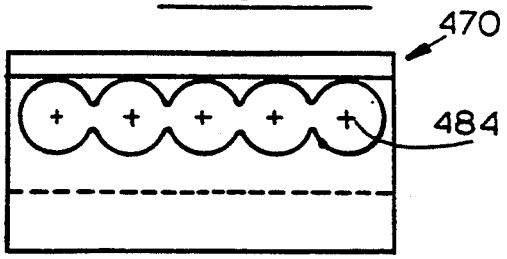
FIG. 50
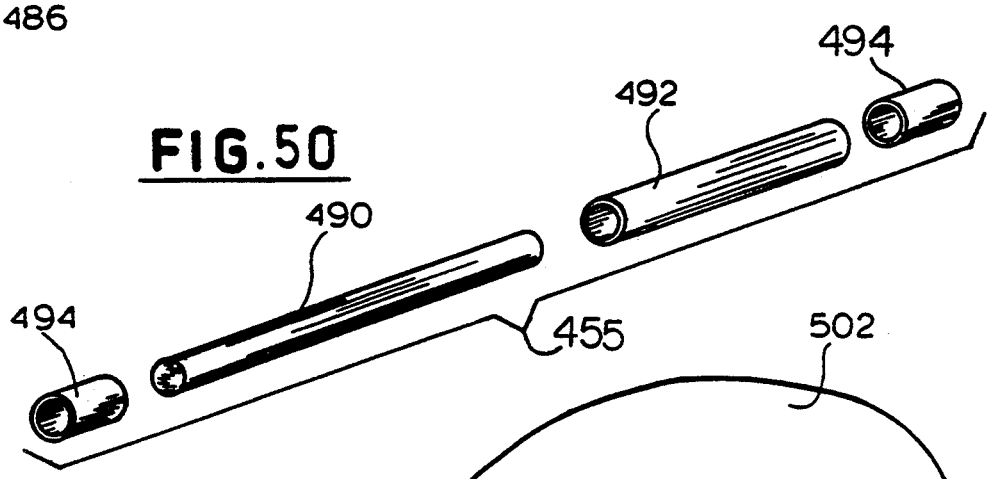
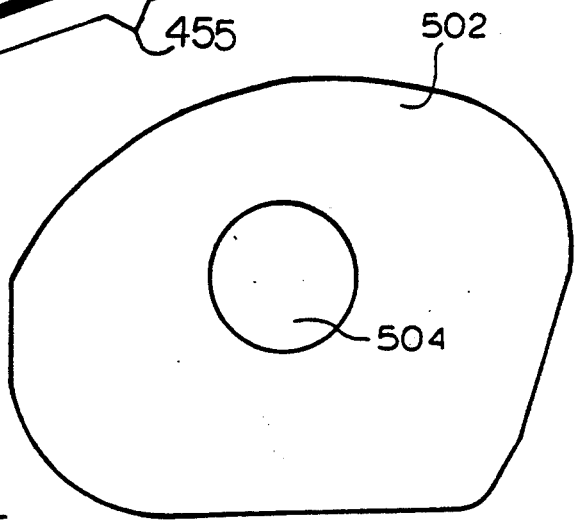
FIG. 51

FIG. 57
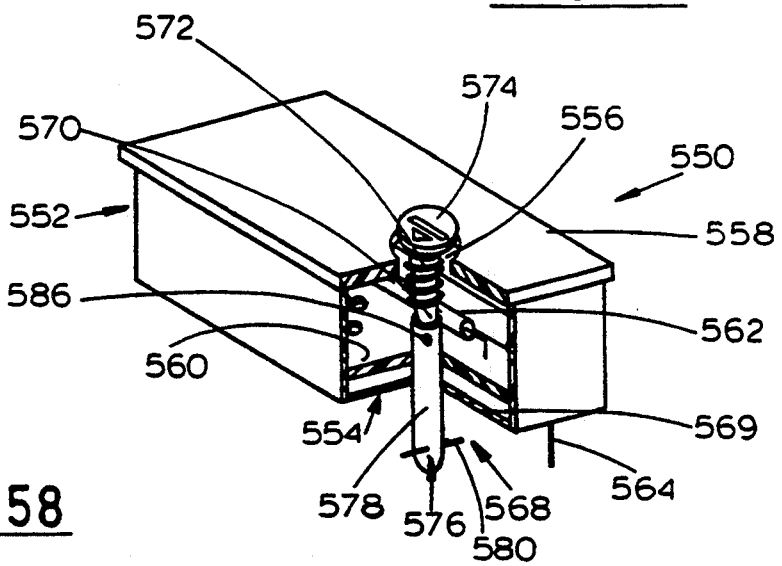
FIG. 58
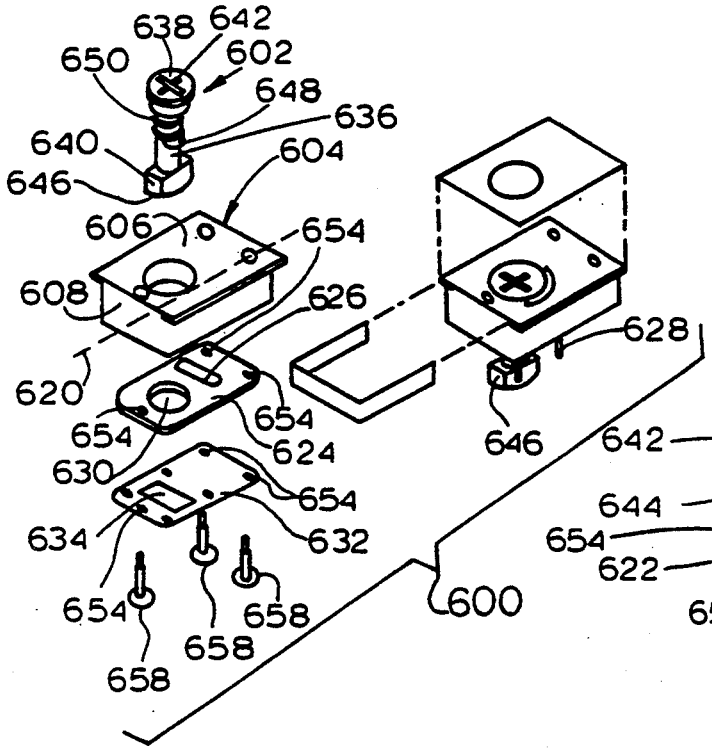
FIG. 59
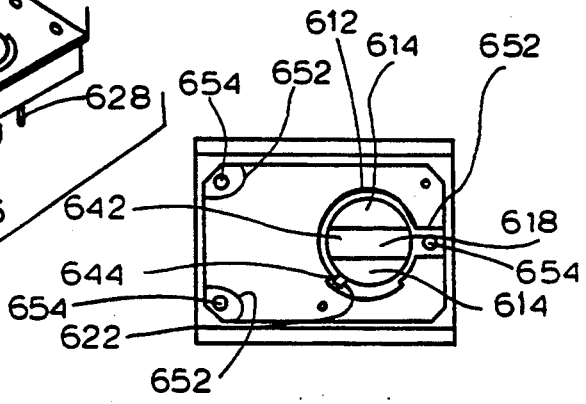
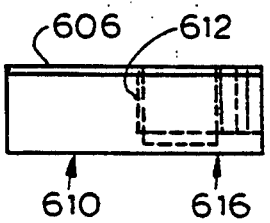
FIG. 60

MOLDED CASE CURRENT LIMITING CIRCUIT BREAKER

CROSS REFERENCE TO RELATED APPLICATIONS

This application is related to another patent application Ser. No. 779,441, filed on even date entitled MOLDED CASE CURRENT LIMITING CIRCUIT BREAKER, by Richard E. White Douglas C. Marks, A. M. Stay W. 0. Jenkins and Alfred E. Maier.

The following patent applications all relate to molded case circuit breakers: Ser. No. 07/226,503, filed Aug. 1, 1988, entitled CROSSBAR ASSEMBLY by Jere L. McKee, Lance Gula and Glenn R. Thomas.

The following commonly assigned U.S. patent applications were filed on Oct. 12, 1988 and all relate to molded case circuit breakers: Ser. No. 07/256,881 entitled SCREW ADJUSTABLE CLINCH JOINT WITH BOSSES, by James N. Altenhof, Ronald W. Crookston, Walter V. Bratkowski and J. Warren Barkell and Ser. No. 07/256,878 entitled TWO-PIECE CRADLE LATCH FOR CIRCUIT BREAKER, by Alfred E. Meier and William G. Eberts.

The following commonly owned patent applications also relate to circuit breakers: Ser. No. 07/491,329, filed on Mar. 9, 1990 entitled PINNED SHUNT END EXPANSION JOINT, by Lance Gula and Roger W. Helms; Ser. No. 07/503 812 filed on Apr. 3, 1990, entitled CIRCUIT BREAKER POSITIVE OFF LINK, by David A. Parks, Thomas A. Whitaker and Y. W. Chou; Ser. No. 07/511,700, filed on Apr. 20, 1990, entitled CIRCUIT BREAKER WITH POSITIVE INDICATION OF WELDED CONTACTS, by R. J. Tedesco and P. L. Ulerich; Ser. No. 07/543,985, filed on Jun. 26, 1990, entitled PHASE SENSITIVITY, by Stephen Mrenna, L. M. Hapeman, John A. Wafer, Robert J. Tedesco, Kurt A. Grunert and Henry A. Wehrli III; Ser. No. 07/574,978, filed on Aug. 30, 1990, entitled E FRAME PANCAKE DESIGN, by Kurt A. Grunert, John A. Wafer, H. A. Wehrli III and L. M. Hapeman; Ser. No. 07/676,584, filed on Mar. 28, 1991, entitled LINE COPPER GASKET, by Arthur Carothers, Ser. No. 07/676,584, filed on Mar. 28, 1991, entitled INTEGRAL MANUAL ON/OFF CRANK ASSEMBLY, by Lance Gula.

BACKGROUND OF THE INVENTION

1. Technical Field

The present invention relates to a molded case circuit breaker and more particularly to a current limiting molded case circuit breaker optimized to enable the current limiting circuit breaker to be disposed in a relative small breaker frame size.

2. Description of the Prior Art

Molded case circuit breakers are generally known in the art. An example of such a circuit breaker is disclosed in U.S. Pat. No. 4,891,618. Such circuit breakers are used to protect electrical circuitry from damage due to an overcurrent condition, such as an overload or a short circuit or both. An overload normally is about 200–300% of the nominal current rating of the circuit breaker, while a short circuit may be 1000% or more of the nominal current rating of the circuit breaker.

Overload protection is normally provided by a bimetal disposed in series with a load conductor. The bimetal normally consists of two strips of metal having different rates of thermal expansion, bonded together at one end. On a sustained overload, the bimetal will deflect due to the heat and engage the circuit breaker trip bar to trip the circuit breaker.

Short circuit protection may be provided by an electromagnet assembly or by magnetic repulsion forces. Electromagnet assemblies include an electromagnet disposed in series with a load conductor and include a cooperating armature which latches the circuit breaker trip bar during normal conditions. During a short circuit condition, the short circuit current passes through the electromagnet which generates attraction forces to attract the armature and unlatch the trip bar which, in turn, causes the circuit breaker to trip.

Short circuit protection may also be provided by magnetic repulsion members. For example, as disclosed in U.S. Pat. No. 4,891,618, magnetic repulsion members, which consist of flexible shunts are formed in generally a V-shape defining two depending legs. The flexible shunts are used to connect the pivotally mounted contact arlns to the load conductors. During a short circuit condition, the short circuit current flowing in the depending legs of the shunts generate repulsion forces between the depending legs which causes the pivotally mounted contact arms to blow open.

The electromagnet assemblies are normally used to provide short circuit protection where the expected short circuit current is 50,000 amperes or less. Since modern electrical distribution systems are capable of delivering substantially larger short circuit current, for example, 100,000 amperes or more, current limiting molded case circuit breakers are used in such applications. Such current limiting circuit breakers have been known to use magnetic repulsion members to interrupt short circuit currents of 100,000 amperes or more.

Such current limiting circuit breakers are provided in various frame sizes. The frame size refers to a number of important characteristics of the circuit breaker, such as maximum allowable voltage and current, interrupting capacity and physical dimensions of the molded case. For example, U.S. Pat. No. 4,891,618 relates to Westinghouse Series C, R-frame circuit breaker, rated at 600 volts and 1600/2000 amperes.

Since molded case circuit breakers and in particular current limiting molded case circuit breakers are relatively compact, a problem exists to provide current limiting capabilities for a circuit breaker in relatively smaller frame sizes. More specifically, the components in a relatively larger frame size current limiting molded case circuit breaker cannot merely be downsized to provide a current limiting circuit breaker in a smaller frame size.

SUMMARY OF THE INVENTION

It is an object of the present invention to solve the problems associated with the prior art.

It is another object of the present invention to provide current limiting capabilities in circuit breakers with relatively smaller frame sizes.

Briefly, the present invention relates to a molded case circuit breaker having current limiting capabilities optimized for relatively smaller frame sizes. More specifically, an important aspect of the invention relates to a two-piece carrier assembly for carrying the main and arcing contact arms which allows the main and arcing contacts to be blown open during short circuit conditions. The two-piece carrier assembly includes an inner carrier and an outer carrier pivotally connected together. The contact arms are carried by the inner carrier. When sufficient magnetic repulsion forces are exerted on the contacts due to a short circuit condition, the inner carrier pivots relative to the outer carrier to allow the contact arms to blow open. In order to control the amount of force required for blow open, a compression spring loaded cam assembly is provided. Another important aspect of the invention relates to a contact spring housing which relocates the contact springs away from the separable contacts to protect the springs from damage, for example, from heat due to contact separation. In order to improve the interruption time of the circuit breaker for relatively large overcurrents, such as a short circuit, a reverse current loop is provided which generates sufficient magnetic repulsion forces to blow open the separable contacts in a relatively short period of time. Within the restraints of the physical dimension of a relatively smaller breaker frame size, additional features have also been incorporated. More specifically, an improved rating plug assembly is provided with a one-piece plunger, relatively easier to manufacture than known designs which utilize two-piece plungers. Another important aspect of the invention relates to an auxiliary cam plate for controlling the motion of the crossbar at the remote end in a four pole circuit breaker. The cam plate compensates for bending of the crossbar to improve the contact force in the remote pole. Lastly, a molded interphase barrier forms a gas barrier within the circuit breaker and maintains its position during assembly relatively better than known interphase barriers.

DESCRIPTION OF THE DRAWING

These and other objects and advantages of the present invention will become readily apparent upon consideration of the following detailed description and attached drawing, wherein:

FIG. 6 is an elevational view of an upper toggle link in accordance with the present invention;

FIG. 7 is an elevational view of a trip link in accordance with the present invention;

FIG. 8 is a sectional view along line 8—8 of FIG. 5 illustrating an insulator link in accordance with the present invention;

FIG. 9 is an end view along 9—9 of FIG. 5 of the insulator link illustrated in FIG. 8;

FIG. 12 is a simplified partial sectional view similar to FIG. 2 illustrating the handle yoke rollers in accordance with the present invention with the circuit breaker shown in an ON position;

FIG. 13 is similar to FIG. 12 illustrating the circuit breaker in an OFF position;

FIG. 14 is similar to FIG. 12 illustrating the relationship between the roller pins and the handle yoke when the circuit breaker is in an ON position;

FIG. 15 is a partial sectional view along line 15—15 of FIG. 2;

FIG. 16 is a perspective view of a handle yoke in accordance with the present invention;

FIG. 35 is an elevational view of a main contact arm in accordance with the present invention;

FIG. 36 is an elevational view of an arcing contact arm in accordance with the present invention;

FIG. 37 is a plan view of an inner carrier in accordance with the present invention;

FIG. 38 is a side elevational view of the inner carrier illustrated in FIG. 37;

FIG. 39 is a front elevational view of the inner carrier illustrated in FIG. 37;

FIG. 47 is a perspective view of a cam spring housing in accordance with the present invention.

FIG. 48 is an end elevational view of the cam spring housing illustrated in FIG. 47.

FIG. 49 is a front elevational view of the cam spring housing illustrated in FIG. 47.

FIG. 50 is an exploded perspective view of a cam roller assembly in accordance with the present invention.

FIG. 51 is an elevational view of a prior art interphase gas barrier.

FIG. 57 is an exploded perspective view of a prior art rating plug assembly.

FIG. 58 is an exploded view of a rating plug assembly in accordance with the present invention.

FIG. 59 is bottom plan view of a housing for the rating plug assembly in accordance with the present invention.

FIG. 60 is a side elevational view of the housing illustrated in FIG. 59.

DETAILED DESCRIPTION

As illustrated and described herein, a Westinghouse Series C, N-frame, molded case circuit breaker is described and illustrated. However, it will be appreciated by those of ordinary skill in the art that the principles of the present invention are applicable to various types of molded case circuit breakers. Moreover, for simplicity, only the center pole of a multiple pole molded case circuit breaker is described in detail and illustrated.

As is known by those of ordinary skill in the art, circuit breakers are provided in various sizes and assigned a frame size. The frame size refers to various characteristics of the circuit breaker, such as the allowable voltage and current ratings as well as the interrupting capacity and the physical dimensions of the circuit breaker. Generally speaking, the physical dimensions of the circuit breaker housing are related to the ratings of the circuit breaker. More specifically, relatively larger circuit breaker housings are used for circuit breakers with relatively higher ratings.

The principles of the present invention are directed toward an intermediate breaker frame size, such as a 1200 ampere frame, for a circuit breaker having current limiting capabilities. Such current limiting capabilities generally allow the circuit breaker to interrupt relatively large magnitudes of overcurrent, such as short circuit current, which may be 100,000 amperes or more. Such relatively large magnitudes of current are generally interrupted by way of magnetic repulsion forces, generated within the circuit breaker. Known mechanisms, such as disclosed in U.S. Pat. No. 4,891,618, assigned to the same assignee as the assignee of the present invention, are generally not suitable for circuit breakers of relatively smaller frame sizes due to the amount of physical space required. Accordingly, one aspect of the molded case circuit breaker in accordance with the present invention, enables current limiting capabilities to be incorporated into a relatively smaller frame size housing.

Figure 1:
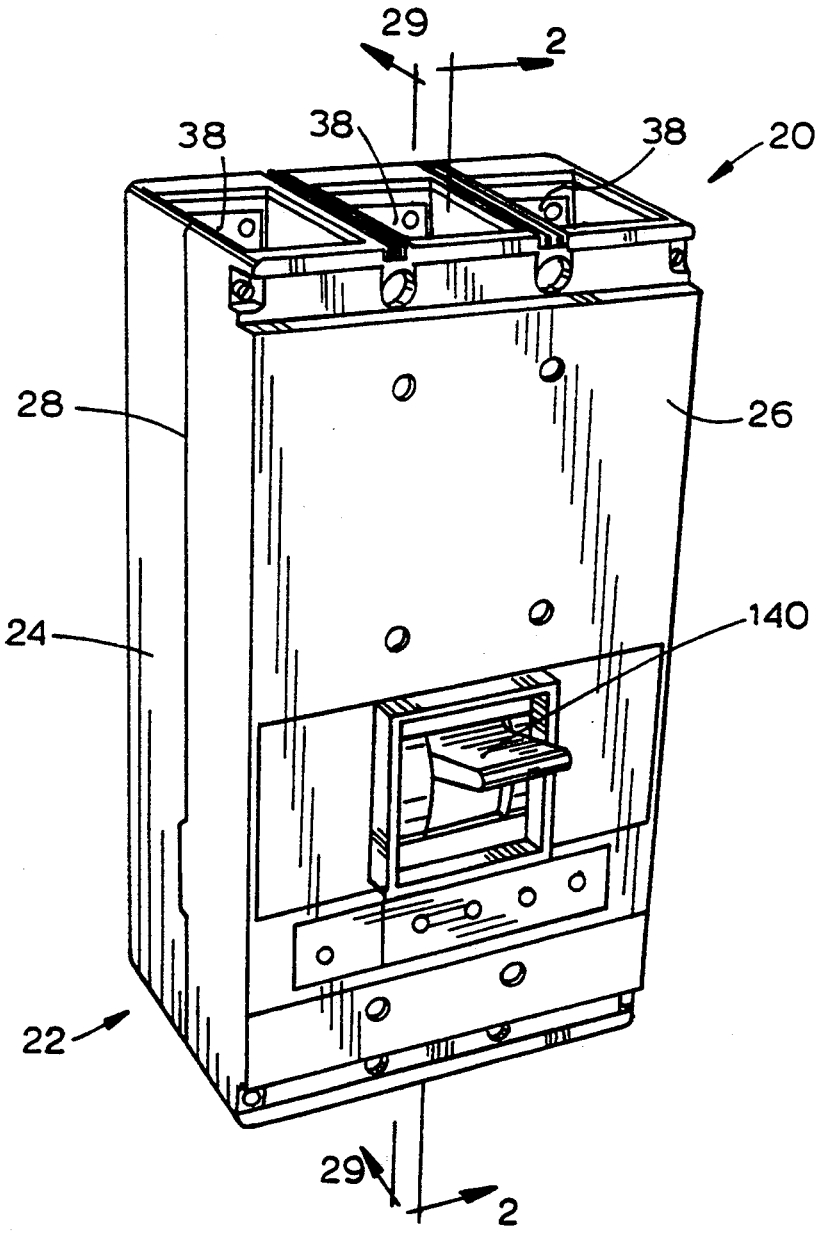
FIG. 1 is a perspective view of the molded case circuit breaker in accordance with the present invention.

Referring to the drawing and in particular to FIG. 1, a molded case circuit breaker, generally identified with the reference numeral 20, comprises an insulated housing 22, formed from a molded base 24 and a molded cover 26, assembled at a parting line 28. The circuit breaker 20 also includes at least one pair of separable main contacts 30 (FIGS. 2–4), provided within the insulated housing 22, which includes a fixed main contact 32 and a movably mounted main contact 34. The fixed main contact 32 is carried by a line side conductor 36, rigidly secured relative to the molded base 24. The line side conductor 36, in turn, is electrically connected to a line side terminal 38 (FIG. 1) for connection to an external electrical circuit (not shown).

Figure 2:
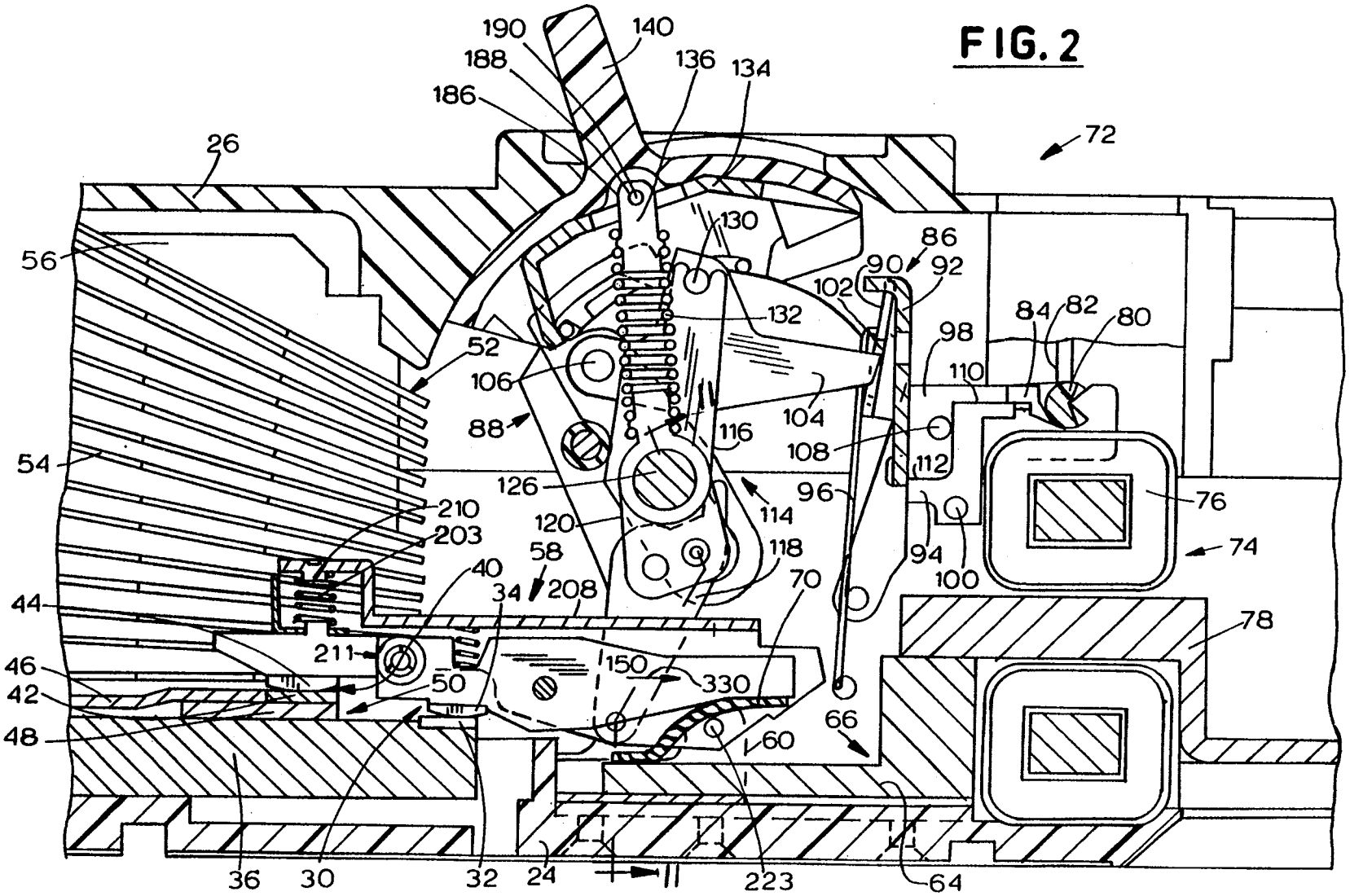
FIG. 2 is a cross-sectional view along line 2—2 of FIG. 1 illustrating the circuit breaker in an ON position.
Figure 3:
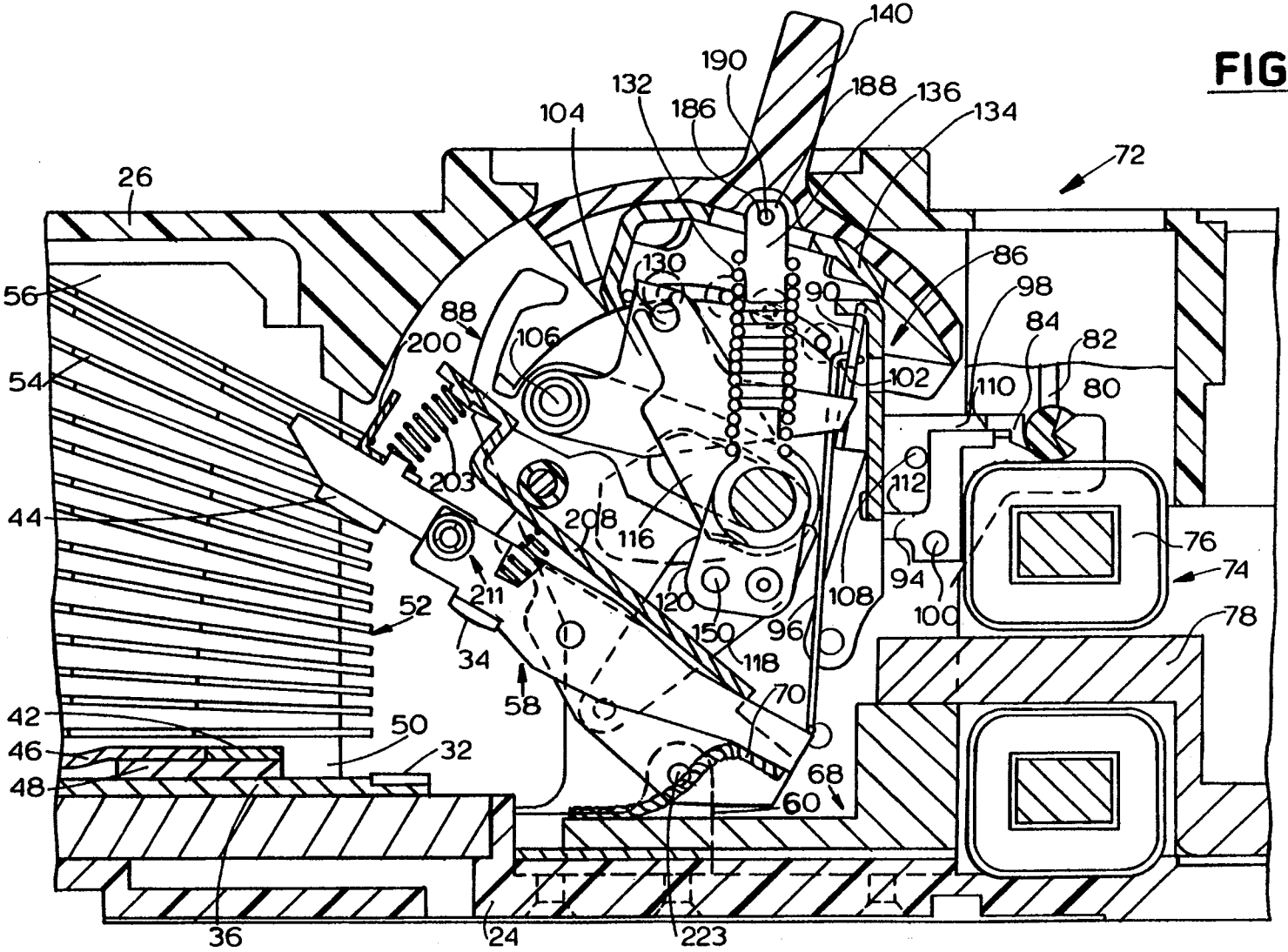
FIG. 3 is similar to FIG. 2 illustrating the circuit breaker in an OFF position.
Figure 4:
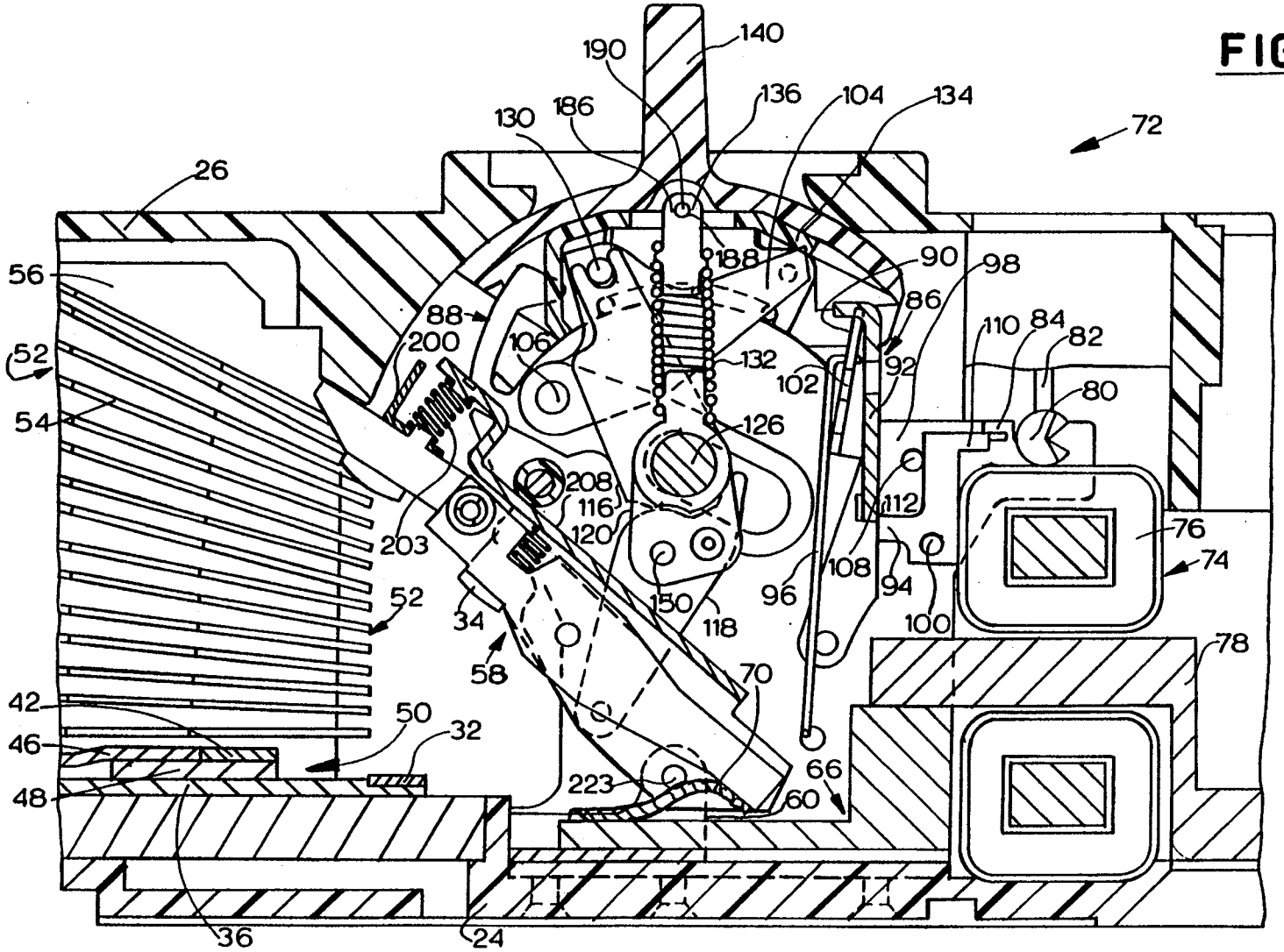
FIG. 4 is similar to FIG. 2 illustrating the circuit breaker in a TRIP position.

In order to decrease the wear on the separable main contacts 30, a plurality of arcing contacts 40 are provided (FIGS. 2–4). The arcing contacts 40 include one or more fixed arcing contacts 42 and one or more movably mounted arcing contacts 44. As will be discussed in more detail below, the mechanical coupling between the movably mounted arcing contacts 44 and the movably mounted main contacts 34 allows the arcing contacts 40 to close before the separable main contacts 30 when the circuit breaker 20 is placed in an ON position and allows the arcing contacts 40 to open after the main contacts 30 when the circuit breaker 20 is placed in an OFF position.

The line side conductor 36 carries the fixed arcing contact 42. More specifically, a plate 46 is rigidly secured to the line side conductor 36 on one end and spaced apart therefrom on the opposite end. The fixed arcing contact 42 is rigidly secured to another plate 48, for example, by welding or brazing forming a fixed arcing contact assembly 50. The fixed arcing contact assembly 50 is, in turn, sandwiched between the plate 46 and the line side conductor 36 and rigidly secured therebetween, for example, with fasteners (not shown) to facilitate replacement of the fixed arcing contact assembly 50.

Disposed adjacent a fixed main contact 32 and the fixed arcing contact 42 is an arc chute assembly 52. The arc chute assembly 52 facilitates extinguishment of arcs generated by separation of the main contacts 30 and the arcing contacts 40. As the arc is extinguished in the arc chute assembly 52, a conductive gas is generated which is directed out dedicated vents (not shown) in the circuit breaker cover 26. The arc chute assembly 52 includes a plurality of spaced apart arc plates 54 carried by a pair of spaced apart sidewalls 56.

As will be discussed in more detail below, a movably mounted main contact arm assembly 58 carries the movable contact 34. The movably mounted contact arm assembly 58 is pivotally mounted with respect to the molded base 24. More specifically, an L-shaped bracket 60 (FIG. 5) is provided which defines a pair of spaced apart depending legs 62 interconnected by a connecting leg 64. A generally L-shaped load conductor 66 is disposed on top of the connecting leg 64. The load conductor 66 and the connecting leg 64 are, in turn, rigidly secured to the molded base 24 with a plurality of fasteners (not shown).

The depending legs 62 are provided with aligned apertures 68. As will be discussed in more detail below, the movably mounted contact arm assembly 58 is pivotally connected to the L-shaped bracket 60 by way of the apertures 68. The movably mounted contact arm assembly 58 is also electrically connected to the load conductor 66 by way of a plurality of flexible shunts 70 (FIG. 5), formed from, for example, braided copper conductor, for example, by welding or brazing.

Disposed adjacent the load conductor 66 is an electronic trip unit 72 (FIGS. 2–4). The electronic trip unit 72 does not form a portion of the present invention and is described briefly only to provide a better understanding of the invention. Such electronic trip units are generally known in the art. For example, one known electronic trip unit is disclosed in U.S. Pat. No. 3,783,423, hereby incorporated by reference.

The electronic trip unit 72 includes a current transformers 74 for each phase for sensing load current. The current transformers 74 are formed in a generally donut shape with a plurality of secondary windings 76 disposed about a load conductor 78.

The load conductor 78 is formed in a generally L-shape and is rigidly secured on one end to the load conductor 66 as well as to the molded base 24 with a plurality of fasteners (not shown). The free end (not shown) of the load conductor 78 acts as a load terminal for connection to an external load, such as a motor.

When the main contacts 30 are in an ON position as shown in FIG. 2, the load current flows from the line side conductor 36 through the main contacts 30 and the arcing contacts 40 to load side conductors 66 and 78 to the electrical load. The load current through the load conductor 78 induces a current into the secondary windings 76 of the current transformer 74. The current in the secondary windings 76 is, in turn, applied to an overcurrent trip circuitry (not shown) disposed within the electronic trip unit 72 for initiating a trip of the circuit breaker 20 for predetermined levels of overcurrent. More specifically, the electronic trip unit 72 includes a trip bar 80 (FIGS. 2–4) having an integrally formed extending trip lever 82. The trip lever 82 is mechanically coupled to a flux shunt trip assembly (not shown) which cooperates to rotate the trip bar 80 in a clockwise direction (FIG. 2) during predetermined levels of overcurrent. Upon rotation of the trip bar 80, a latch lever 84, integrally formed on the trip bar 80, releases a latch assembly 86 to allow the circuit breaker 20 to trip.

LATCH ASSEMBLY

The latch assembly 86 latches the circuit breaker operating mechanism, generally identified with the reference numeral 88, during conditions when the circuit breaker 20 is in an ON position as shown in FIG. 2 and when the circuit breaker 20 is placed in an OFF position as shown in FIG. 3. However, during an overcurrent condition, the electronic trip unit 72, and more specifically, the trip bar 80 releases the latch assembly 86 to allow the circuit breaker 20 to trip as shown in FIG. 4.

The latch assembly 86 includes a pivotally mounted lock plate 90, a latch plate 92, a latch lever 94 and a biasing spring 96. The lock plate 90 is pivotally mounted to a pair of spaced apart side plates 98, best shown in FIG. 25, used to carry the operating mechanism 88, by way of a pin 100. The latch plate 92 is coupled to the lock plate 90 at one end. The other end of the lock plate 90 is mounted for arcuate movement within the side plates 98. The lock plate 90 includes a pair of spaced apart notches 102 for latching a cradle 104 which forls a portion of the operating mechanism 88 as will be discussed below in more detail. The biasing spring 96 biases the lock plate 90 and the latch plate 92 in a counterclockwise direction.

The latch lever 94 is pivotally mounted to one of the side plates 98 by way of a pin 106. The latch lever 94 is biased in a counterclockwise direction by a torsion spring (not shown). A stop pin 108 serves to limit rotation of the latch lever 94 as well as the lock plate 90.

The latch lever 94 is integrally formed with an upper latch surface 110 and a lower latch surface 112. The lower latch surface 112 is adapted to be received in a notch (not shown) in the lock plate 90 to maintain the lock plate 90 and latch plate 92 in a latched position as shown in FIGS. 2 and 3. The upper latch surface 110 is adapted to communicate with the latch lever 84 formed on the trip bar 80 which releases the cradle 104 upon detection of an overcurrent condition by the electronic trip unit 72 as shown in FIG. 4. After the latch assembly 86 is unlatched, the circuit breaker must be placed in the OFF position as shown in FIG. 3 to reset it.

OPERATING MECHANISM

Figure 5:
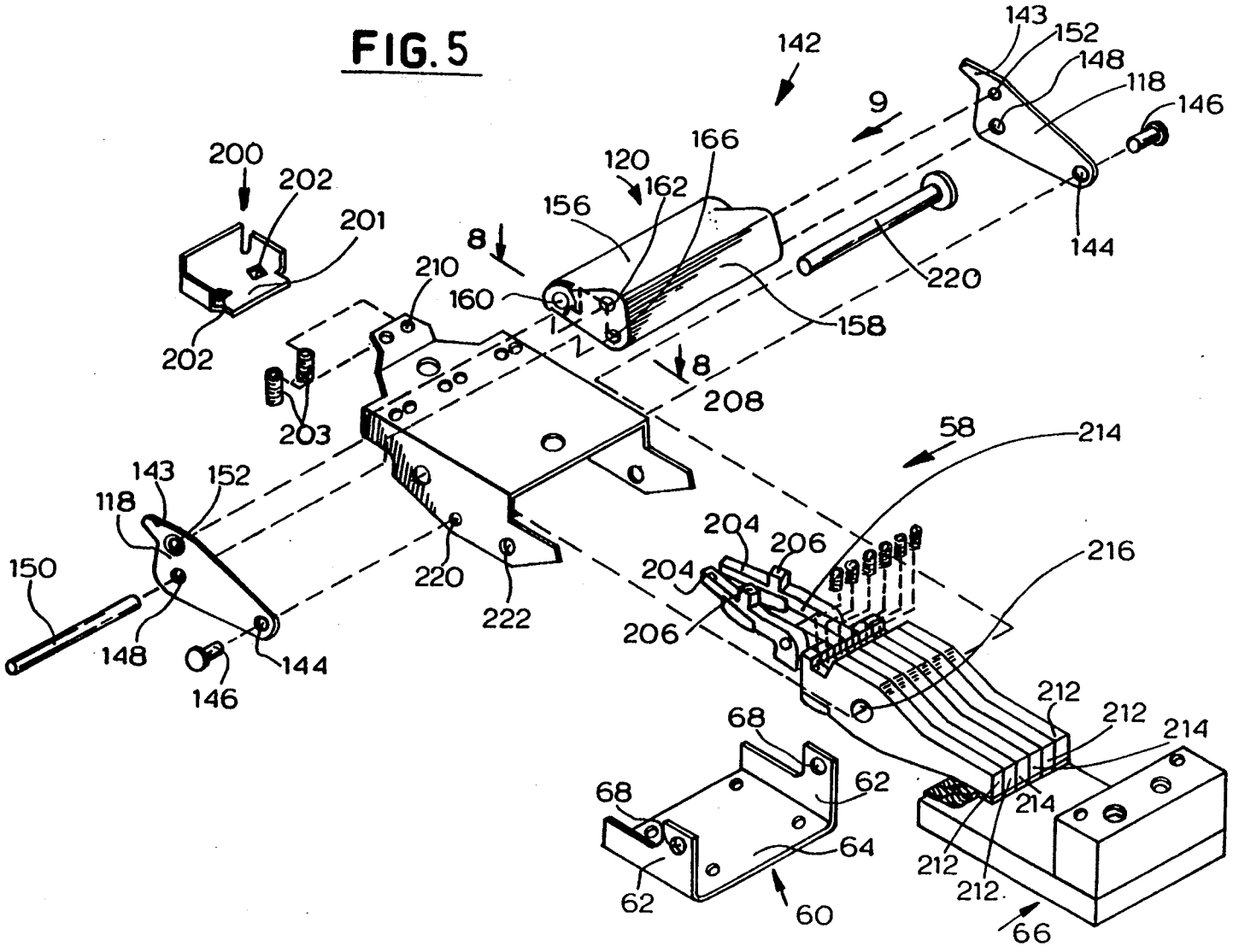
FIG. 5 is an exploded perspective view of a movable contact arm assembly, a high interrupting current assembly and an arcing contact spring housing in accordance with the present invention.

An operating mechanism 88 is provided for opening and closing the separable main contacts 30. The operating mechanism 88 includes a toggle assembly 114 which includes a pair of upper toggle links 116 (FIGS. 2, 3, 4 and 6), a pair of trip links 118 (FIGS. 1, 5 and 7) and an insulator link 120 (FIGS. 5, 8 and 9). In one embodiment of the invention, the upper toggle link 116 is formed as an irregular shaped member having an aperture 124 for receiving a crossbar 126 (FIGS. 2–4 and 28). Each of the upper toggle links 116 is also provided with a notch 128 which allows it to be mechanically coupled to the cradle 104 by way of a pin 130 (FIGS. 2–4). Operating springs 132 (FIGS. 2–4 and 29) are connected between the crossbar 126 and a handle yoke 134 by way of spring retainers 136 as will be discussed in more detail below.

The cradle 104 may be formed from a pair of oppositely disposed, irregular-shaped members. One end of each of the cradle members 104 is pivotally connected to each of the side plates 98 by way of the pin 106. The cradle members 104, in cooperation with the latch assembly 86 allows the circuit breaker 20 to be tripped by way of the electronic trip unit 72. More specifically, when the cradle members 104 are in the position shown in FIG. 2, the separable main contacts 30 are under the control of an extending operating handle 140, rigidly secured to the handle yoke 130 to enable the circuit breaker 20 to be placed in an OFF position as shown in FIG. 3. Similarly, the operating handle 140 may also be used to place the circuit breaker 20 in an ON position. However, upon detection of an overcurrent, the electronic trip unit 72 releases the latch assembly 86 which, in turn, releases the cradle 104 to allow the circuit breaker main contacts 30 to be tripped as shown in FIG. 4 under the influence of the operating springs 132. In order to reset the cradle 104, it is necessary to rotate the operating handle 140 to the OFF position (FIG. 3) which, in turn, allows the cradle members 104 to be latched relative to the latch assembly 86. Once the cradle members 104 are latched, the operating handle 140 may be used to place the main contacts 30 in the ON position.

HIC ASSEMBLY

An important aspect of the invention relates to a high interrupting current (HIC) assembly 142 (FIG. 5). The HIC assembly 142 allows for interruption of relatively large magnitude overcurrents, such as short circuit currents, for example, 100,000 amperes or more, as a result of magnetic repulsion forces generated by the shunts 70. The HIC assembly 142 is adapted to uncouple the movably mounted contact arm 58 from the operating mechanism 88 during such conditions. Moreover, the HIC assembly 142 in accordance with the present invention offers distinct advantages over known blow open mechanisms, for example, as shown and disclosed in U.S. Pat. No. 4,891,618, assigned to the same assignee as the present invention. More specifically, in that system, the pivotally mounted contact arm is mechanically coupled to the operating mechanism by way of a cam roll pin assembly. When relatively large magnitude overcurrents, such as a short circuit current, the cam roll pin assembly allows the movably mounted contact arm to be uncoupled from the operating mechanism by way of relatively large magnetic repulsion forces generated in flexible shunts used to electrically connect the pivotally mounted contact arm to the load side conductor.

There are several problems with a blow open assembly as described in the aforementioned U.S. patent. First, such an assembly requires a substantial amount of space within the circuit breaker. For relatively large frame size circuit breakers, such as a 1600/2000 ampere frame size circuit breaker, such an assembly is suitable. However, for relatively smaller frame size circuit breakers, such as a 1200 ampere frame size breaker, such an assembly requires relatively more space than is available. Secondly, such an assembly can be difficult to calibrate to vary the magnitude of overcurrent at which the assembly blows open. More specifically, in the assembly disclosed in above-mentioned U.S. patent, the electrical current at which the movable contact arm assembly is uncoupled from the operating mechanism is largely dependent upon the cam roll pin assembly. More specifically, the cam roll pin assembly mechanically couples the movable main contact arm to the operating assembly by way of a cam roll pin which is carried by a cam formed on the movable contact arm assembly. A plurality of biasing springs are used to couple the cam roll pin to the cam surface on the movable contact arm in assembly. In such a design, the blow open current dependent upon the interrelationship of the cam design as well as the force of the biasing springs and thus is relatively difficult to adjust.

The HIC assembly 142 in accordance with the present invention solves such problems. More specifically, the HIC assembly 142 facilitates adjustment of the electrical current at which blow open occurs. Moreover, the HIC assembly 142 requires relatively less space within a circuit breaker housing to allow the blow open feature to be incorporated into breakers having relatively smaller frame sizes, such as a 1200 ampere frame size circuit breaker.

The HIC assembly 142 includes the insulator link 120 (FIGS. 5, 8 and 9) and a pair of trip links 118 (FIGS. 5 and 7). During normal operating conditions and relatively low magnitude overcurrent conditions, the trip link 118 couples the movably mounted contact arm assembly 58 to the operating mechanism 88. More specifically, during such conditions, the trip link 118 is coupled to the insulator link 120 and in conjunction with the upper toggle link 116 forms the toggle assembly 114 to allow the circuit breaker to be selectively placed in the 0N position as shown in FIG. 2 or alternatively in the OFF position as shown in FIG. 3 under the control of the operating springs 132 by actuation of the operating handle 140.

During relatively low magnitude overcurrent conditions, the trip link 118 remains coupled to the insulator link 120 to allow the circuit breaker 20 to be tripped by the electronic trip unit 72, as illustrated in FIG. 4. In this condition, the electronic trip unit 72 causes cradle 104 to be unlatched from the latch assembly 86 to allow the movably mounted contact arm 58 to be rotated upwardly under the influence of the operating springs 132 as previously mentioned.

Figure 10:
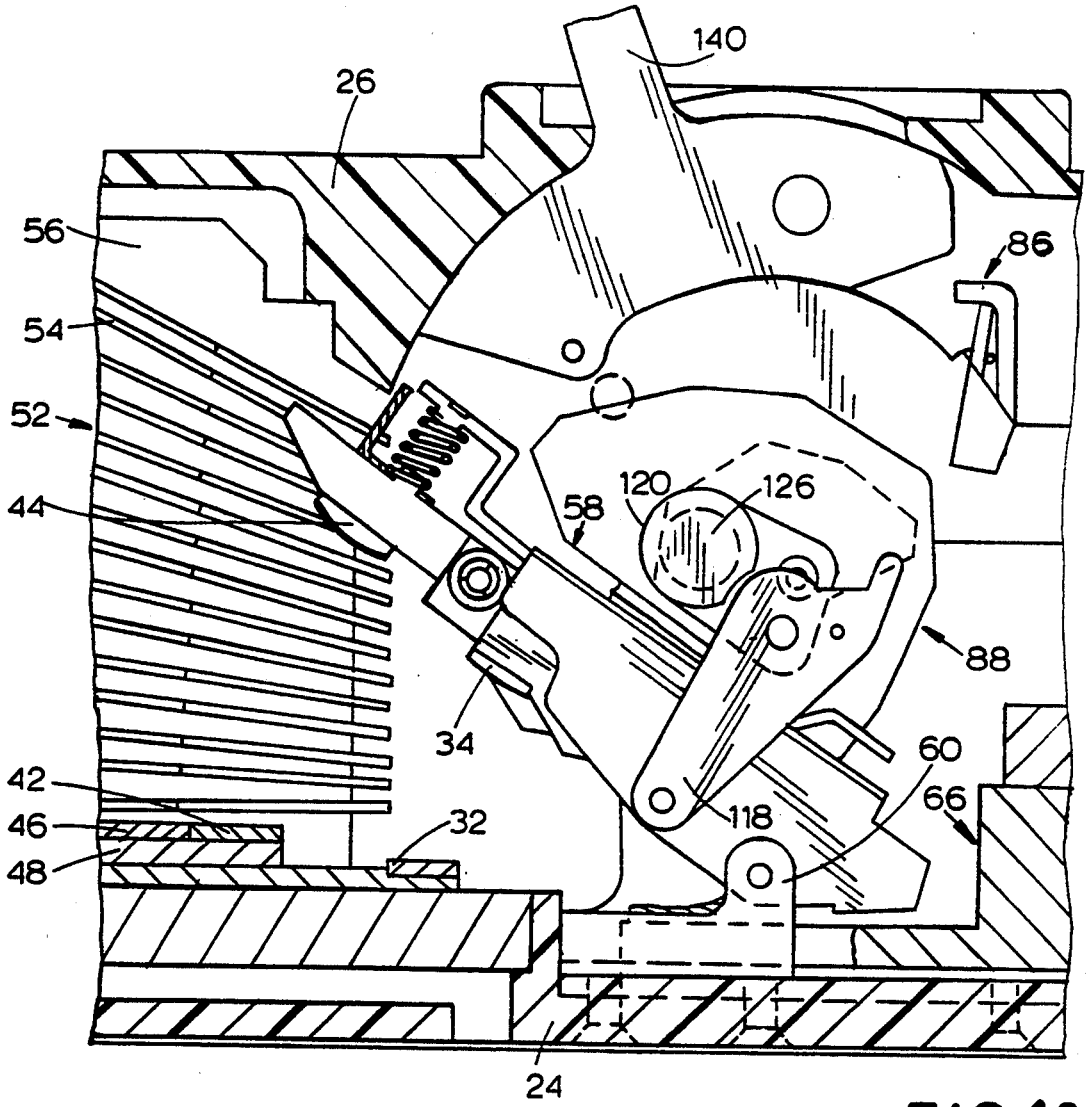
FIG. 10 is similar to FIG. 2 illustrating the circuit breaker in accordance with the present invention in a blown open position.

During relatively large magnitude overcurrent conditions, such as a short circuit condition, the HIC assembly 142 uncouples the operating mechanism 88 from the movable contact arm assembly 58 to allow the separable main contacts 30 to be blown open before the electronic trip unit 72 has time to react. In this condition, magnetic repulsion forces generated in the shunts 70 uncouple the trip link 118 from the insulator link 120 to allow the movably mounted contact arm assembly 58 to be blown open to the position as shown in FIG. 10.

The trip links 118, are best illustrated in FIGS. 5 and 7. One trip link 118 is pivotally connected on each side of the movably mounted contact arm assembly 58 as shown in FIG. 5. Each trip link 118 is formed from an irregular shape with an extending finger portion 143 formed on one end. The extending finger portion 143 is adapted to engage the insulator link 120 during conditions when the trip link 118 is coupled thereto. An aperture 144 disposed adjacent one end to allow pivotal attachment of the trip link 118 to the movably mounted contact arm assembly 58 by way of a pin 146 (FIGS. 5 and 10). Another aperture 148, spaced apart from the aperture 144 allows the pivotal connection of the trip link 118 relative to the insulator link 120 by way of another pin 150.

A third aperture 152 is provided on the trip link 118 for coupling the trip link 118 to the insulator link 120. More specifically, the aperture 152 forms a detent for capturing a spring-loaded detent ball 154 (FIG. 11) disposed on opposing ends of the insulator link 120 as will be discussed below. Spring-loaded detent balls 154 as well as the design of the aperture 152, control the magnitude of electrical current at which blow open of the contacts occurs. More specifically, the detent ball diameter and/or the diameter of the aperture 152 may be varied to adjust the magnitude of electrical current at which blow open occurs. Additionally, the spring force on the detent balls 154 may also be varied. Also, the aperture 152 may be countersunk and chamfered. In such an embodiment, the chamfer angle may be varied in order to adjust the blow open current.

Figure 11:
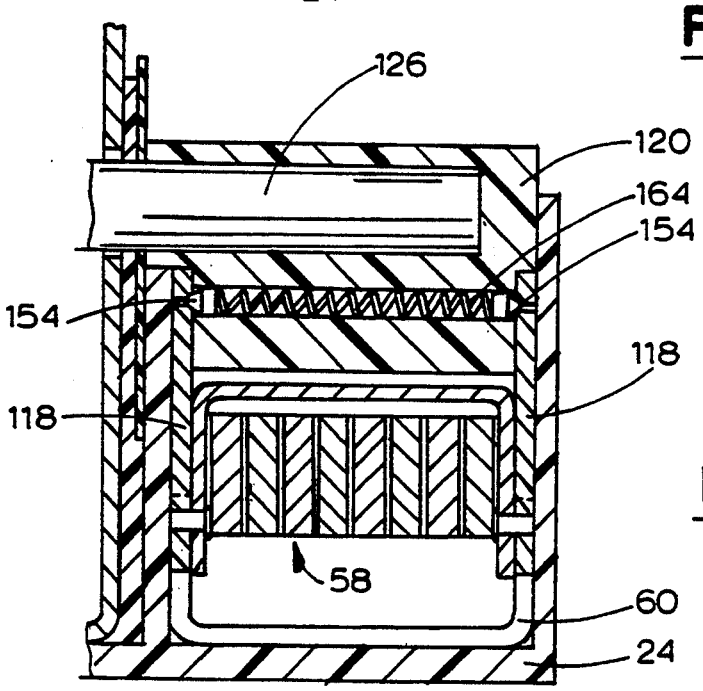
FIG. 11 is a partial sectional view along line 11—11 of FIG. 10.

The insulator link 120 is formed from an electrically insulated material including a cylindrical portion 156 and an irregular-shaped portion 158. The cylindrical-shaped portion 156 includes a centrally disposed bore 160 for receiving the crossbar 126. The irregular-shaped portion 158 also includes a bore 162 for receiving a biasing spring 164 and the detent balls 154 as best shown in FIG. 11. More specifically, biasing spring 164 is disposed in the bore 162. Detent balls 154 are then disposed on opposite ends of the bore 162. The biasing spring 164 biases the detent balls 154 outwardly to apply an outward force against the trip link 120.

The irregular-shaped portion 158 also includes a bore 166 that is adapted to be aligned with the bores 148 in the trip links 118. The pin 150 is then inserted in the aligned bores 148 and 166 to provide a pivotal connection between the insulator link 120 and the trip links 118.

During a relatively large overcurrent condition, such as a short circuit condition, magnetic repulsion forces are created between the shunts 72. These magnetic repulsion forces exert a clockwise moment on the movably mounted contact arm assembly 58 before the electronic trip unit 72 has time to react. In such a situation, the crossbar 126 will be stationary, thus causing the trip links 118 to pivot relative to the insulator link 120. More specifically, since the crossbar 126 is stationary in this condition, the clockwise moment on the movably mounted contact arm assembly 58 forces the detent balls 154 inward against the pressure of the biasing spring 164 to allow the trip links 118 to rotate relative to the insulator link 120 to the position as shown in FIG. 10 to allow the movably mounted contact arm 58 to blow open.

Handle Yoke With Rollers

In order to conserve space within the circuit breaker housing 22, the handle yoke 134 is supported with a plurality of rollers 170 (FIGS. 12-16) relative to the side plates 98. By supporting the handle yoke 134 with rollers 170 on the side plates 98, the virtual pivot axis for the handle yoke 134 can be maintained while at the same time allowing the same space to be used for the crossbar 126. More specifically, in known circuit breakers, such as disclosed in U.S. Pat. No. 4,891,618, the handle yoke is formed as a generally U-shaped member defining a pair of depending legs which are rounded on the free ends. These rounded free ends are disposed in notches formed in the side plates to allow rotation of the handle yoke. Because of the size of the handle yoke and the degree of rotation between an ON position and an OFF position, a substantial amount of space within a circuit breaker is required. Consequently, no other components can be located within such space since they would interfere with the movement of the handle yoke. Accordingly, in such a circuit breaker, the crossbar assembly, mechanically interlocked to the movably mounted contact arm, must be spaced away from the space occupied by the handle yoke. For circuit breakers with relatively large frame sizes, such as a 1600/2000 ampere frame size, such space within the base is normally available. However, with relatively smaller frame size circuit breakers, such as a 1200 ampere frame size, space within the breaker housing is at a premium. The present invention is adapted to be used in such relatively smaller frame size circuit breakers, such as a 1200 ampere frame size. In order to conserve space, the handle yoke 134 is supported by rollers 170 relative to the side plates 98 to essentially maintain the same virtual pivot axis for the handle yoke 134 necessary to accomplish the circuit breaker operations. At the same time, the crossbar 126 can be located within the space normally occupied by the handle yoke pivot axis to conserve space within the housing.

Referring to the drawings and in particular FIGS. 12–15, the side plates 98, which normally carry the circuit breaker operating mechanism 88, are formed with curved surfaces 172. The radius R of such curved surfaces 172 is such to allow the circuit breaker 20 to accomplish all of its normal mechanical operations. More specifically, as shown in FIG. 12, the radius R of the curved surfaces 172 defines a virtual pivot axis 174. As is shown in FIGS. 12 and 13, the virtual pivot axis 174 located in a window 176 in the side plates 98 where the crossbar 126 is located in order to conserve space within the housing 22.

The handle yoke 134, best illustrated in FIG. 16, is formed from a piece of flat steel stock, stamped and formed into the shape illustrated. The handle yoke 134 is formed in a generally U-shape defining a bight portion 176 and two generally depending arm portions 178. Slots 180 are provided between the bight portion 176 and the depending arm portions 178 to allow free travel of the cradle 104 and the upper toggle links 116. The bight portion 176 is also formed with a plurality of slots 182 for receiving spring retainers 136 (FIGS. 2–4) for the operating springs 132. More specifically, the spring retainers 136 are formed with extending arm portions 186 with apertures 188, formed intermediate the end. The spring retainers 136 are inserted into the slots 182 such that the apertures 188 in the spring retainers 136 extend upwardly from the bight portion 176 of the handle yoke 134. A pin 190 is inserted through the apertures 188 to couple the handle yoke 134 to one end of the operating springs 132. The other end of the operating springs 132 are coupled to the crossbar 126.

The depending arm portions 178 of the handle yoke 134 are disposed adjacent the curved surfaces 172 on the side plates 98 as best shown in FIGS. 12–15. A pair of notches 192 are provided in each of the depending arm portions 178. The length of the notches 192 are sized such that when the handle yoke 134 is at the midpoint of travel between oppositely disposed stop surfaces 193 formed in the side plates 98, the length of each notch 192 is one half of the distance to the stop surface 193. These notches 192 allow for travel of the rollers 170 relative to the handle yoke 134. The notches 192 also define projections 194, 196 and 198. More specifically, projections 194 and 198 are defined on each end of the depending arm portions 178 of the handle yoke 134. A projection 196 is defined intermediate the two notches 192. The projections 194, 196 and 198 facilitate orientation of the rollers 170 relative to the handle yoke 134 in the event of slippage. More specifically, as shown in FIG. 13, when the circuit breaker 20 is in an OFF position, the rollers 170 are disposed adjacent the left projection 194 and the center projection 198. When the circuit breaker operating handle 140 is moved toward the ON position as shown in FIG. 5, the rollers 170 are rotated in a counterclockwise direction until the opposing side of the center projection 196 and the right projection 198 engage the handle rollers 170. Thus, in the event of slippage of the handle rollers 170 relative to the handle yoke 134, the notches 192 and the curved surfaces 172 on the depending arm portions 178 of the handle yoke 134, serve to properly orientate the position of the rollers 170 relative to the handle yoke 134.

The end projections 194 and 198 also reduce tilting of the handle yoke 134 relative to the curved surfaces 172 on the side plates 98 in the event that an excessive amount of force is applied to the circuit breaker operating handle 140. In such a situation, the end projections 194 and 198 form pivot axes for any tilting action of the handle yoke 134 relative to the curved surface 172 on the side plate 98. By disposing the pivot axis during such a condition on the ends of the depending arm portions 178, any excessive force applied to the operating handle in either an ON position or an OFF position will be opposed by the force of the operating springs 132 used to couple the handle yoke 134 to the side plates 98 thus minimizing tilting of the handle yoke 194.

As shown best in FIG. 15, each roller 170 is formed with a pin 192 with rigidly mounted disks 194 mounted on each end. The space between the inwardly facing faces of the disks 194 is sized to be slightly greater than the width of the side plate 98. The spaced apart disks 194 capture the side plate 98 and provide axial stability of the handle yoke 134 relative to the side plate 98.

Arcing Contact Spring Housing

A housing 200 is provided for the biasing springs for the arcing contact which shield the biasing springs from conductive gases generated during interruption. More specifically, in known circuit breakers, such as the circuit breaker disclosed in U.S. Pat. No. 4,891,618, the contact pressure for the arcing contacts is provided by disposing a spring between the top surface of the arcing contact arm and the bottom surface of the contact arm carrier. In such a design, the arcing contact springs are subject to conductive gases which can deteriorate the springs causing a maloperation of the arcing contacts which, in turn, can result in damage to the arcing contacts as well as the main contacts.

The spring housing 200 (FIGS. 2–5) is formed from a piece of flat stock and formed in a generally boxshape with one open side and open on the top. One face 201 of the spring housing 200 is provided with a pair of spaced apart apertures 202, used for locating the spring housing 200 as well as biasing springs 203. More specifically, as shown best in FIG. 5, arcing contact arms 204 are provided with locating tabs 206. These locatinq tabs 206 are received in the apertures 202 in the spring housing 200 which function to locate the spring housing 200 relative to the arcing contact arm 204 and also to prevent longitudinal as well as transverse movement of the spring housing 200 relative to the arcing contact arm 204 after assembly.

The spring housing 200 is captured between the arcing contact arm 204 and a carrier 208. As shown in FIG. 5, the carrier 208 is formed in an L-shape at the free end. Tabs 210 are formed on the underside of the carrier surface adjacent the free end. One end of the biasing spring 203 is received over tab 210. The other end of the biasing spring 203 is disposed about the locating tab 206, formed on the arcing contact arm 204. The tabs 206 and 210 serve as spring retainers.

Clinch Joint Arcer Assembly

Figure 17:
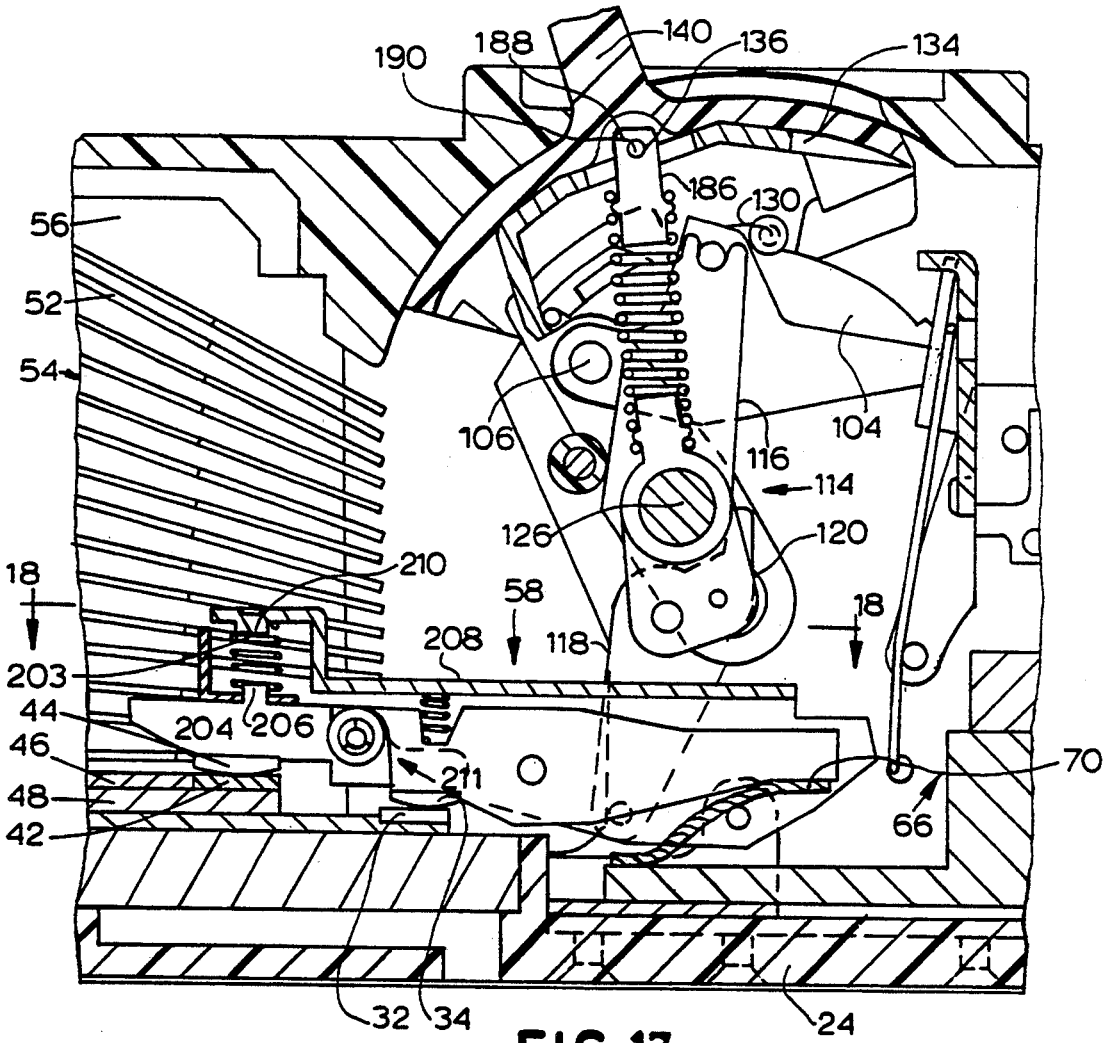
FIG. 17 is a sectional view similar to FIG. 2 illustrating the clinch joint arcing contact assembly with the circuit breaker in an ON position.
Figure 18:
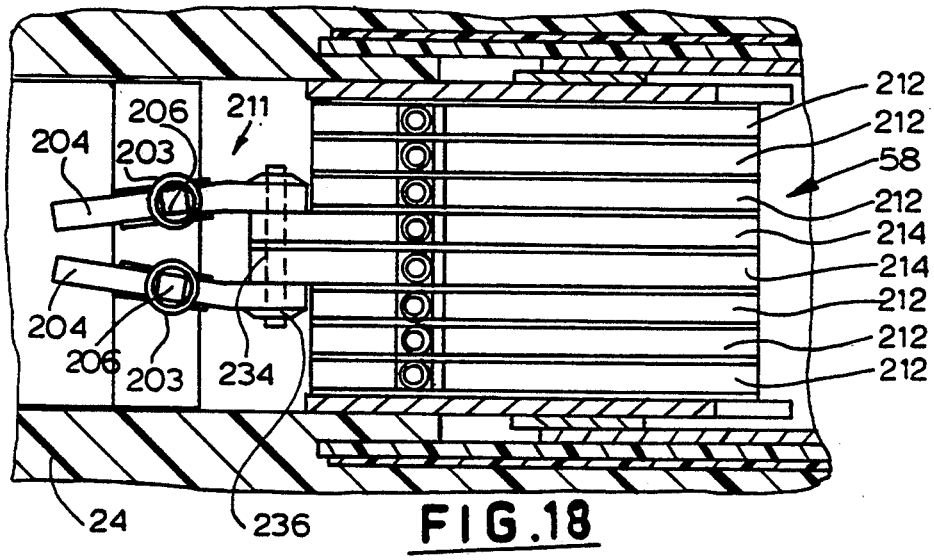
FIG. 18 is a sectional view along line 18—18 of FIG. 17.
Figure 19:
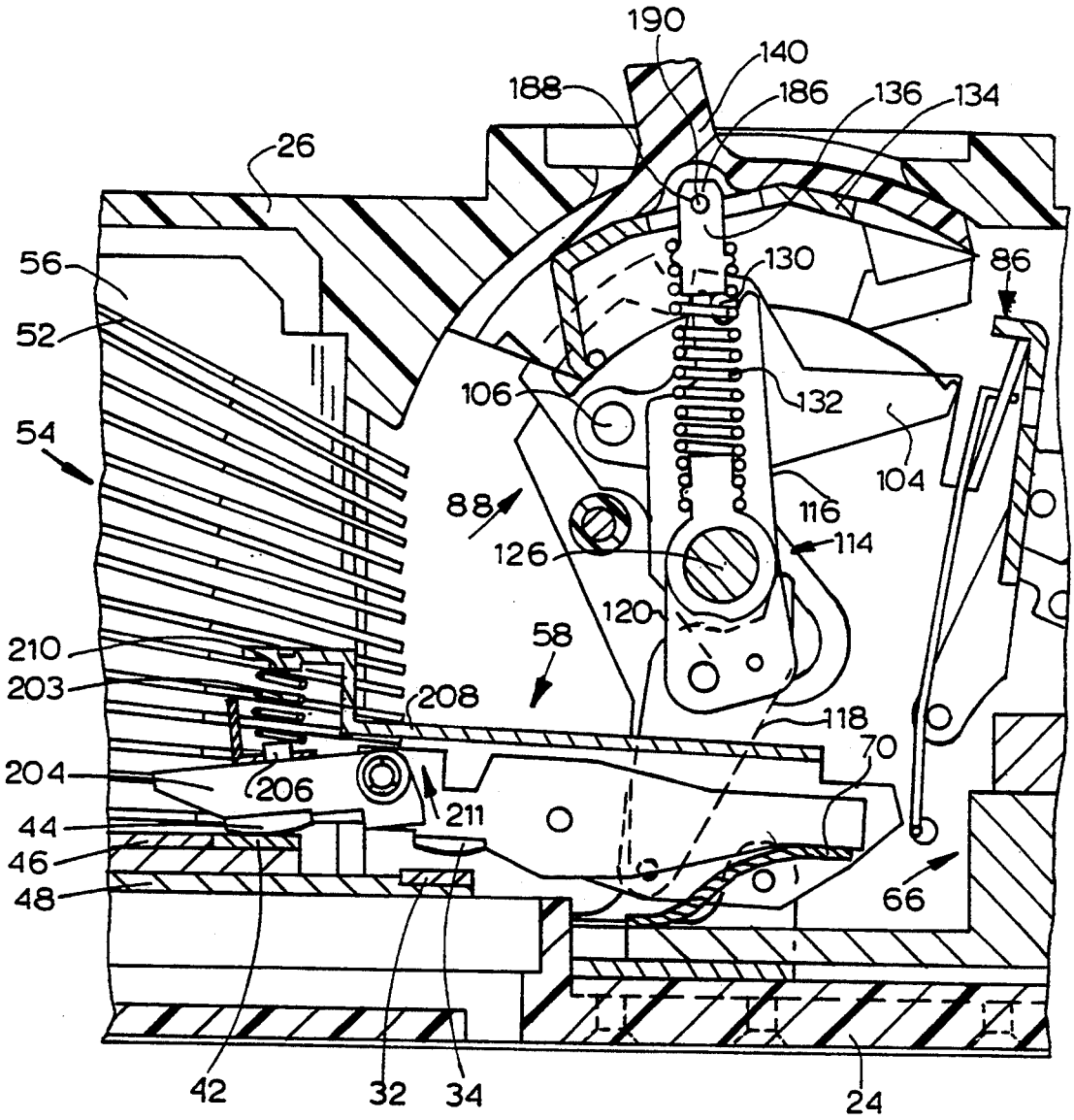
FIG. 19 is similar to FIG. 17 illustrating the separation of the main contacts while the arcing contacts remain in an ON position.

A clinch joint arcer assembly 211 is illustrated in FIGS. 17–19. The clinch joint arcer assembly offers several advantages over known movable arcing contacts. More specifically, such movable arcing contacts, such as disclosed in U.S. Pat. No. 4,891,638, are carried by separate arcing contact arms. The arcing contact arms are combined with a plurality of main contact arms to form a laminated contact arm assembly. The arcing contact arms as well as the main contact arms are pivotally mounted about a single pivot axis. By utilizing separate contact arms for the arcing contacts and the main contacts, the contact arm assembly occupies a relatively large amount of space within a circuit breaker housing. While such an assembly as disclosed in the aforementioned patent may be suitable for relatively larger frame size circuit breakers, it is not suitable in some cases for relatively smaller frame size circuit breakers, such as a 1200 ampere frame size breaker.

Arcing contacts are adapted to reduce wear on the circuit breaker main contacts as well as to reduce temperature rise within the circuit breaker housing during a circuit interruption. This is generally accomplished by forcing the main contacts to be opened before the arcing contacts in order to transfer the electrical current to the arcing contacts. In known circuit breakers, such as the circuit breaker disclosed in the aforementioned patent, the arcing contacts are generally placed at a relatively longer pivot radius than the main contacts. Since the contact arm assembly is normally in a sliqht overtravel position to create contact pressure between the main contacts and the arcing contacts, rotation of the contact arm assembly will generally cause the main contacts to be separated prior to the arcing contact since the arcuate travel of the main and arcing contacts will be different due to the difference in pivot radii for a given degree of rotation of the contact arms.

The clinch joint arcer assembly 211 provides greater control of transfer of the electric current to the arcing contacts by placing the arcing contacts on a different pivot axis than the main contacts, which in conjunction with biasing springs, ensures that the main contacts are fully separated prior to separation of the arcing contacts. By providing more efficient transfer of the electric current from the main contacts to the arcing contacts, the wear on the main contacts is minimized.

Another advantage of the clinch joint arcer assembly 211 is that the contact arm assembly, which may include a pair of arcing contacts, and a plurality, for example, six main contacts, requires less space in a circuit breaker housing than known contact arm assemblies, for example, as disclosed in U.S. Pat. No. 4,891,638. More specifically, the arcing contacts in accordance with the present invention are carried by arcing contact arms that are pivotally connected to contact arms that carry movable main contacts. By pivotally connecting the arcing contact arms to the main contact arms, the contact arm assembly in accordance with the present invention utilizes less space within the circuit breaker housing making it particularly suitable for circuit breakers with relatively small frame sizes, such as a 1200 ampere frame size.

As shown in FIGS. 5 and 17–19, the contact arm assembly 58 is formed from a plurality of main contact arms 212 and 214 and a pair of arcing contact arms 216. As will be discussed in more detail below, the main contact arms 214 are adapted to be pivotally connected to the arcing contact arms 216 by way of a clinch joint assembly 211. As best illustrated in FIG. 18, two main contact arms 214 are disposed on each side of the main contact arms 212 to form a laminated contact arm assembly 58.

Each of the main contact arms 212 (FIG. 20) and 214 (FIG. 21) are provided with apertures 216 to allow the main contact arms 212 and 214 to be pivotally connected by way of aligned apertures 218 (FIG. 5), provided in the carrier 208 by way of a pin 220.

As best illustrated in FIG. 5, the carrier 208 is an irregular-shaped member formed with two additional pairs of aligned apertures 220 and 222. The aligned apertures 220 allow the carrier 218 to be pivotally connected to the trip link 118 by way of the pin 146. The aligned apertures 222 allow the carrier 218 to be pivotally connected to the bracket 60 by way of a pin 223 (FIGS. 2–4).

Figure 20:
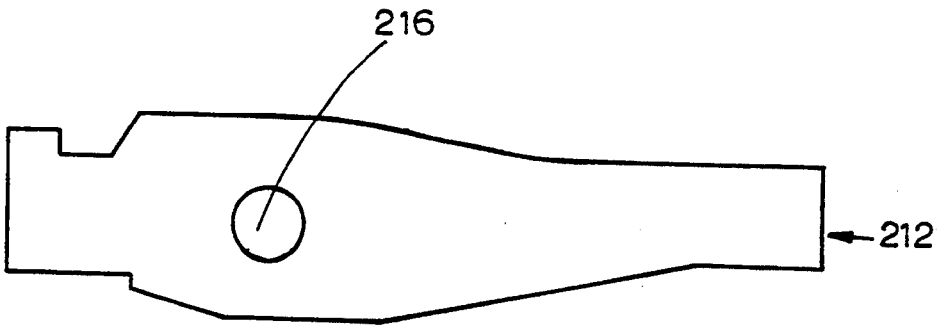
FIG. 20 is an elevational view of a main contact arm in accordance with the present invention.
Figure 21:
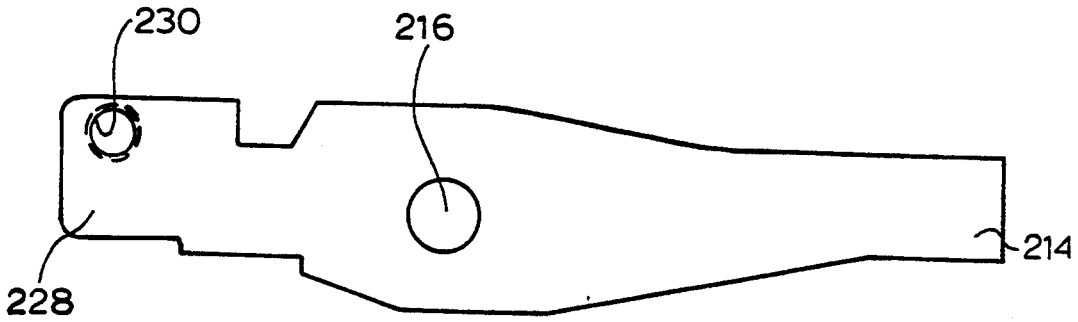
FIG. 21 is an elevational view of another main contact arm adapted to be pivotally connected to an arcing contact arm in accordance with the present invention.
Figure 22:
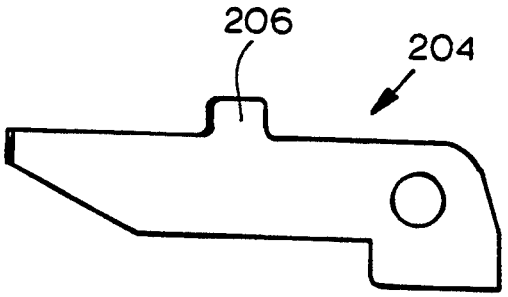
FIG. 22 is an elevational view of an arcing contact arm in accordance with the present invention.

The main contact arms 214 (FIG. 21) are formed to be relatively longer than the-main contact arms 212 defining an extending portion 228 (FIG. 20). An aperture 230 is provided in the extending portion 228. This aperture 230 allows the arcing contact arms 216 to be pivotally connected thereto. More specifically, each of the arcing contact arms 216 (FIG. 22) is adapted to be disposed adjacent the extending portions 228 of the main contact arms 214. The arcing contact arms 216 are formed with an aperture 232 on one end. The aperture 232 is adapted to be aligned with the apertures 230 in the extending portions 228 of the main contact arms 212. A clinch joint 211 assembly (FIG. 18) which includes a pin 234 and a plurality of spring washers 236 is used to connect the arcing contact arms 216 to the extending portions 228 on the main contact arms 214. By providing a clinch joint 211, the friction between the arcing contact arms 216 relative to the main contact arms 214 can readily be adjusted.

As best shown in FIG. 17, the circuit breaker 20 is illustrated in an ON position. In this position, both the main contacts 30 and the arcing contacts 40 are closed. During a trip or blow open condition, the clinch joint 211 allows the main contacts 30 to rather readily be separated prior to the arcing contacts 40. More specifically, FIG. 19 illustrates the position of the main contacts 30 as well as the arcing contacts 40 immediately after the initiation of a trip or blow open condition. In this condition, the contact arm assembly 58 begins to rotate in a clockwise direction as a result of the magnetic repulsion forces generated between depending legs of the flexible shunts 70, used to connect the movably mounted contact arm assembly 58 to the load side conductor 38. As the contact arm assembly 58 begins to rotate in a clockwise direction, the main contact arms 212 and 214 pivot in a clockwise direction as shown to separate the main contacts 30. Clockwise rotation of the main contact arms 212 and 214 causes the clinch joint pivot axis, defined by the pin 236, to move slightly upwardly under the influence of the biasing springs 203 disposed between the arcing contact arms 216 and the carrier 58, which, in turn, causes the arcing contact arm 216 to pivot in a counterclockwise direction. Accordingly, by placing the arcing contact arms 216 on a different pivot axis than the main contact arms 212 and 214, thus creating a two bar linkage, and taking advantage of the spring pressure of the biasing springs 203, the assembly rather efficiently transfers the electric current from the main contact arms 212 and 214 to the arcing contact arms 216 during an interruption. Moreover, by pivotally mounting the arcing contact arms 216 relative to the main contact arms 214, the assembly utilizes relatively less space within the circuit breaker housing 22 making it more suitable for circuit breakers having a relatively smaller frame size.

Positive Off Link

Positive off links are generally used to prevent the circuit breaker operating handle from being placed in an OFF position during a condition when the main contacts weld together, for example, during interruption of an excessive short circuit current. During such a condition, in order that the operating handle reflect the proper status of the circuit breaker contacts, it is necessary to provide a mechanism to prevent the circuit breaker operating handle from being placed in an OFF position when the main contacts are in fact welded. Various mechanisms are known for preventing the circuit breaker operating handle from being placed in an OFF position when the main contacts are welded. For example, U.S. patent application Ser. No. 07/511,700, filed on Apr. 20, 1990, assigned to the same assignee as the assignee of the present invention, discloses such a mechanism. However, that mechanism only prevents the circuit breaker operating handle from being placed in an OFF position and does not return the circuit breaker operating handle to the ON position afterward. Moreover, such a mechanism only prevents movement of the circuit breaker operating handle and cannot attempt to break the weld of the main contacts.

The positive off mechanism in accordance with the present invention solves such problems. First, the positive off mechanism in accordance with the present invention allows an operator to attempt to break the weld of the main contacts by applying a sufficient amount of force to the circuit breaker operating handle. In the event that the force applied to the operating handle is insufficient, the positive off mechanism in accordance with the present invention returns the operating handle to the ON position.

Figure 23:
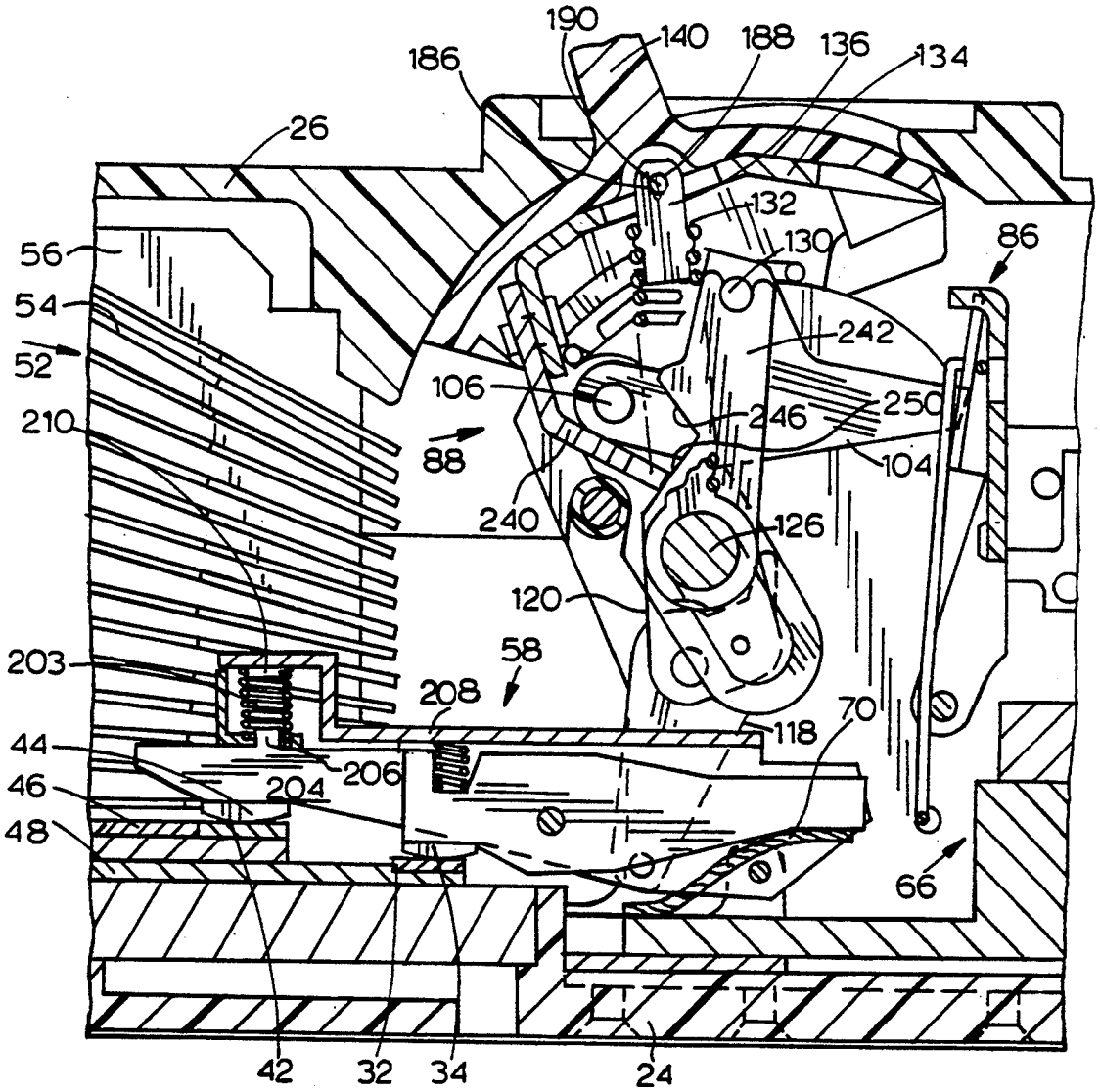
FIG. 23 is similar to FIG. 2 illustrating a positive off link in accordance with the present invention.
Figure 24:
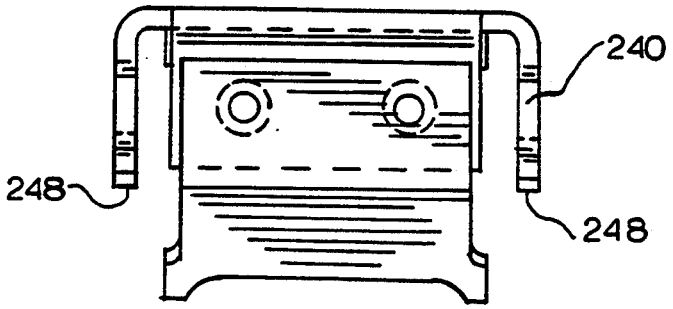
FIG. 24 is an elevational view of a weld bracket in accordance with the present invention.

Referring to the drawings and in particular FIGS. 23 and 24, the positive off mechanism in accordance with the present invention includes a weld bracket 240 and a modified upper toggle link 242. The weld bracket 240 is formed as a generally U-shaped member and is adapted to be rigidly connected to the handle yoke 134 with suitable fasteners 244. The modified upper toggle link 242 is similar to known toggle links except it is provided with a generally V-shaped notch 246 as shown in FIG. 19.

During normal conditions, the modified positive off link 242 does not interfere with the operation of the circuit breaker 20. More specifically, when the circuit breaker 20 is switched from an OFF position to an 0N position, the upper link 242 generally lags behind the handle yoke 134. Moreover, when the circuit breaker 20 is moved from an ON position to an OFF position, the upper link 242 will travel in front of the handle yoke 134. However, during a contact weld position, the positive off link 242 can be used to attempt to break the weld and if unsuccessful, will return the operating handle 140 to the ON position. More specifically, during a contact weld position, free ends 248 of the weld bracket 240 will engage a stop face 250 formed on the positive off link 242 defined by the V-shaped notch 246 in the positive off link 242. The stop face 250 on the positive off link 242 is positioned to stop the handle yoke 134 before the operating mechanism 88 goes past the overcenter position, which prevents toggling of the toggle assembly 114.

By applying a sufficient amount of force to the operating handle 140, the free ends 248 of the weld bracket 240 will, in turn, apply force to the positive off link 242 to attempt to break the weld. If the weld cannot be broken, the operating handle 140 will be returned to the ON position under the influence of the operating springs 132 since the toggle assembly 114 is prevented from moving past the overcenter position.

Reversible Barrier

Figure 27:
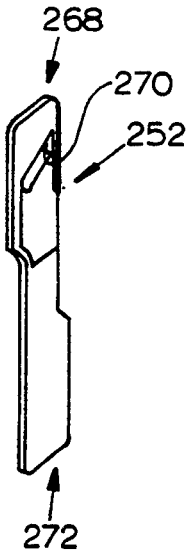
FIG. 27 is a perspective view of a reversible phase barrier in accordance with the present invention with an auxiliary contact switch partially removed.

Another important aspect of the present invention relates to a reversible barrier 252 (FIG. 27). As mentioned earlier, the circuit breaker housing includes a molded base 24 and a coextensive cover 26. The molded base 24 is formed with one or more integrally formed sidewalls 254. These sidewalls 254 generally act as interphase gas barriers to prevent conductive gases generated during a circuit interruption from causing either phase to phase or phase to ground faults within the circuit breaker housing 22. The sidewalls 252 are generally formed as solid members to allow them to be used as interphase gas barriers.

Figure 25:
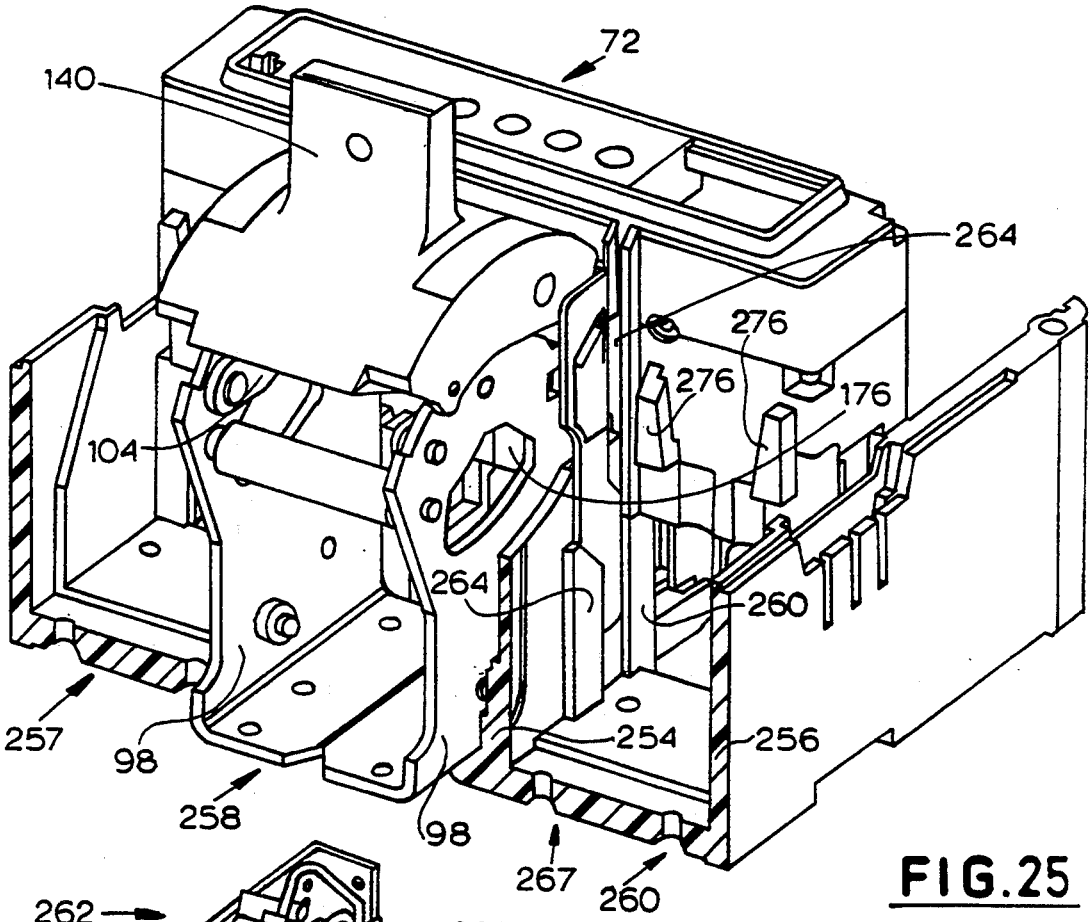
FIG. 25 is a partial perspective view of a circuit breaker illustrating a reversible phase barrier in accordance with the present invention in a first position.
Figure 28:
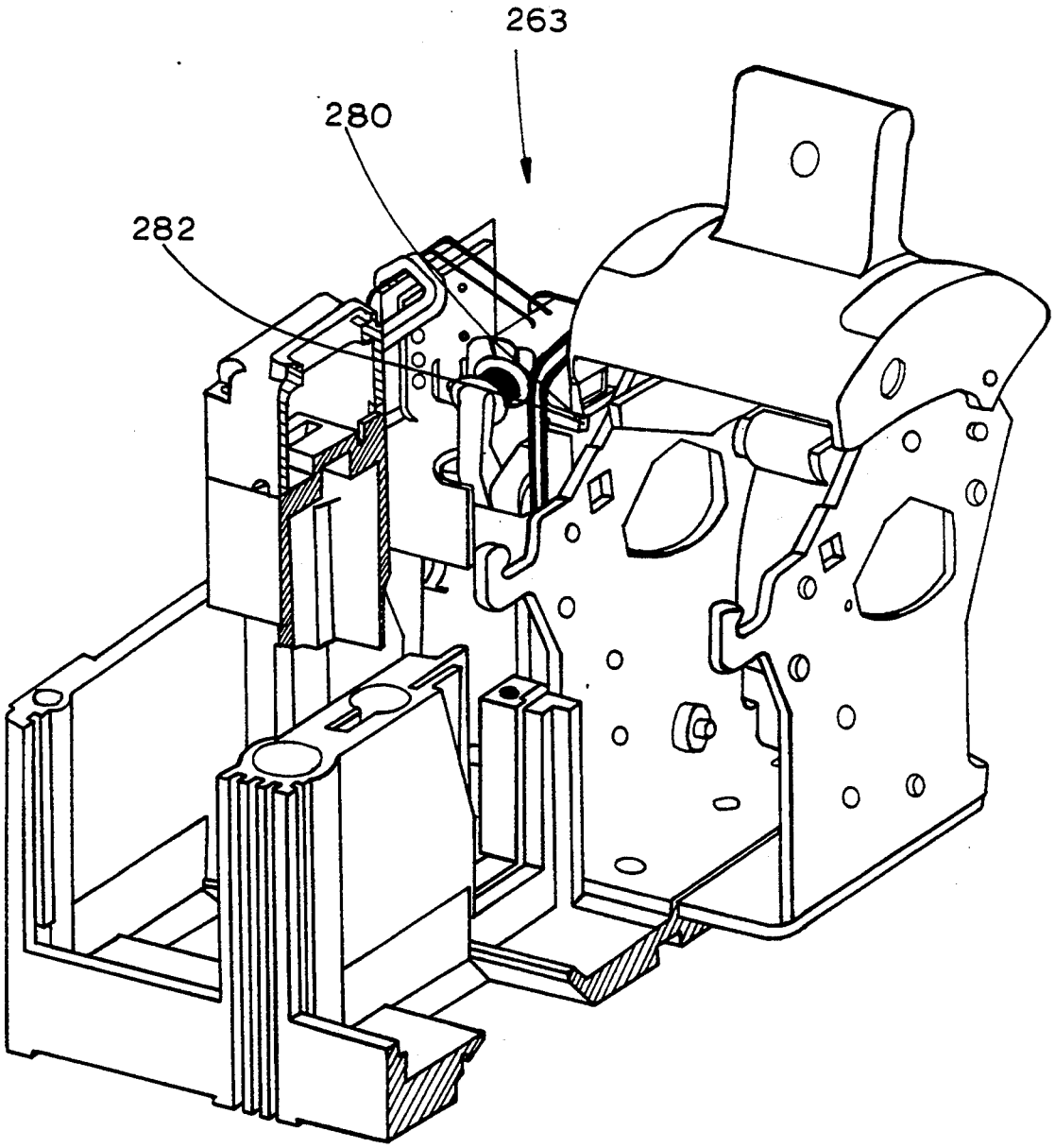
FIG. 28 is a partial perspective view of circuit breaker with an undervoltage release mechanism installed.
Figure 29:
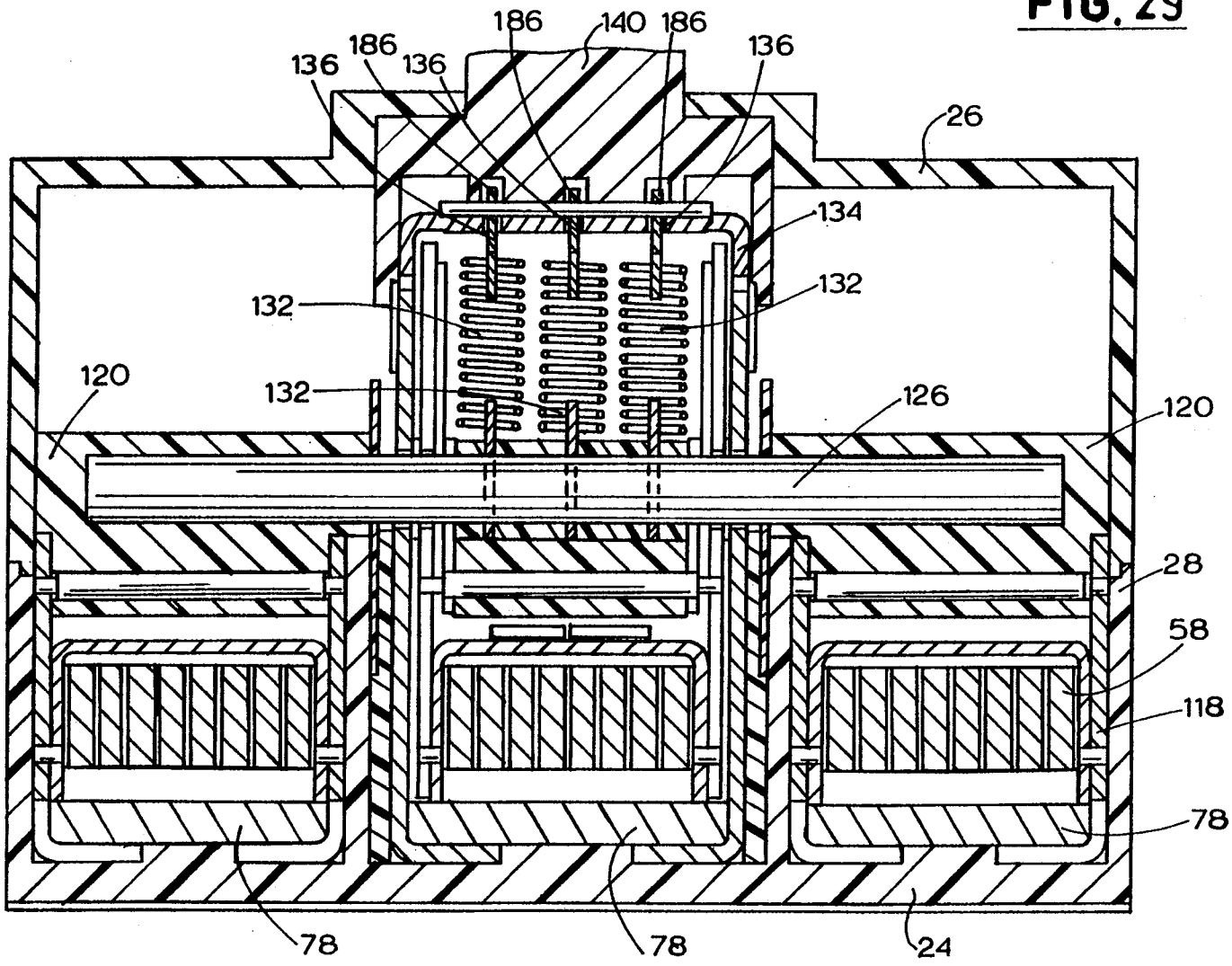
FIG. 29 is an end sectional view along line 29—29 of FIG. 1.

For three phase circuit breakers as shown in FIG. 28, two sidewalls 254 are provided within the base 24. These sidewalls 254 along with the exterior end walls 256 of the housing 22 define three phase compartments 257, 258 and 260 (FIG. 25). The operating mechanism 88 is disposed in the center phase compartment 258. Due to the space limitations within the center phase compartment 258 after the operating mechanism 88 is installed, it is necessary to locate various circuit breaker auxiliaries 262, such as an undervoltage release mechanism 263, an auxiliary contact assembly 265, and the like, in the outer phase compartments 257 and 260. One known auxiliary, an auxiliary switch, is disclosed in U.S. Pat. No. 4,928,079, assigned to the same assignee as the present invention and hereby incorporated by reference.

Since certain auxiliaries 262, such as an undervoltage release mechanism 263 need to be interlocked, for example, with components in the center phase compartment 258; for example, the circuit breaker operating handle 140 or the operating mechanism 88, it is necessary to provide an opening in one side of the sidewalls 254. However, since such auxiliaries 262 are not provided on all circuit breakers 20, separate molded bases have heretofore been provided. More specifically, for circuit breakers 20 provided without auxiliaries 262, a separate molded base has heretofore been provided with solid sidewalls. For those applications where circuit breaker auxiliaries, such as an undervoltage release mechanism, are to be provided, a different molded base with an opening in one of the sidewalls has been provided to allow communication between the auxiliary located in the outer phase compartment and the center compartment 258. The use of separate base units for circuit breakers depending on whether or not auxiliaries are to be provided with the circuit breaker results in increased cost of the circuit breaker. The reversible phase barrier 252 in accordance with the present invention solves this problem and allows a single molded base with an opening 264 in one of the sidewalls 252 to be manufactured. The reversible phase barrier 252 is adapted to be disposed in the opening 264 to enable the molded base to be used for both applications.

Figure 26:
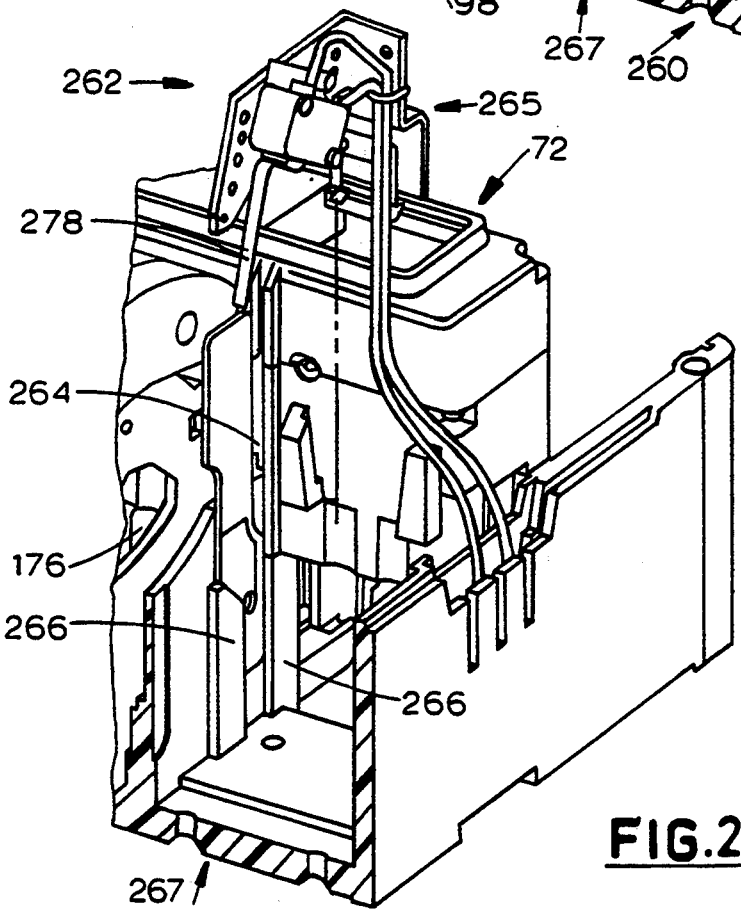
FIG. 26 is similar to FIG. 25 illustrating the reversible phase barrier in a second position.

More specifically, referring to the drawings and in particular FIGS. 25–28, a modified base unit 267 is illustrated which includes a sidewall 254 formed with the opening 264 defined between the electronic trip unit 72 and the cross bar 126 as shown in FIGS. 25 and 26. Disposed below and adjacent the opening 264 on opposing sides are track members 266. The track members 266 allow the reversible phase barrier 252 in accordance with the present invention to be rather easily inserted and removed.

The reversible phase barrier 252 is illustrated in FIG. 27. The reversible phase barrier 252 may be formed in a generally rectangular-shape from an electrically insulating material. One end 268 of the reversible phase barrier 252 is provided with a slot 270. The other end 272 of the reversible phase barrier 252 is solid. The width of the reversible phase barrier 252 is provided to allow quick and easy insertion and removal of the phase member relative to the track members 266.

For circuit breakers 20 provided without auxiliaries 262 as shown in FIG. 25 or with auxiliaries, such as auxiliary contacts 265 shown in FIG. 26, which can be interlocked with the trip link 120 located in an outer phase compartment 257 or 260, the end 268 of the reversible phase barrier 252 is disposed between the track members 266. In this position, the opening 264 formed in the sidewall 252 will be blocked forming an interphase gas barrier.

Such auxiliary contacts 263 are generally provided with a bracket 274, adapted to be received between spaced apart track members 276, integrally formed on the electronic trip unit 72. Once mounted, with an actuator arm 278, formed as part of the auxiliary contact mechanism 263, will be disposed adjacent the trip link 120 located in an outer phase compartment 257 or 260 to allow interlocking therebetween.

For auxiliaries 262, such as undervoltage release mechanisms 263, as illustrated in FIG. 28, the reversible phase barrier 252 may be reversed such that the solid end 272 is disposed between the track members 266 formed in the side wall 252. In this position, the slot end 268 of the barrier 252 will be disposed upwardly such that the slot 270 is aligned with the opening 264 to allow communication between the center phase compartment 258 and the outer phase compartment 257. As shown in FIG. 28, this allows the undervoltage release mechanism 263, normally installed on the load side of an outer phase compartment 257 or 260 to communicate with the center compartment 258. More specifically, the undervoltage release mechanism 263 includes a generally L-shaped actuation arm 280 (FIG. 28) that is normally interlocked with the circuit breaker operating handle 140. By disposing the reversible barrier 252 such that the slot 270 is aligned with the opening 264, an extending portion 282 of the actuator arm 280 is received in the slot 270 to allow communication with the operating handle 140.

Various other circuit breaker auxiliaries 262 are known in the art such as shunt trips and bell alarm contacts. It will be appreciated by those of ordinary skill in the art that the principles of the present invention are adapted to be utilized with all of such auxiliaries. The interlocking between those auxiliaries and the circuit breaker is well within the ordinary skill in the art and thus does not form a part of the present invention.

Reverse Current Loops

As shown in FIGS. 30–33, alternate line conductors 300, 302, 304 and 306 are provided to create reverse current loops between the line conductors 300, 302, 304 and 306 and the main and/or arcing contact arms 212 and 204 (FIG. 5), respectively, to generate sufficient magnetic repulsion forces during relatively high overcurrent conditions, such as a short current condition, to blow open the movably mounted main contacts 34 and/or the movably mounted arcing contacts 44 relatively quicker than known electronic or thermomagnetic tripping mechanisms. More specifically, known electronic and thermomagnetic tripping mechanisms take at least one cycle to trip a circuit breaker. The reverse current loops created by the line conductors 300, 302, 304 and 306 in accordance with the present invention are able to trip a circuit breaker in less than one cycle.

Reverse current loops have heretofore not been known to be used for relatively larger circuit breakers (i.e., circuit breakers having a rating of greater than 600 amperes) due to manufacturing and design constraints. More specifically, known means for forming reverse current loops, for example, as disclosed in U.S. Pat. No. 4,950,853, assigned to the same assignee as the assignee of the present invention, involves cutting a generally U-shaped slot in the line conductor to form a pair of spaced apart depending leg portions and a center peninsula portion. A single fixed main contact is carried by the peninsula portion. In such a design, electrical current from the line side terminal flows in a first direction along the depending leg portions. The electrical current in the depending leg portion flows into the peninsula portion in a reverse direction and, in turn, into the fixed main contact. While the circuit breaker is in a closed position, the electrical current in the peninsula portion flows in a direction opposite to the direction of electrical current flow in the movably mounted main contact arm. During relatively high level overcurrent conditions, such as a short circuit condition, magnetic repulsion forces are generated due to the electrical current flowing in opposite directions between the movably mounted main contact arm and the line conductor to cause the movably mounted contact arm to blow open. While such a configuration as described in the aforementioned patent may be suitable for certain types of circuit breakers, for example, circuit breakers having a single pair of separable contacts per pole, it is not suitable for circuit breakers having multiple pairs of separable main contacts per pole, such as the circuit breaker 20, which may have six or more pairs of separable main contacts per pole.

Moreover, other reverse current loop configurations, such as disclosed in U.S. Pat. No. 4,551,597, assigned to the same assignee as the present invention, are likewise not suitable. More specifically, the configuration disclosed in the '597 patent generally entails bending the line conductor into a generally U-shape. While such a configuration may be suitable in certain applications, it is not suitable for relatively compact circuit breakers, such as a current limiting circuit breaker and circuit breakers having relatively high electrical current ratings, for example, 1200 amperes. More specifically, there is generally insufficient space within relatively compact circuit breakers for such U-shaped line conductors. Moreover, for circuit breakers having relatively high ratings, for example, 1200 amperes, the line conductor is normally formed from a copper conductor generally about $\frac{5}{8}$ inches thick. As such, such line conductors cannot be formed into a U-shape without damage.

Figure 30:
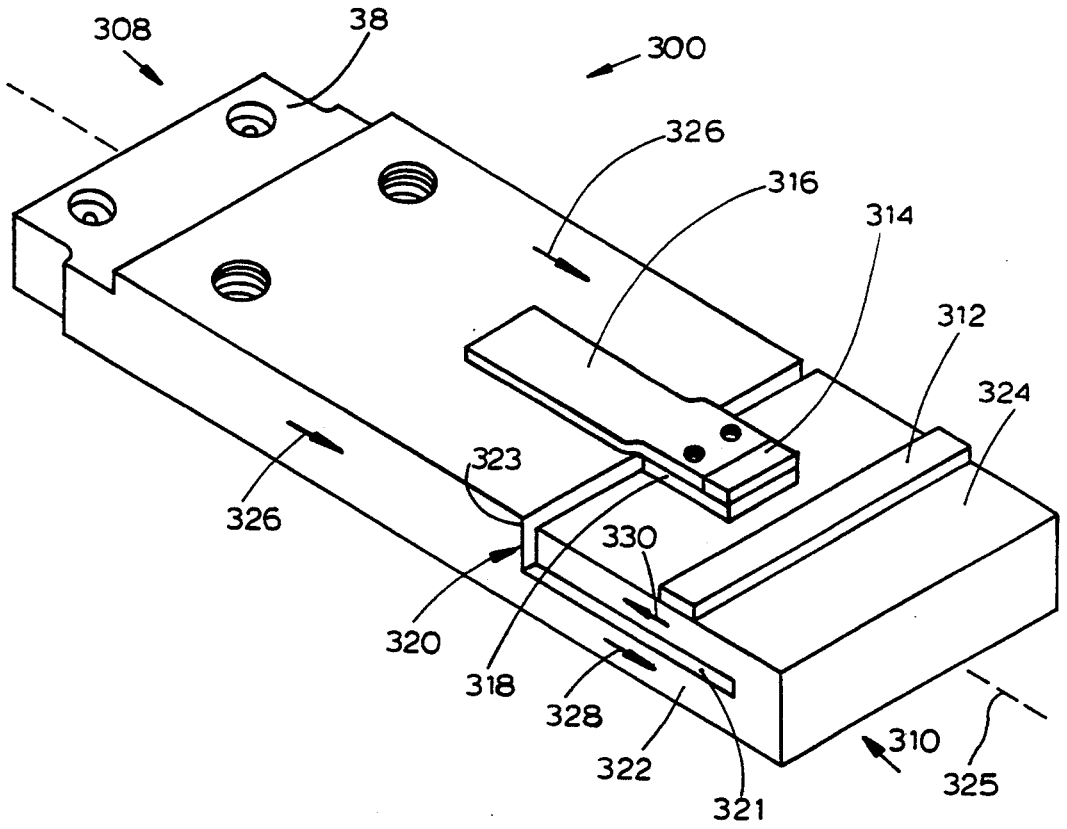
FIG. 30 is a perspective view of a line conductor in accordance with the present invention.
Figure 31:
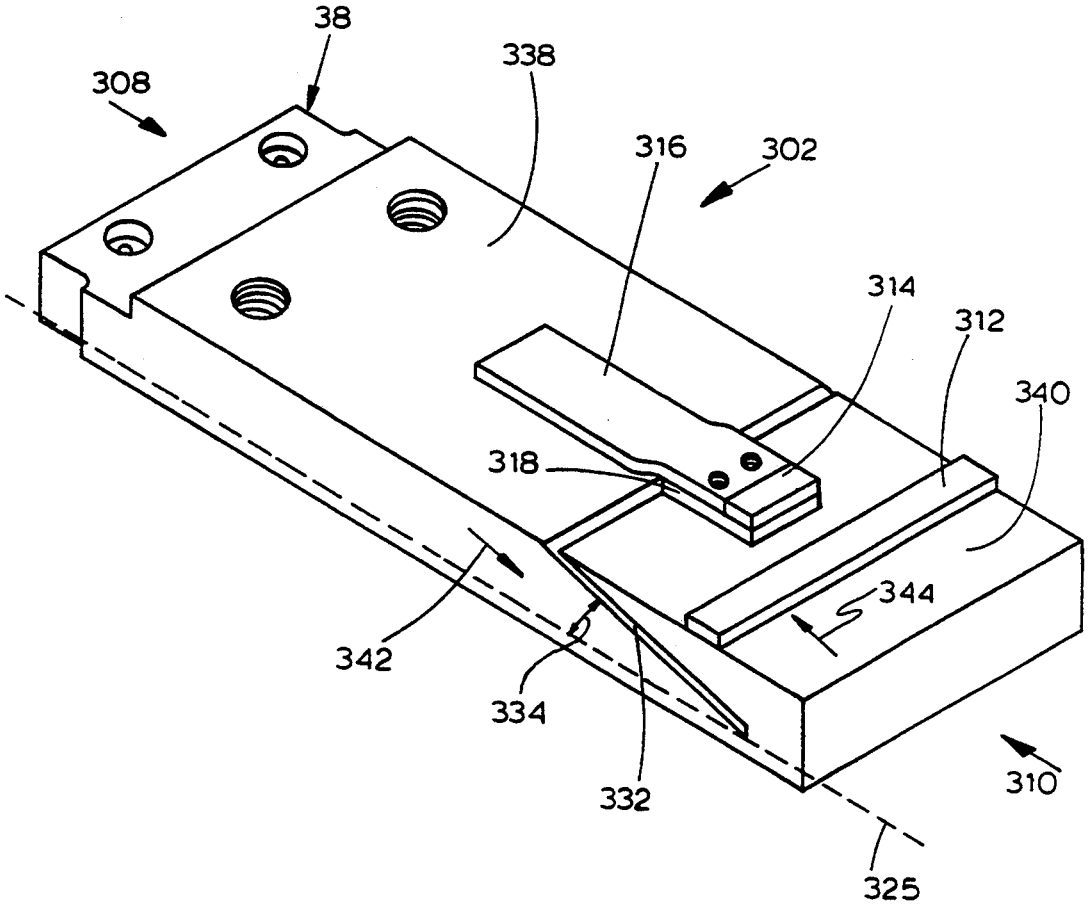
FIG. 31 is an alternate embodiment of the line conductor illustrated in FIG. 30.
Figure 32:
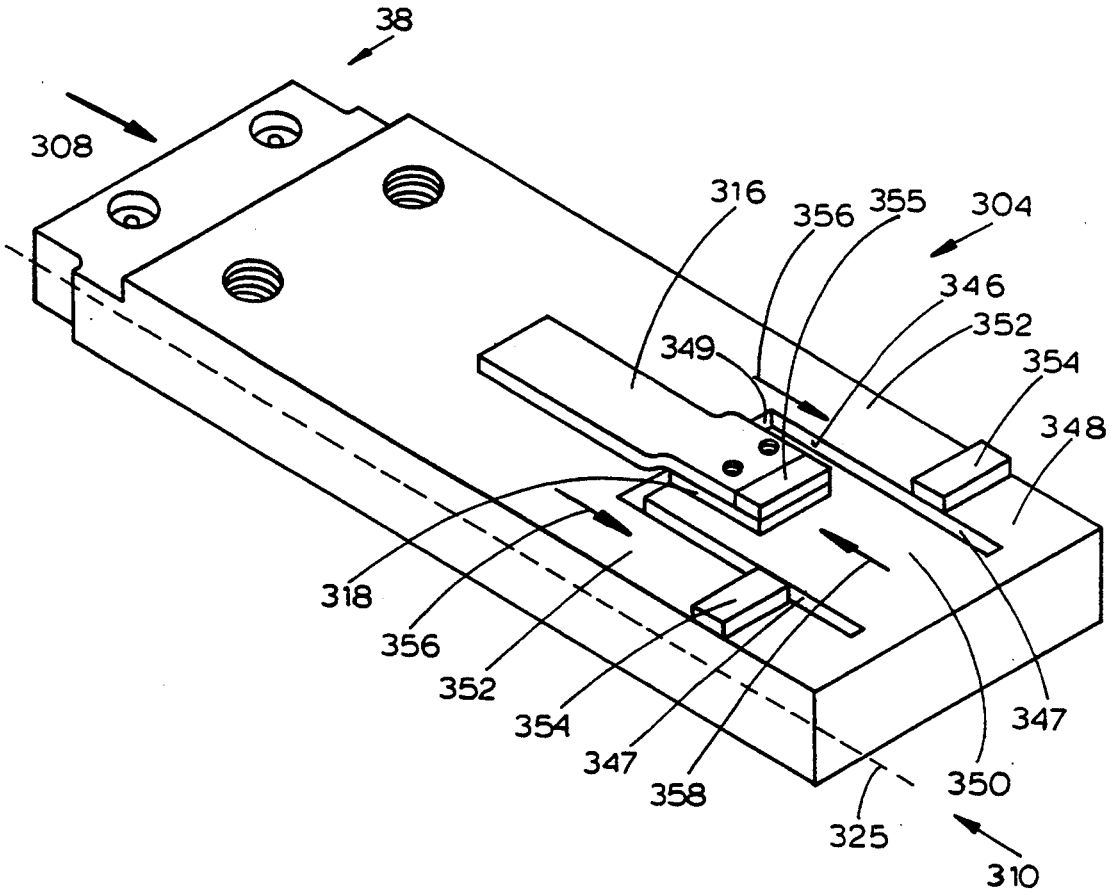
FIG. 32 is an alternate embodiment of the line conductor illustrated in FIG. 30.
Figure 33:
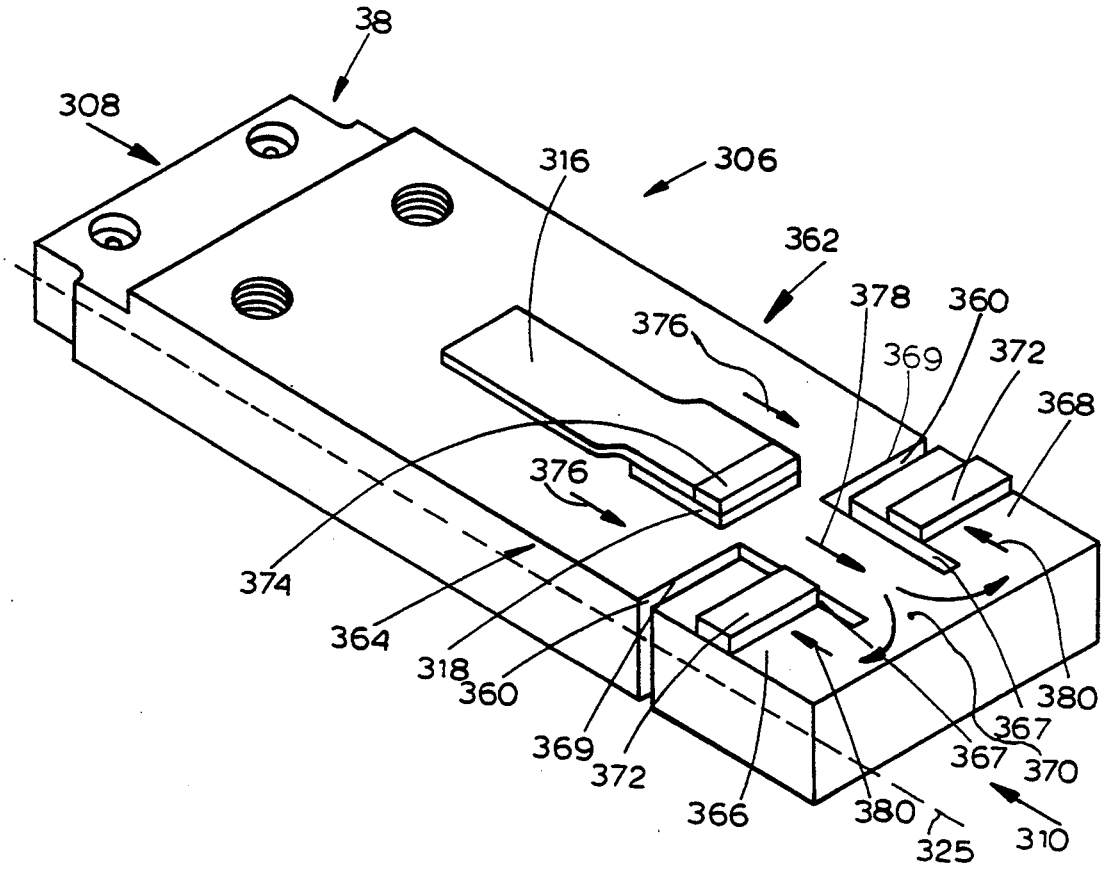
FIG. 33 is an alternate embodiment of the line conductor illustrated in FIG. 30.

The line side conductors 300, 302, 304 and 306 in accordance with the present invention, adapted to be used in lieu of the line side conductor 36 described above, solve this problem by providing configurations of the line side conductor that are suitable for relatively compact current limiting circuit breakers while at the same time providing a configuration suitable for multiple pairs of separable contacts per pole. Various embodiments of the line conductors in accordance with the present invention for creating reverse current loops are illustrated in FIGS. 30–33. FIGS. 30 and 31 represent configurations in which reverse current loops are formed in both the main contact arms 212 as well as the arcing contact arms 204 (FIG. 5). FIG. 32 illustrates a configuration wherein a reverse current loop is created relative to the arcing contact arms 204 but not the main contact arms 212. FIG. 33 illustrates a configuration wherein a reverse current loop is created relative to the main contact arms 212 but not relative to the arcing contact arms 204. Each of the configurations illustrated in FIGS. 30–33 allows the interruption time of the circuit breaker during relatively high overcurrent conditions, such as short circuit condition, to be improved relative to known electromechanical and electronic tripping devices.

Referring to FIGS. 30 and 31, reverse current loops are created relative to both the main contact arms 212 as well as the arcing contact arms 204 (FIG. 5). With such a configuration, the magnetic repulsion forces generated during a relatively high level overcurrent condition, such as a short circuit condition, will add to the magnetic repulsion forces generated due to the reverse current loop generated in the flexible shunts 70 (FIGS. 24) as described above.

Referring to FIG. 30, a line side conductor 300 in accordance with the present invention is formed from a generally rectangular conductor material, such as copper. One end 308 of the line side conductor 300 is formed as a line side terminal 38, similar to the line conductor 36 discussed above. The opposite end 310 (hereinafter "contact end") of the line side conductor 300, is adapted to carry an elongated stationary mounted main contact 312 suitable for circuit breakers having multiple pairs of separable main contacts 34, as well as an elongated stationary mounted arcing contact 314, suitable for circuit breakers having one or more pairs of separable arcing contacts 44. The elongated main contact 312 adapted to be rigidly affixed to the line side conductor 300 by welding, brazing or the like. The elongated arcing contact 314 is rigidly attached to an elongated plate 316, for example, by brazing, which, in turn, is rigidly attached to the line side conductor 300 on one end by brazing, welding or the like. The other end of the elongated plate 36 is rigidly secured to another plate 318, which, in turn, is rigidly secured to the line side conductor 300 by way of fasteners (not shown) and/or by brazing and the like.

A generally L-shaped cut out 320 is formed in the contact end 310 of the conductor 300 defining a relatively longer leg portion 321 and a shorter leg portion 323, disposed adjacent the main contact 312 and the arcing contact 314 such that the long leg portion is generally parallel to a longitudinal axis 325 and the short leg portion 323 is generally transverse to said longitudinal axis 325. The line side conductor 300 with the L-shaped cut out 320 may be formed in various ways, all of which are considered to be within the scope of the present invention. For example, the line side conductor 300 with the L-shaped cut out 320 may be formed by casting or by forming the line side conductor in multiple sections and rigidly securing such sections together, for example, by brazing.

The L-shaped cut out 320 is adapted to reverse the direction of electrical current flow through the line side conductor 300 in order to create a reverse current loop relative to the movably mounted main contact arms 2212 as well as the movably mounted arcing contact arms 204 (FIG. 5). More specifically, referring to FIG. 30, the generally L-shaped cut out 320 defines two spaced apart conductor portions 322 and 324 at the contact end 310 disposed one above the other. When the circuit breaker is in a closed position as illustrated in FIG. 2, the direction of electrical current flow from the line side terminal 38 is indicated by the arrows 326. The direction of electrical current flow in the bottom conductor portion 322 is thus in the same direction as the electrical current from the line terminal 38, as indicated by the arrow 328. The direction of electrical current in the upper conductor portion 324; however, is in a reverse direction as indicated by the arrow 330. The electrical current from the upper conductor portion 324 flows into the elongated main contact 312 as well as the elongated arcing contact 314 and, in turn, into the movably mounted main contacts 34 and the movably mounted arcing contacts 44 (FIG. 2). As shown in FIG. 2, the direction of electrical current flow in the movably mounted arcing contact arms 204 as well as the movably mounted main contact arms 212 is in the direction as indicated by the arrow 330. Since the electrical current in the movably mounted contact arms 204 and 212 flows in a direction that is opposite the direction of electrical current flow in the upper conductor portion 324 of the line side conductor 300, magnetic repulsion forces are generated between the line side conductor 300 and the movably mounted main contact arms 212 as well as the movably mounted arcing contact arms 204. When the level of electrical current flowing through the line side conductor 300 and the movably mounted contact arms 204 and 212 becomes sufficiently high, for example, due to a short circuit current, sufficient magnetic repulsion forces will be generated to blow open the main contact arms 212 as well as the arcing contact arms 204. Such magnetic repulsion forces are in addition to the magnetic repulsion forces generated by way of the reverse current loop, created in the generally U-shaped flexible shunts 70 (FIG. 2), used to connect the movably mounted contact arms 204 and 212 to the load side conductor 78 as discussed above.

In an alternate embodiment of the line side conductor illustrated in FIG. 30, the reverse current loop is created in the line conductor by a generally linear saw cut as illustrated in FIG. 31. More specifically, a notch 332 is cut into the line side conductor 302 at a predetermined angle 334, relative to the longitudinal axis 325 of the line side conductor 302 defining a line side portion 338 and a contact portion 340. The main contact 312 and the arcing contact 314 are rigidly secured to the line side conductor 302 in a similar manner as described above. When the circuit breaker 20 is in a closed position as illustrated in FIG. 2, electrical current from the line side terminal 38 flows in the direction indicated by the arrow identified with the reference numeral 342 in the line side portion 338 of the line side conductor 302. The electrical current flowing in the contact portion 340 of the line side conductor 302 flows in an opposite direction as illustrated by the arrow identified with the reference numeral 344, thus creating a reverse loop relative to the movably mounted main contact arms 212 as well as the movably mounted arcing contact arms 204 as discussed above.

Referring to FIG. 32, an alternate embodiment of the present invention is illustrated wherein a reverse current loop is created in the line side conductor 304 only with respect to the movably mounted arcing contact arms 204 but not the movably mounted main contact arms 212. In this embodiment, a generally U-shaped slot 346 is formed in an upper portion 348 of the line side conductor 304 defining two depending leg portions 347 and a bight portion 349, disposed such that the depending leg portions 347 are oriented generally parallel to the longitudinal axis 325 and the bight portion 349 is oriented generally transverse to the axis 325. The slot 346 forms a peninsula portion 350 disposed intermediate two spaced apart generally parallel depending leg portions 352 in the conductor 304. A plurality of fixed main contacts 354 are rigidly mounted on the depending leg portions 352 in a manner as described above. More specifically, the fixed main contacts 354 are divided between the two depending leg portions 352 and rigidly attached thereto to accommodate multiple movably mounted main contacts 34 carried by a plurality of movably mounted main contact arms, such as the contact arms 212. A fixed arcing contact 355 is rigidly attached to the peninsula portion 350 in a manner as described above.

Electrical current from the line side terminal 38 flows in the direction of the arrows 356 along the depending leg portions 352 to the stationary mounted main contacts 354 as indicated. As illustrated by the arrow identified with the reference numeral 358, electrical current flows in an opposite direction into the peninsula portion 350, and in turn, into the stationary mounted arcing contact 355. The electrical current in the peninsula portion 350, in turn, flows into the arcing contact arm 204 in an opposite direction, thus creating a reverse current loop between the peninsula portion 350 and the movably mounted arcing contact arms 204. However, since the direction of electrical current flow in the depending leg portions 352 is in the same direction as the direction of electrical current flow in the movably mounted main contact arm 212, no reverse loop will be created relative to the movably mounted main contact arms 212.

In another alternate embodiment of the invention as illustrated in FIG. 33, reverse current loops are created relative to the main contact arms 212 but not the arcing contact arms 204. In this configuration, additional magnetic repulsion forces are generated to blow the main contact arms 212 open before the arcing contact arms 204. As shown in FIG. 33, two generally L-shaped notches 360 are formed on opposing edges 362 and 364 of the line side conductor 306, each notch including a first depending leg portion 367 and a second depending leg portion 369 oriented such that the first depending leg portions 367 are oriented generally parallel to the longitudinal axis 325 and the second depending leg portions 369 are oriented generally transverse to the longitudinal axis 325. The slots 366 define two main contact portions 366 and 368 spaced apart by an aisleway portion 370. A plurality of main contacts 372 are rigidly mounted to the main contact portions 366 and 368 of the line side conductor 306. An arcing contact 374 is rigidly secured to the line side conductor in a manner as described above and spaced away from the L-shaped notches 360 toward the line side terminal 38.

When the circuit breaker 20 is closed, electrical current from the line side terminal 38 flows through the arcing contact 374 in a direction as indicated by the arrows, identified with the reference numeral 376. Electrical current also flows in the same direction in the aisleway portion 370 of the line side conductor 306 as indicated by the arrow identified with the reference numeral 378. The electrical current that flows into the fixed main contacts 372 flows in a reverse direction relative to the direction of electrical current flow in the contact portions 366 and 368 as indicated by the arrows identified with the reference numerals 380. The direction of electrical current flow in the main contact portions 366 and 368 of the line side conductor 306 thus creates a reverse current loop with respect to the direction of electrical current flow in the movably mounted main contact arms 212, thus creating additional magnetic repulsion forces to allow the movably mounted main contact arms 212 to blow open prior to the arcing contact arms 204, since no reverse current loop is created relative to the arcing contact arms 204.

TWO-PIECE CARRIER

Another important aspect of the present invention relates to a contact arm assembly 400 (FIG. 34) and more particularly to a two-piece carrier assembly 402. The two-piece carrier assembly 402 in accordance with the present invention allows better control of the magnitude of electrical current at which the main contacts 30 and the arcing contacts 40 are blown open relative to the one-piece carrier 208 illustrated in FIG. 5 and obviates the need for the HIC assembly 142 described above. In this embodiment, the trip links 118 are rigidly secured to the insulator link 120. More specifically, referring to FIG. 34 the two-piece carrier assembly 402 includes an inner carrier 404 and an outer carrier 406, pivotally connected together defining a pivot axis 407. With the two-piece carrier assembly 402, magnetic repulsion forces generated during relatively high overcurrent conditions create a torque relative to the pivot axis 407 to provide better control of the magnitude of electrical current at which blow open occurs as opposed to the one-piece carrier 208 and the HIC assembly 142 discussed above, wherein it is relatively difficult to concentrate the torque generated as a result of the magnetic repulsion forces about a single axis.

Figure 34:
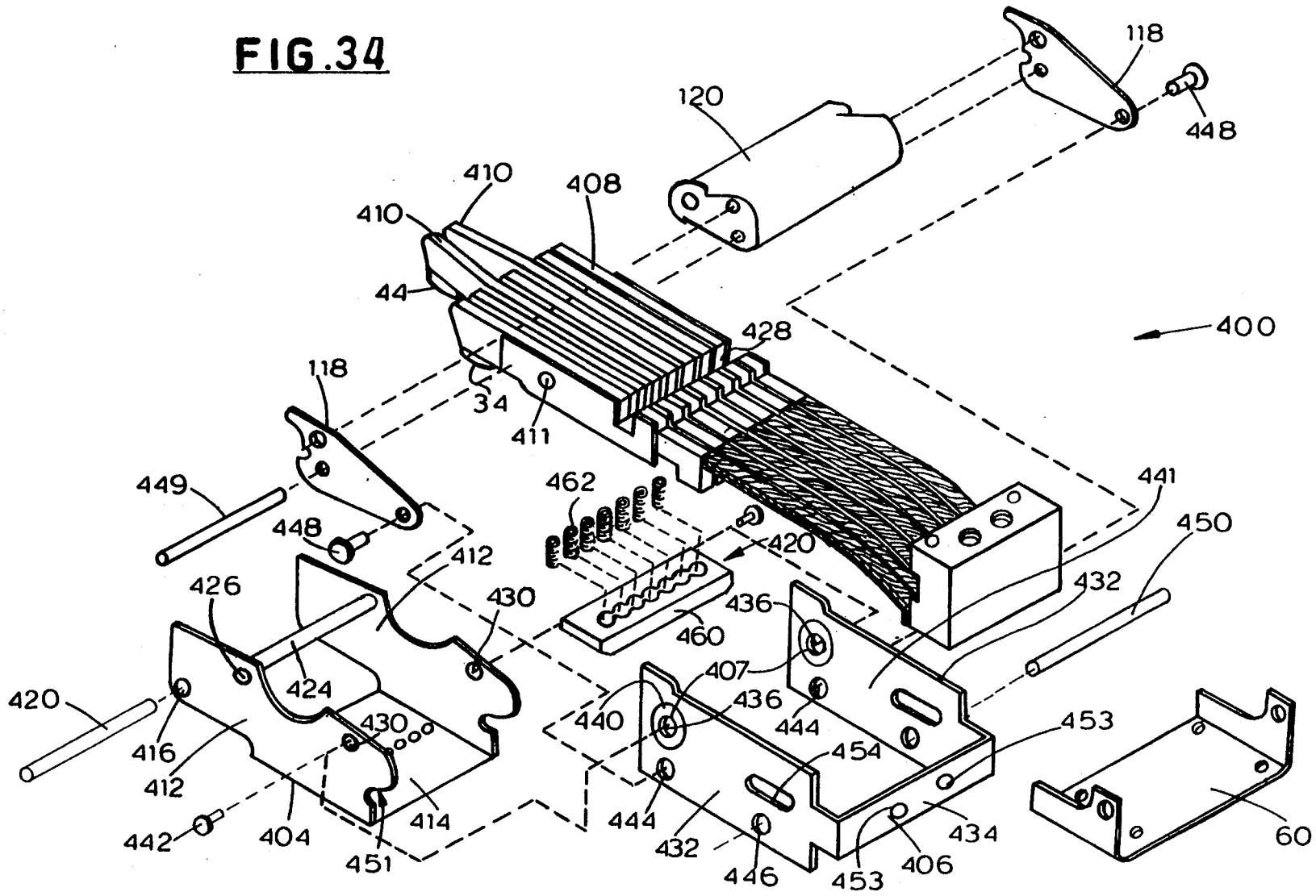
FIG. 34 is an exploded perspective view of a contact arm assembly in accordance with the present invention.

The contact arm assembly 400 in accordance with the present invention is best illustrated in FIG. 34. The contact arm assembly 400 includes a plurality of main contact arms 408, for example six, and a pair of arcing contact arms 410 for carrying the movably mounted main and arcing contacts 34 and 44, respectively. The main contact arms 408 (FIG. 35) as well as the arcing contact arms 410 (FIG. 36) are provided with apertures 411 which allow the contact arms 408 and 410 to be pivotally connected to the inner carrier 404, which, in turn, is pivotally connected to the outer carrier 406. More specifically, as best illustrated in FIGS. 37–39, the inner carrier 404 is formed as a generally U-shaped member defining two generally spaced apart depending leg portions 412 and a bight portion 414. The depending leg portions 412 are provided with aligned apertures 416. These aligned apertures 416 are used to provide a pivot axis for the main contact arms 408 as well as the arcing contact arms 410. More specifically, the main contact arms 408 and arcing contact arms 410 are adapted to be disposed intermediate the depending leg portions 412 of the inner carrier 404 such that the apertures 411 are aligned with the apertures 416 in the depending arm portions 412. A pin 420 is then disposed in the apertures 416 and 411 to provide a pivotal connection of the main and arcing contact arms 408 and 410, respectively, relative to the inner carrier 404.

As will be discussed in more detail below, a contact spring assembly 422 exerts a generally counterclockwise torque (FIG. 34) about the pin 420. A stop pin 424 is provided to limit the counterclockwise movement of the main and arcing contact arms 408 and 410. More specifically, aligned apertures 426 are provided in the depending leg portions 412 of the inner carrier 404. The stop pin 424 is adapted to be received in the aligned apertures 426 in the depending leg portions 412 of the inner carrier 404 and received in notches 428 (FIGS. 35 and 36) formed in the main and arcing contact arms 408 and 410, respectively. Thus, in a normal position, the stop pin 424 limits the counterclockwise torque exerted on the pivot pin 420 by way of the contact spring assembly 422. As will be discussed in more detail below, the contact spring assembly 422 allows for a slight overtravel of the contact arm assembly 400 in the closed position to create a contact force between the contacts.

Figure 40:
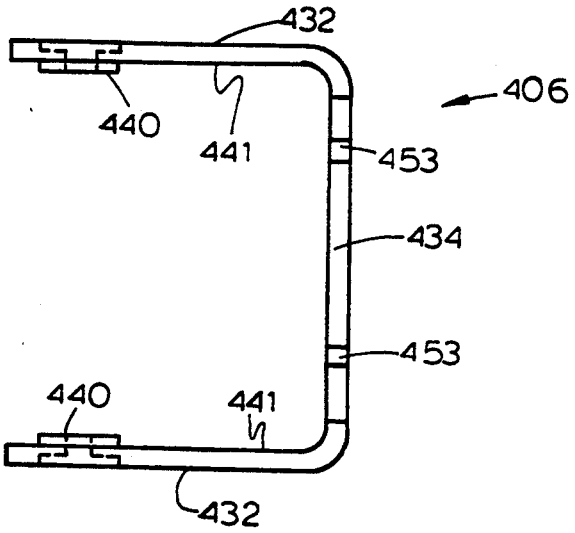
FIG. 40 is a plan view of an outer carrier in accordance with the present invention.
Figure 41:
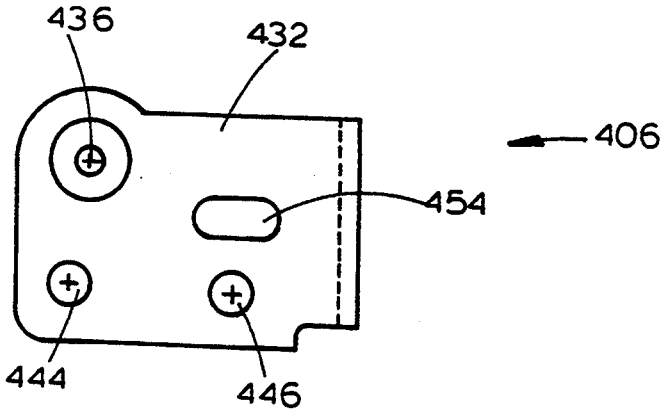
FIG. 41 is an elevational view of the outer carrier illustrated in FIG. 40.

In order to pivotally connect the inner carrier 404 to the outer carrier 406, aligned apertures 430 are provided in the depending leg portions 412 of the inner carrier 404. The outer carrier 406 is formed as a generally U-shaped member as illustrated in FIGS. 40 and 41 defining depending leg portions 432 and a bight portion 434. Apertures 436 are provided in the depending leg portions 432 that are adapted to be aligned with the apertures 430 provided in the inner carrier 404. Bosses 440 may be formed on inner surfaces 441 of the depending leg portions 432 to provide clearance between the inner carrier 404 and the outer carrier 406. Pins 442 (FIG. 34) are inserted in the apertures 436 in the outer carrier 406 as well as the apertures 430 in the inner carrier 404 to provide a pivotal connection therebetween. In order to avoid interference with the pivotal movement of the main contact arms 408 and the arcing contact arms 410 relative to the inner carrier 404, the pins 442 should not extend beyond the inner surface of the inner carrier 404.

The depending leg portions 432 are also provided with aligned apertures 444 and 446. The apertures 444 allow for pivotal connection of the trip links 118 relative to the depending arm portions 432 by way of pins 448 (FIG. 34), which, in turn, are connected to the insulator link 120 by way of a plurality of pins 449. The apertures 446 allow for pivotal connection of the outer carrier 406 to the L-shaped bracket 60 by way of a pin 450 in a similar manner as described above.

As will be described in detail below, a spring loaded cam assembly 452 biases the two-piece carrier assembly 402 to prevent the inner carrier 404 from pivoting relative to the outer carrier 406 unless sufficient magnetic repulsion forces are generated. The spring loaded cam assembly 452 cooperates with a cam surface 451 formed on the depending leg portions 412 of the inner carrier 404. The spring loaded cam assembly 452 is secured to the outer carrier 406 by way of spaced apart apertures 453 (FIGS. 34 and 40) provided in the bight portion 434 of the outer carrier 406. Additionally, a pair of aligned slots 454 are provided in the depending leg portions 432 of the outer carrier 406 for receiving a cam roller assembly 455 (FIG. 50) which forms a part of the spring loaded cam assembly 452 as will be discussed below. The operation of the two-piece carrier assembly 402 will be described in conjunction with the spring loaded cam assembly 452 below.

CONTACT SPRING HOUSING

Figure 42:
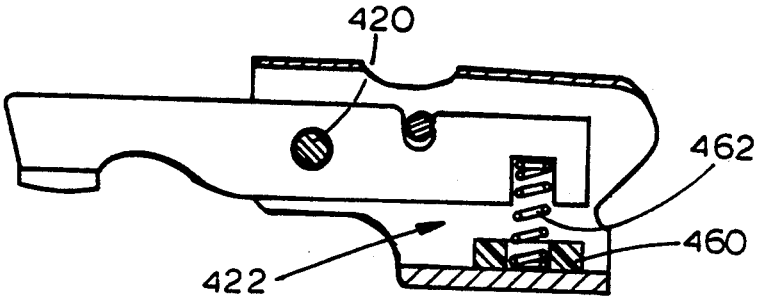
FIG. 42 is an elevational view of a portion of the contact arm assembly illustrating a contact spring assembly in accordance with the present invention.
Figure 43:
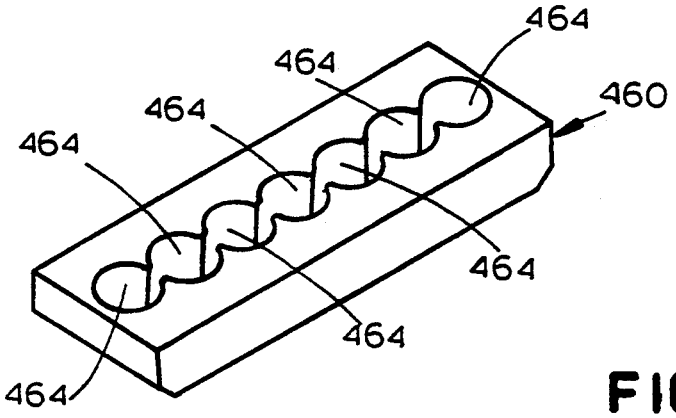
FIG. 43 is a perspective view of a housing which forms a portion of the contact spring assembly.

Another important aspect of the present invention relates to the contact spring assembly 422. As previously mentioned, the contact spring assembly 422 biases the main contact arms 408 as well as the arcing contact arms 410 rotate in a generally counterclockwise direction (FIG. 34) relative to the pin 420. The contact spring housing assembly 422 includes a contact spring housing 460 (FIG. 43) and a plurality of biasing springs 462 (FIG. 42). The contact spring housing assembly 422 allows the biasing springs 462 to be located in an area of the circuit breaker 20 that is subjected to relatively lower heat than current designs. More specifically, in such current designs as illustrated in FIG. 5, the biasing springs are located toward the contact end of the main contact arms 212 and the arcing contact arms 204 to the left of the pivot axis defined by the pin 220 (i.e. as shown in FIG. 5). In such a design, the biasing springs are subject to a relatively large amount of heat during contact separation. Therefore, in the design illustrated in FIG. 5, a housing 200 is provided to protect the arcing contact biasing springs from damage due to heat. In that embodiment, although the main contact arm biasing springs are located to the right of the arcing contact biasing springs 203 such biasing springs still must be located to the left (FIG. 2) of the pivot axis. Consequently, although the main contact arm biasing springs are located in an area subject to a relatively lower amount of heat than the arcing contact biasing springs 203, such main contacts biasing springs are still subject to damage due to the heat caused by separation of the contacts. The contact spring housing assembly 422 in accordance with the present invention solves this problem by locating the biasing springs for the main contact arms 408 as well as the arcing contact arms 410 to the opposite side of the contact arm pivot axis 420 (FIG. 42). By locating the contact spring housing assembly 422 in such a location, the biasing springs 462 are located in an area that is subject to relatively less heat than the biasing springs illustrated in FIG. 5 and are thus less likely to become damaged.

The contact spring housing 460 may be formed from an electrically insulating material as a generally elongated rectangular member having a plurality of apertures 464. These apertures 464 provide two functions. First, the apertures 464 act as a spring retainer for retaining a bottom portion of the biasing springs 462 as shown in FIG. 42. Second, the apertures 464 also function to locate the spring housing 460 relative to the inner carrier 404. More specifically, the spring housing 460 is carried by the bight portion 414 of the inner carrier 404. The bight portion 414 of the inner carrier 404 is provided with a plurality of spaced apart projections 466 (FIGS. 37 and 39) that are adapted to be received in the apertures 464 of the spring housing 460. By forming the apertures 464 slightly larger than the diameter of the biasing springs 462, the projections 466 (FIGS. 36, 39) and the bight portion 414 of the inner carrier 404 may be used to capture the bottom portion of the biasing springs 462 and at the same time capture the contact spring housing 460 to prevent movement of the housing 460 relative to the inner carrier 404. The top portions of the biasing springs 462 are captured by U-shaped notches 467 (FIGS. 35 and 36).

In operation, the biasing springs 462 provide a generally upward force against the main contact arms 408 as well as the arcing contact arms 410. This upward force generates a torque relative to the pivot axis 420. When the contacts are in a closed position as shown in FIG. 42, a slight amount of overtravel of the main contact arms 408 as well as the arcing contact arms 410 is created by the operating mechanism 88 to create a contact pressure between the arcing contacts 44 and the main contacts 34. More specifically, with reference to FIG. 42, the operating mechanism 88 causes the main contact arms 408 as well as the arcing contacts 410 to be slightly spaced away from the stop pin 424. The biasing springs 462 cause an upward force on the contact arms 408 and 410 which generates a counterclockwise torque relative to the pivot axis 420 to create a contact pressure or contact force on the main contacts 34 as well as the arcing contacts 44 when the circuit breaker is in a closed position. Once the main contact arms 408 and arcing contact arms 410 begin to open either during a tripping mode or when the circuit breaker 20 is manually opened, the biasing springs 462 cause the contact arms 408 and 410 to pivot about the pivot axis 420 until the notches 428 of such contact arms 408 and 410 engage the stop pin 424.

COMPRESSION SPRING LOADED CAM

Another important aspect of the present invention relates to the spring loaded cam assembly 452. The spring loaded cam assembly 452 works in conjunction with the two-piece carrier assembly 402 to ensure that the main and arcing contact arms 408 and 410 blow open at a predetermined level of electrical current. More specifically, the spring loaded cam assembly 452 biases the inner carrier 404 including the main contact arms 408 and arcing contacts 410, such that the assembly operates in conjunction with the outer carrier 406 during normal load conditions. Once the electrical current in the circuit breaker 20 exceeds a predetermined level, for example, a short circuit current, sufficient magnetic repulsion forces are generated which act against and overcome the biasing force provided by the spring loaded cam assembly 452 to cause the inner carrier 404 as well as the main and arcing contact arms 408 and 410 to be released from the outer carrier 406 and blown open.

Another important aspect of the spring loaded cam assembly 452 is that it allows the biasing force to be rather quickly and easily adjusted. More specifically, the spring loaded cam assembly 452 includes a cam spring housing 470 (FIG. 47) and a plurality of biasing springs 472 (FIGS. 44, 46) for providing a predetermined biasing force. More specifically, the biasing force required by the spring loaded cam assembly 452 is a dependent upon the magnetic repulsion forces generated within the circuit breaker 20. In one embodiment of the present invention, it is contemplated that a line conductor, similar to the line conductor 36 will be utilized. In this embodiment, the magnetic repulsion forces are generated primarily by the flexible shunts 70. In such an embodiment, the biasing force provided by the spring loaded cam assembly 452 is a function of the magnetic repulsion forces generated by the flexible shunt 70 in response to a predetermined overcurrent, such as a short circuit current. In alternate embodiments of the invention, reverse current loops are provided between the movably mounted contact arms 408 and/or 410 and the line conductor 300, 302, 304 and 306. In these embodiments, the biasing force of the spring loaded cam assembly 452 is a function of the magnetic repulsion forces generated by the flexible shunts 70 as well as the reverse current loops formed between the line conductor 300, 302, 304 and 306 and the movably mounted contact arms 408 and 410 at a predetermined level of overcurrent. The biasing force can be adjusted by adjusting the number of biasing springs 472 disposed in the housing 470 or by adjusting the spring characteristics of the biasing springs 472. Moreover, as will be discussed below, the cam surfaces 451 formed on the inner carrier 404 may also be used to adjust the biasing force provided by the spring loaded cam assembly 452.

Figure 44:
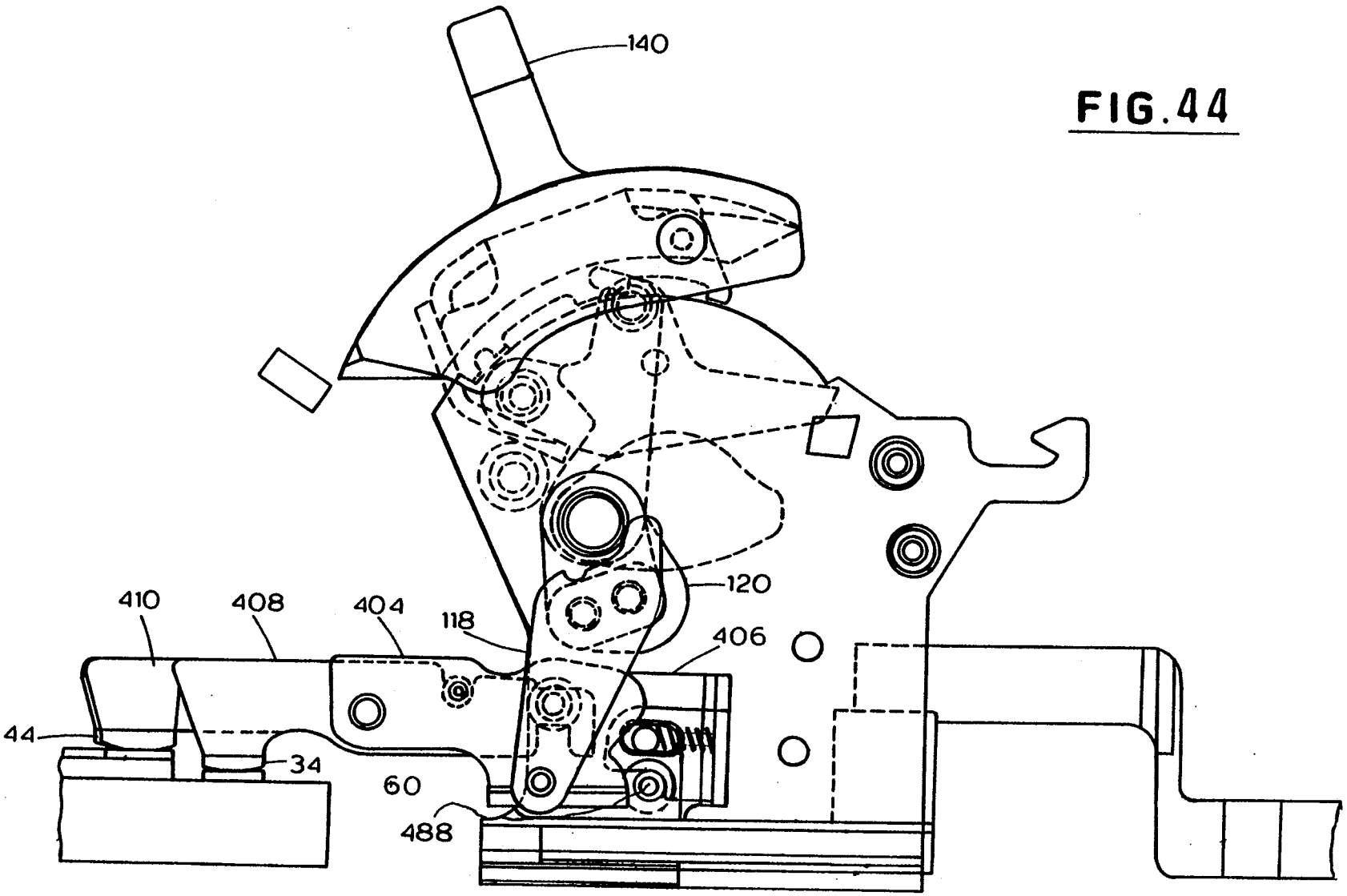
FIG. 44 is a partial elevational view of a circuit breaker in accordance with the present invention in a closed position.
Figure 45:
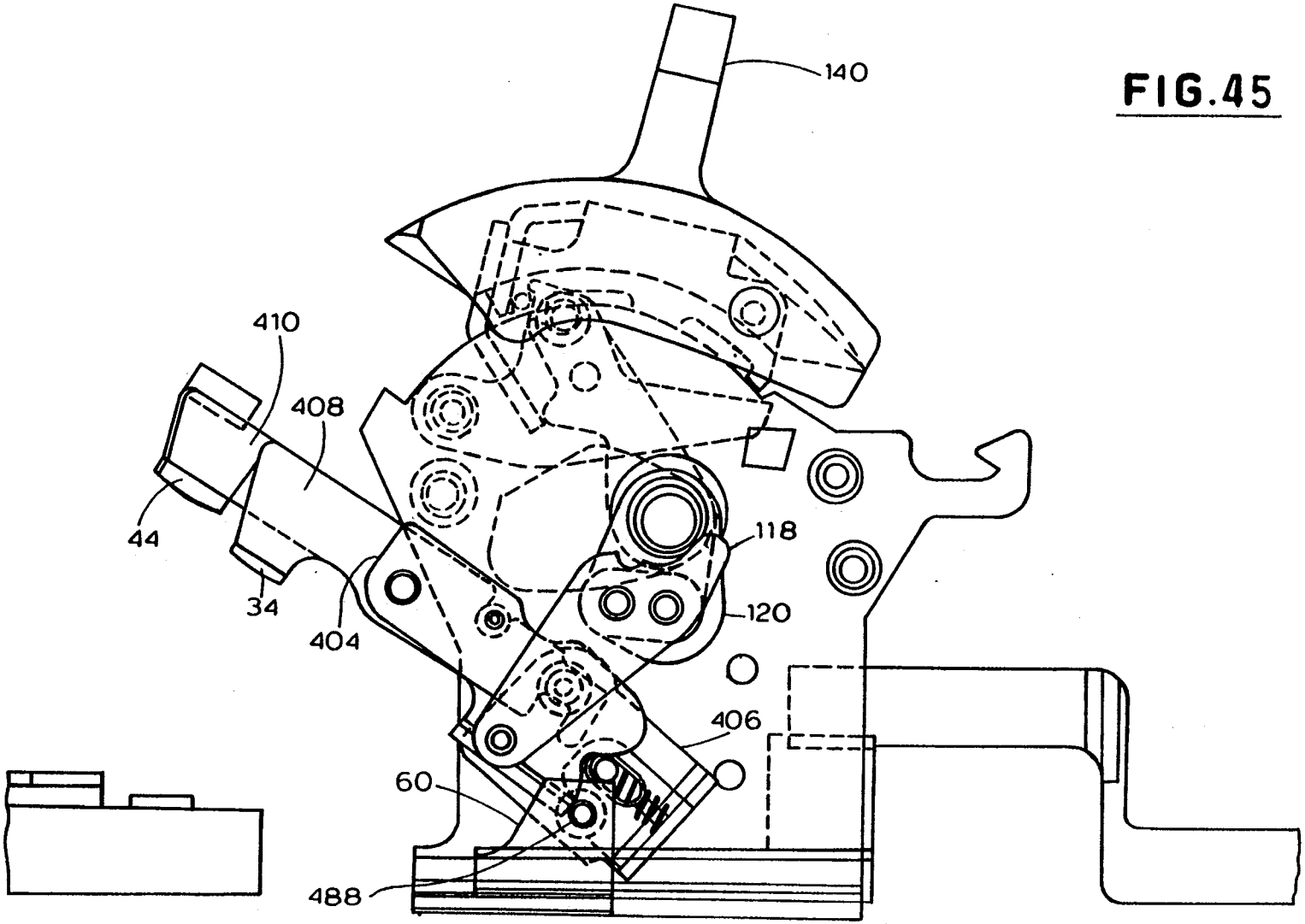
FIG. 45 is similar to FIG. 44 illustrating the circuit breaker in an open position.
Figure 46:
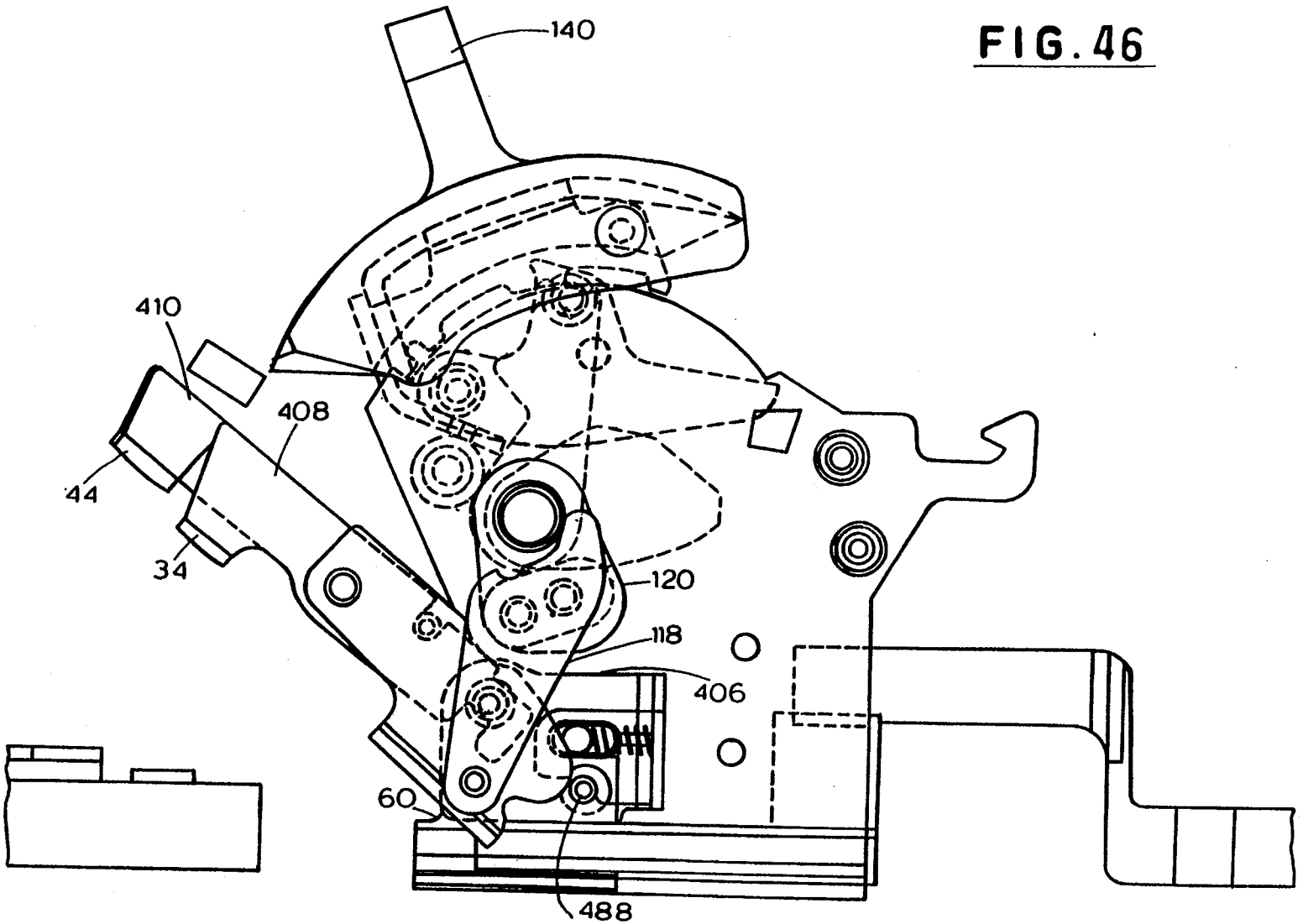
FIG. 46 is similar to FIG. 44 illustrating the circuit breaker in a blown open position.

Operation of the spring loaded cam assembly 452 is best understood with reference to FIGS. 44, 45 and 46. As shown in FIG. 44, the circuit breaker 20 is illustrated in a closed position. In this position, the inner carrier 04 is mechanically coupled to the outer carrier 406 by way of the spring loaded cam assembly 452. More specifically, cam surfaces 451 formed on the inner carrier 404 together with a cam roller assembly 455, which forms a portion of the spring loaded cam assembly 452, provide mechanical coupling between the inner carrier 404 and the outer carrier 406 when the electrical current is below a predetermined high level, such as a short circuit level. In the closed position as illustrated in FIG. 44, the cam roller assembly 455, under the influence of the biasing springs 472, exerts a force against the cam surfaces 451. Since the spring loaded cam assembly 452 is coupled to the outer carrier 406 as discussed above, the biasing force provided by the biasing springs 472 and the cam roller assembly 455 act to mechanically couple the inner carrier 404 to the outer carrier 406. As long as the electrical current is below a predetermined level, such as a short circuit level, the inner carrier 404 will remain mechanically coupled to the outer carrier 406 even when the circuit breaker 20 is placed in an open position as shown in FIG. 45. Since the trip links 118 are pivotally connected to the outer carrier 406, movement of the operating handle 140 to an open position as shown in FIG. 45 will cause the outer carrier 406 as well as the inner carrier 404 to move in unison to an open position by way of the operating mechanism 88 in a similar manner as discussed above.

When the electrical current in the circuit breaker reaches a sufficiently high level, magnetic repulsion forces are generated which cause a clockwise torque about the pivot axis 420. The clockwise torque causes the cam surface 74 to exert a force on the cam roller assembly 455 which, in turn, causes the biasing springs 472 to be compressed. As the biasing springs 472 are compressed, the inner carrier 404 pivots about the pivot axis 420 to allow the main contact arms 408 as well as the arcing contact arms 410 to be blown open as shown in FIG. 46. During a blow open condition, the outer carrier 406 remains in the same position as in the closed position. In order to reset the circuit breaker after a blow open condition, the operating handle 140 is moved to an open position as shown in FIG. 45 and then placed in the closed position as shown in FIG. 44.

The cam spring housing 470 is illustrated in FIGS. 47–49. The cam spring housing 470 is formed as an irregular-shaped member from an electrically insulating material. An elongated slot 474 is provided in one portion of the cam spring housing 470, generally parallel to a longitudinal axis 476. A plurality of apertures 484 are provided generally transverse to the slot 474. The apertures 484 are for receiving the biasing springs 472. Additionally, apertures 473 are provided, adapted to be aligned with the apertures 453 (FIG. 40) in the outer carrier 406 to enable the cam spring housing 470 to be rigidly secured to the bight portion 434 of the outer carrier 406 with suitable fasteners (not shown). The cam spring housing 470 is also formed with a notch 486. As best shown in FIGS. 44–46, the notch 486 is adapted to ride on a mechanical support pin 488 (FIGS. 44–46) to provide additional support for the assembly.

The cam roller assembly 455 is disposed within the elongated slot 474. One end of the biasing springs 472 is disposed against the cam roller assembly 455. The other end of the biasing springs 472 seat against the bight portion 434 of the outer carrier 406. The cam roller assembly 455 is best illustrated in FIG. 50. The cam roller assembly 455 includes a pin 490, a central sleeve 492 and two outer sleeves 494. The central sleeve 492 as well as the outer sleeves 494 are formed with a diameter slightly greater than the diameter of the pin 490. Moreover, the combined length of the central sleeve 492 as well as the outer sleeves 494 is formed to be slightly less than the length of the pin 490.

The cam roller assembly 455 allows independent rotation of the outer sleeves 494 relative to the central sleeve 492. More specifically, the outer sleeves 494 are received in the slots 454 (FIGS. 41, 44, 45, 46) formed in the outer carrier 406. The central sleeve 492 acts as a cam follower and engages the cam surface 451 formed in the rear portion of the inner carrier 404.

MOLDED INTERPHASE BARRIER

Another important aspect of the present invention relates to a molded interphase gas barrier 500. Such interphase gas barriers are utilized to prevent damage to a circuit breaker as a result of a circuit interruption. More specifically, ionizing gases are generated within the circuit breaker as a result of the separation of the main contacts. Since such gases are conductive, communication of such gases between phases or between a phase and ground can cause a short circuit condition. Consequently, these gases are known to be segregated and generally channeled through an arc extinguisher and vented out the circuit breaker.

In order to segregate such ionizing gases, each pole within a multiple pole circuit breaker is segregated by way of interior side walls which define one or more phase compartments. However, since the crossbar normally communicates with all poles in a multiple pole circuit breaker, various openings in the side walls are provided to allow the crossbar to pass therethrough. In order to seal the space between the crossbar and the openings in the interior side walls, interphase barriers are normally provided. Known interphase barriers, such as the interphase barrier 502 illustrated in FIG. 51, are formed from stamped plastic and provided with a centrally disposed aperture 504 for receiving an insulating sleeve, such as the insulator link 120. A rubber cement is normally applied about the interface 505 defined between the insulator link 120 relative to the aperture 504 to provide a generally gas tight seal.

There are several problems with a known interphase gas barrier, such as the interphase gas barrier 502. First, there is no way to ensure uniform quality of the seal at the interface 505 between the aperture 504 and the insulator link 120. More specifically, the quality of the seal is a function of the assembly personnel experience. Relatively inexperienced assembly personnel may inadvertently fail to completely seal the interface 505. Second, such interphase barriers 502 are normally assembled to the pole assemblies prior to the installation of such pole assemblies into the circuit breaker housing. Accordingly, such interphase gas barriers 502 have known to become misaligned when the pole assembly is installed in the circuit breaker housing requiring a realignment of the interphase barrier relative to the crossbar and possibly resealing of the interface 505.

Figure 52:
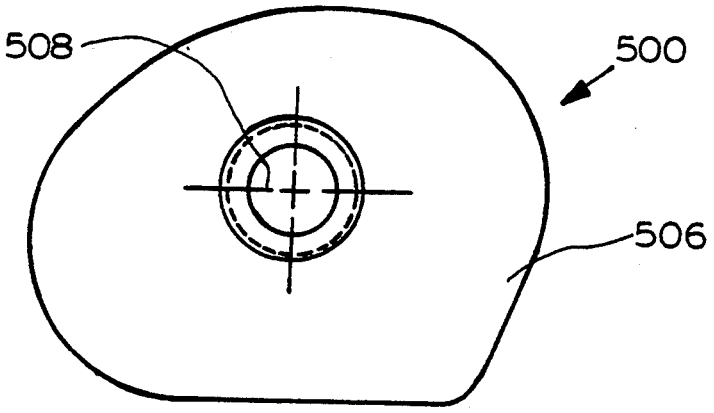
FIG. 52 is an elevational view of an interphase gas barrier in accordance with the present invention.
Figure 53:
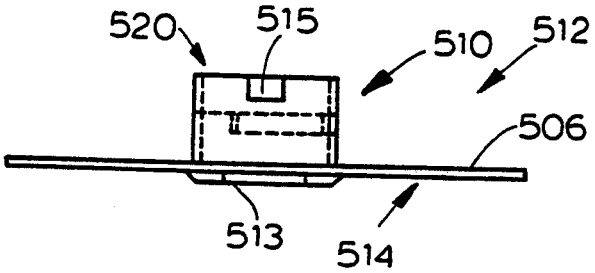
FIG. 53 is a plan view of the interphase gas barrier illustrated in FIG. 52.
Figure 54:
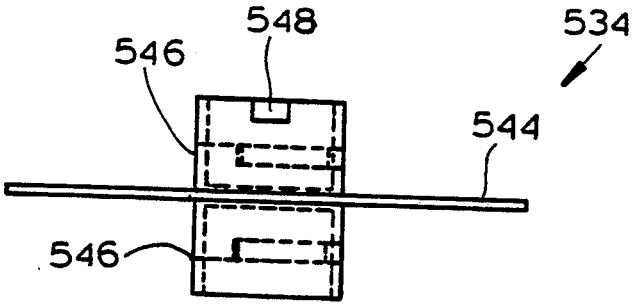
FIG. 54 is a plan view of an alternative embodiment of the interphase gas barrier illustrated in FIG. 52.

The interphase barrier, in accordance with the present invention, generally identified with the reference numeral 500, solves these problems by obviating the need to seal the interface relative to the insulator link 120 as well as providing a structure that can be registered with the insulator links 120 which minimizes, if not eliminates, the possibility of misalignment during assembly. More specifically, the interphase barrier 500 in accordance with the present invention is generally illustrated in FIGS. 52–55. FIGS. 52 and 53 illustrate an embodiment of the interphase gas barrier 500 for use in the outside poles of a three pole circuit breaker. FIG. 54 illustrates an embodiment of the interphase gas barrier 500 for use in an outside pole of a four pole circuit breaker.

Referring to FIGS. 52 and 53, the interphase gas barrier 500 in accordance with the present invention may be molded from a plastic material defining an irregular-shaped plate portion 506 with a generally centrally disposed aperture 508. A sleeve portion 510 is concentrically disposed relative to the aperture 508 and extends axially outwardly and generally perpendicular from one side of the plate portion 506 defining an outer pole side 512. The opposite side of the interphase gas barrier 500 defines a center pole side 514. In order to strengthen the centrally disposed aperture 508, a concentric boss 513 is provided. The concentric boss 513 is provided on the center pole side 514 of the interphase gas barrier 500 as shown in FIG. 52.

In order to seal the interface between the crossbar 126 and the interphase gas barrier 500, the diameter of the centrally disposed aperture 508 is formed to be slightly larger than the diameter of the crossbar 126 to provide a generally snug fit therebetween. By providing such a snug fit between the crossbar 126 and the interphase gas barrier 500, the need to seal the interface 516 therebetween with, for example, a rubber cement as in known circuit breakers, is obviated. Accordingly, the interphase gas barrier 500 in accordance with the present invention allows for a generally uniform and consistent seal at the interface 505 relative to the crossbar 126 which does not depend on the experience of the personnel assembling the circuit breaker.

The inside diameter of the sleeve portion 510 is generally formed to have substantially the same diameter as the cylindrical portion 156 (FIG. 9) of the insulator links 120 in the outer poles. In order to register the interphase barrier 500 with the insulator links 120 in the outside poles, the sleeve portion 510 is formed with a slot 515 adjacent a mouth 520 defined on one end of the sleeve portion 510. The slot 515 is adapted to receive a tab 522 extending axially outwardly from the cylindrical portion 156 of the outside insulator links 120. The combination of the slot 515 and the tab 522 facilitates radial alignment of the interphase barrier 500 relative to the insulator links 120. Such an arrangement minimizes misalignment of the interphase barriers 504 during assembly.

Another important aspect of the invention is that axial misalignment of the interphase gas barrier 500 during assembly is minimized. More specifically, it is necessary to align the interphase gas barrier 500 such that the plane of the plate portion 506 is generally perpendicular to the axis of the crossbar 126. In known designs, which are generally planar, such as the interphase gas barrier 502, the plane of the interphase gas barrier 502 often becomes canted relative to an axis generally perpendicular to the axis of the crossbar during assembly. This misalignment of the interphase gas barrier 502 during assembly occurs in part because the barrier 502 is supported solely by the centrally disposed aperture 504 therein. The interphase gas barrier 500 in accordance with the present invention minimizes this problem by providing the sleeve portion 510 which allows the interphase gas barrier 504 to be relatively securely seated against the cylindrical portion 156 of the outer pole insulator links 120.

Figure 55:
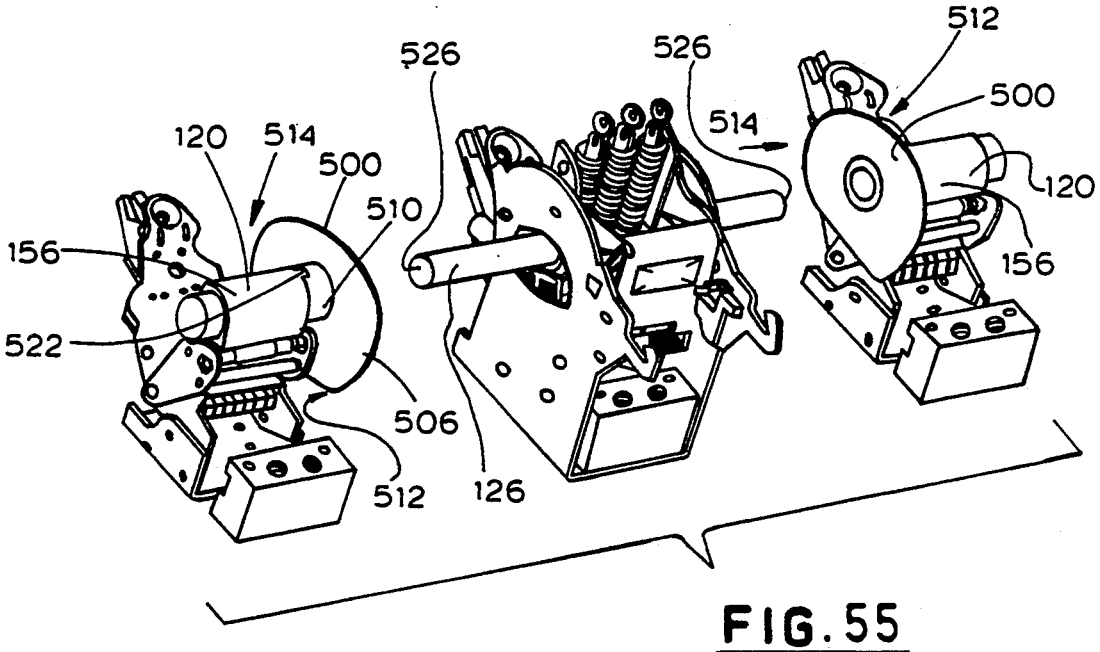
FIG. 55 is a partial perspective view of the poles of a three pole circuit breaker illustrating the installation of the interphase gas barriers to the outside pole assemblies in accordance with the present invention.

As shown in FIG. 55, two interphase gas barriers 500 are provided for a three pole circuit breaker. As shown, the sleeve portions 510 are seated against the cylindrical portion 156 of the outer pole insulator links 120 such that the tabs 522 formed on the insulator links 120 are received in the slots 515, formed in the sleeve portions 510. Extending ends 526 of the crossbar 126 are then received in the centrally disposed apertures 508 to form an assembly. The assembly is then installed into a molded base 24 of a circuit breaker housing 22.

Figure 56:
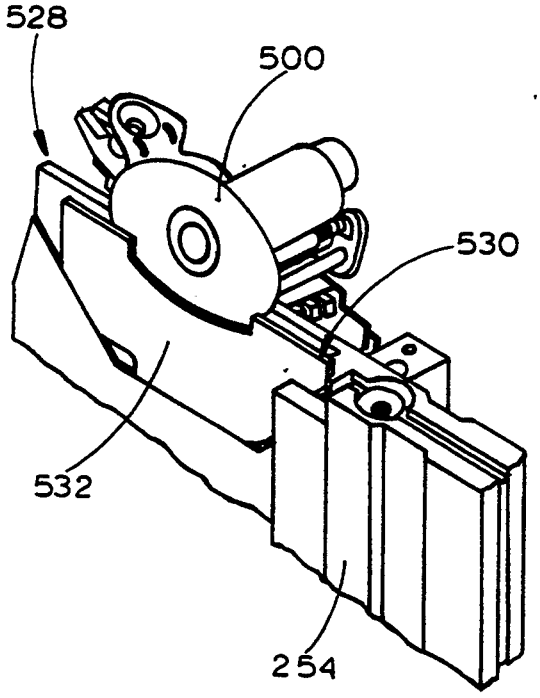
FIG. 56 is a partial perspective view of a sidewall within a circuit breaker illustrating the installation of a pole assembly including an interphase gas barrier to a molded housing.

As shown in FIG. 56, the interior side walls 254 of the molded base 24 are provided with cut outs 528. Such cut outs 528 are formed to allow movement of the crossbar in all anticipated operating conditions. The plate portion 506 is shaped to close the cut outs 528 during all such anticipated positions of the crossbar 126. Recesses 530 are formed in the side walls 254 for receiving the interphase gas barrier 504 as well as a generally planar insulation piece 532.

Figure 63:
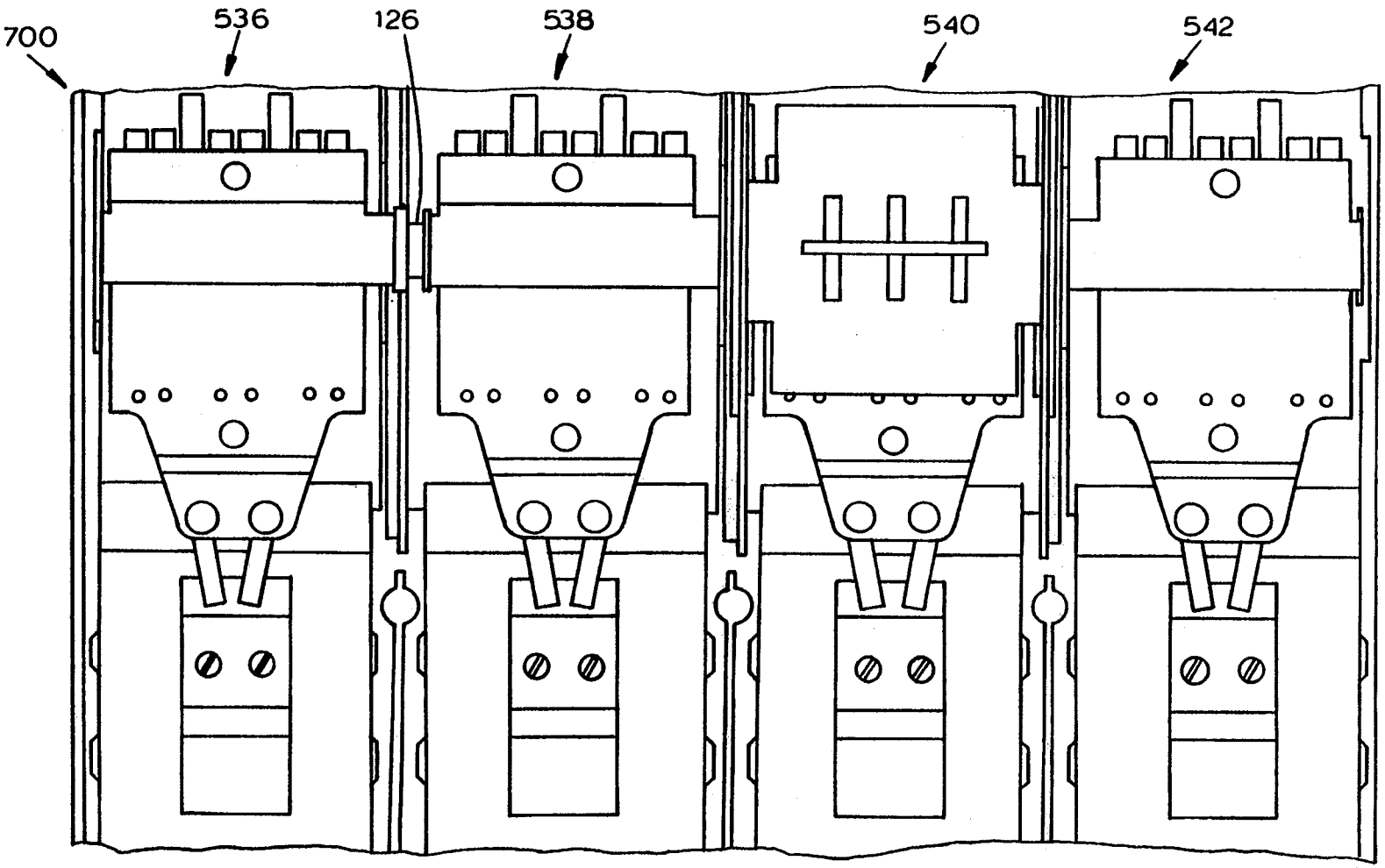
FIG. 63 is a plan view of a four pole circuit breaker in accordance with the present invention.

An alternate embodiment of the invention is illustrated in FIG. 54, generally identified with the reference numeral 534. The interphase barrier 534 is generally used to provide an interphase gas barrier between two outside poles of a four pole circuit breaker. More specifically, a four pole circuit breaker is illustrated in FIG. 63 which includes pole compartments 536, 538, 540 and 542. The pole compartment 538 contains the operating mechanism 88. The pole compartments 534 and 540 are disposed adjacent the pole compartment 538. The pole compartment 542 is disposed furthest away from the pole compartment538. The interphase gas barrier 534 is adapted to be disposed between the pole compartments 540 and 542. In such an application, the interphase gas barrier 534 is formed from a plate portion 544 and two extending sleeve portions 546 extending axially outwardly from both sides of the plate portion 544. In such an application, the interphase gas barrier is adapted to seat against the insulator links 120 between the pole compartments 540 and 542. The interphase gas barrier 534 also includes a slot 548 for facilitating radial alignment of the barrier 534 relative to the insulator links 120 in a manner as discussed above.

RATING PLUG ASSEMBLY

Rating plug assemblies are generally known in the art. Such rating plug assemblies cooperate with the electronic trip unit to establish the trip rating for the circuit breaker. More specifically, as is known in the art, such electronic trip units are adapted to be utilized for a range of tripping values. Known rating plug assemblies include a resistor mounted to a printed circuit board that is adapted to plug into the electronic tripping unit to provide a predetermined tripping value determined by the value of the resistor.

Such rating plug assemblies are formed as modular assemblies which allow for relatively quick and convenient installation and removal relative to an electronic trip unit. In order to prevent removal of the rating plug assembly from the electronic trip unit while the circuit breaker is in a closed position and to prevent closing of a circuit breaker from which the rating plug assembly has been removed, the assembly is mechanically interlocked with the electronic trip unit and, in particular, the trip bar. More specifically, such rating plug assemblies normally include an elongated spring loaded plunger formed with an actuation surface at one end and a slotted head on the opposing end. The actuation surface cooperates with a cam disposed within the electronic trip unit to prevent removal of the rating plug assembly unless the trip bar is in a trip position. The actuation surface in cooperation with the cam also prevent the trip bar from being reset when the rating plug assembly has been removed from the electronic trip unit. Moreover, the rating plug assembly also allows the circuit breaker to be manually tripped in order to permit removal of the rating plug assembly from the electronic trip unit. More specifically, depression of the slotted head formed on the end of the spring loaded plunger causes the actuation surface to engage the trip bar and cause the trip bar to rotate to a trip position. Once the circuit breaker is tripped, the spring loaded plunger may be rotated to a remove position to enable the rating plug assembly to be removed from the electronic trip unit. Such interlocking between the rating plug assembly and the electronic trip unit is generally known in the art and is described in detail in U.S. Pat. No. 4,603,313, assigned to the same assignee as the assignee of the present invention, hereby incorporated by reference.

In order to assure proper operation of the circuit breaker during all anticipated operating conditions including a short circuit condition, it is known in the art to provide means for captivating the spring loaded plunger relative to the rating plug assembly. More specifically, during relatively high overcurrent conditions, such as a short circuit condition, relatively high gas pressure is generated behind the rating plug. In order to prevent the spring loaded plunger from being dislocated relative to the rating plug assembly due to the high gas pressures, two-piece plungers have heretofore been known to be provided. For example, FIG. 57 illustrates a known rating plug assembly with a two-piece plunger design, generally identified with the reference numeral 550. The rating plug assembly 550 includes a generally rectangular housing 552 open on one end 554 which includes an aperture 556 on a surface 558 opposite the open end 554. The rating plug assembly 550 further includes a printed circuit board 560 which includes a resistor 562 and terminals 564 for connecting the rating plug assembly 550 to an electronic trip unit. The printed circuit board 560 includes an aperture (not shown) adapted to be aligned with the aperture 556. A two-piece plunger assembly 568 is provided, adapted to be captured relative to the rating plug assembly 550. More specifically, the plunger assembly 568 includes a first portion 570 which includes an elongated shaft 572 formed with an enlarged head 574 at one end. A second plunger portion 576 is formed with a generally hollow cylinder portion 578 with an enlarged portion 580 at one end which acts as the actuation surface. The shaft 572 of the first plunger portion 570 is adapted to be received in the apertures 556 formed in the housing 552 as well as the aperture in the printed circuit board 560 and an aperture (not shown) formed in an insulation piece 569 used to protect the printed circuit board 560. The diameter of the shaft 572 is formed to be slightly smaller than the diameter of the apertures 556 and 566 in order to allow the shaft 572 to be received in the apertures 566 and the apertures formed in the printed circuit board 560 and insulation plate 569. The inner diameter of the cylindrical portion 578 of the second plunger portion 576 is formed slightly larger than the diameter of the shaft portion 572. The outer diameter of the shaft portion 572 is formed slightly larger than the diameter of the apertures in the printed circuit board 560 and insulation plate 569. The hollow cylindrical portion 578 is adapted to receive a free end 582 of the shaft portion 572 once the printed circuit board 560, insulation plate 569 and first plunger portion 510 have been assembled. By securing the hollow cylindrical portion 578 to the extending shaft portion 572, the plunger assembly 568 is thus captured relative to the rating plug assembly 550.

One problem with such a design is that the joint formed between the shaft portion 572 and the hollow cylindrical portion 578 must be able to withstand the force resulting from the relatively high gas pressures generated behind the rating plug assembly 550 during relatively high overcurrent conditions, such as a short circuit condition. In known rating plug assemblies, such as the rating plug assembly 550, the two plunger portions 570 and 576 have been pinned together by way of a pin 586, oriented generally transverse to a longitudinal axis of the plunger assembly 568. Although such a joint performs adequately, it is relatively expensive and time consuming from a manufacturing standpoint.

The rating plug assembly in accordance with the present invention, generally identified with the reference numeral 600 solves this problem by providing a one-piece plunger which is captured relative to the rating plug assembly 600. More specifically, with reference to FIGS. 58-60, the rating plug assembly 600 in accordance with the present invention includes a generally rectangular housing 604 defining a top surface 606 and four side portions 608, open on one end 610. An integrally formed cylindrical portion 612 projects from the top surface 606 toward the open end 610. As best shown in FIGS. 59 and 60, the cylindrical portion 612 is formed with a pair of arcuate shoulders 614 at a free end 616 of the cylindrical portion 612 defining a generally rectangular slot 618 oriented, generally parallel to a longitudinal axis 620 of the housing 604.

An arcuate slot 622 is formed in the top surface 606 concentric with the cylindrical portion 612. As will be discussed in more detail below, the arcuate slot 622 defines an operate position and a remove position for the rating plug assembly 600.

The rating plug assembly 600 also includes a printed circuit board 624. The printed circuit board 624 carries a resistor 626 (which may be adjustable), a plurality of electrical terminals 628 (FIGS. 61, 62) which allows the rating plug assembly 600 to be plugged into an electronic trip unit 72 as well as providing the appropriate interconnections between the resistor 626 and the terminal 628. The printed circuit board 624 is formed as a generally rectangular member adapted to be received within the housing 604 having a circular aperture 630 adapted to be aligned with the cylindrical portion 612.

A plate 632, formed from, for example, an insulation material, is also provided to protect the printed circuit board 624 from damage due to ionizing gases generated within the circuit breaker during interruption of a relatively high overcurrent condition. The plate 632 is formed with a generally rectangular aperture 634 oriented generally transverse to the longitudinal axis 620. As will be discussed in more detail below, the combination of the rectangular aperture 634 in the plate 632 along with the rectangular slot 618 oriented generally perpendicular to each other when assembled function to capture the one-piece plunger 602 in accordance with the present invention relative to the rating plug assembly 600.

Figure 61:
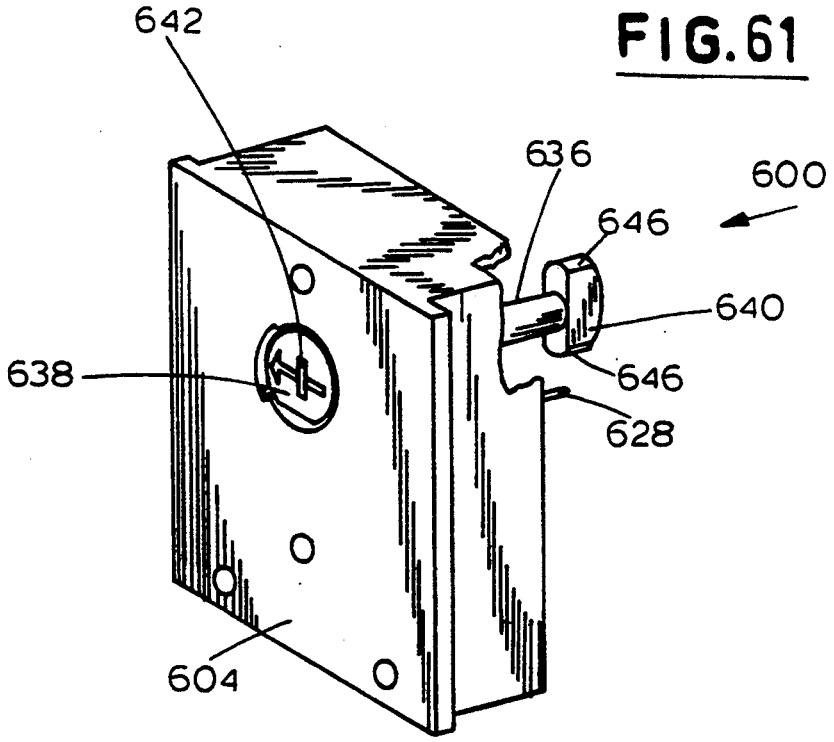
FIG. 61 is a bottom view of the rating plug assembly in accordance with the present invention in an operate position.
Figure 62:
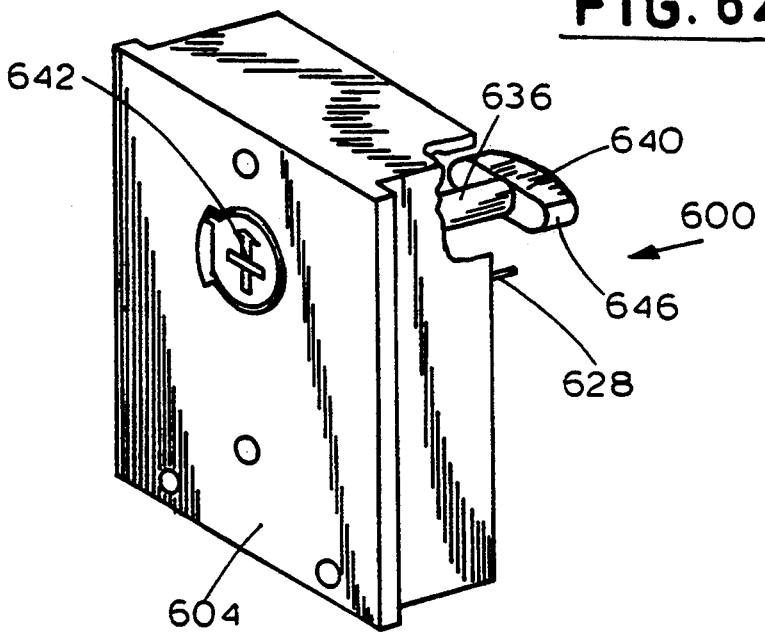
FIG. 62 is similar to FIG. 61 but in a remove position.

The one-piece plunger 602 is formed with an elongated shaft portion 636 with a head portion 638 formed on one end and an actuation portion 640 formed on the opposite end. The head portion 638 is formed with a generally rectangular slot 642 and a radial projection 644. The radial projection 644 is adapted to be received in the arcuate slot 622 formed in the top surface 606 of the housing 604 to allow the plunger 602 to be rotated between an operate position as shown in FIG. 61 and a remove position as shown in FIG. 62.

The actuation portion 640 is formed as a generally rectangular member integrally formed with two arcuate sides 646. The radius of the arcuate side 646 is selected slightly smaller than the radius of the cylindrical portion 612 as well as the circular aperture 630 formed in the printed circuit board 624. Additionally, the diameter defined between the two opposing arcuate sides 646 is selected to be slightly smaller than the length of the slot 618 formed in the free end 616 of the cylindrical portion 612 to allow the actuation portion to be received therethrough during assembly.

A pair of oppositely disposed radial projections 648 (FIG. 58) are formed on the shaft portion 636. These radial projections 648 are radially aligned with the arcuate sides 646. The radial projections 648 cooperate with the slot 618 formed at the free end 616 of the cylindrical portion 612 and the slot 642 formed in the plate 632 to capture the plunger 602 relative to the rating plug assembly 600. More specifically, with reference to FIGS. 61 and 62, the radial projections 644 are oriented generally transverse to the slot 618 in an operate position as shown in FIG. 62 which acts to capture the plunger 602 relative to the housing 604 and generally parallel to the slot 618 in a remove position.

A biasing spring 650 is provided and disposed about the shaft portion 636. The biasing spring 650 biases the one-piece plunger 602 upwardly when the rating plug assembly 600 is in an operate position.

In order to secure the assembly together, the housing 604 is formed with a plurality of standoffs 652 formed with integrally formed with centrally disposed apertures 654. The printed circuit board 624 as well as the plate 632 are also provided with apertures 656 which are adapted to be aligned with the apertures 654 formed in the standoff 652. Fasteners, such as rivets 658, may be used to secure the assembly together.

The rating plug assembly 600 may be assembled by placing the biasing spring 650 around the plunger 602. Next, the printed circuit board 624 is seated against the standoffs 652 formed in the housing 604. The one-piece plunger 602 in accordance with the present invention is then inserted through the cylindrical portion 612 in the housing 604 and through the circular aperture 630 formed in the printed circuit board 624. Subsequently, the one-piece plunger 602 is rotated approximately one-quarter turn. Next, the barrier plate 632 is positioned relative to the printed circuit board and the assembly is secured together by way of the rivets 658.

AUXILIARY CAM PLATE FOR FOUR POLE CIRCUIT BREAKER

A four pole circuit breaker, generally identified with the reference numeral 700 is illustrated in FIG. 63. Such circuit breakers 700 are generally used in 277 volt lighting systems. As previously discussed, the four pole circuit breaker 700 includes pole compartments 536, 538, 540 and 542. As shown, the operating mechanism 88 is operatively disposed in the pole compartment 538. As previously discussed, the crossbar 126 is operatively coupled to the pole compartments 536, 540 and 542 by way of the trip links 118 and the insulator links 120 in each of the poles 536, 538, 540 and 542.

As is known in the art, such crossbars are not perfectly rigid and thus are subject to deflection. In an application such as a four pole circuit breaker, the problems caused by the deflection of the crossbar due to the various unbalanced loads become more acute the farther away from the operating mechanism. Additionally, the unbalanced loads within the circuit breaker also cause a certain amount of deflection and bending of the operating mechanism 88. Due to the deflection of the crossbar, particularly at a remote pole compartment, such as the pole compartment 542, as well as the deflection within the operating mechanism 88, the contact force between the separable main contacts 34 in the remote pole compartment 542 have been known to be relatively less than the contact force between the pairs of separable main contacts disposed in the pole compartments 536, 538 and 540 when the circuit breaker is in a closed position. The present invention solves this problem by providing a cam plate 702 in the outside pole compartment 542 for guiding the end of the crossbar. Additionally, in order to maintain insulation integrity of the circuit breaker 20, the crossbar is segmented and isolated. More specifically, referring to FIG. 64, a relatively shorter crossbar 704 is provided relative to the normal length of the crossbar 126 used in such a four pole circuit breaker 700. Additionally, a crossbar extension 706 is provided. The crossbar 704 as well as the crossbar extension 706 are received in a modified insulator link 708 such that the ends of the crossbar 704 and the crossbar extension are spaced apart with a predetermined amount of the insulation material utilized for the modified insulator link 708 disposed therebetween. A portion of the crossbar extension 706 extends axially outwardly from the modified insulator link 708 forming a cam follower. As will be discussed below, the cam follower 710 cooperates with the cam plate 702 to compensate for the deflection of the crossbar in the four pole circuit breaker 700.

Figure 64:
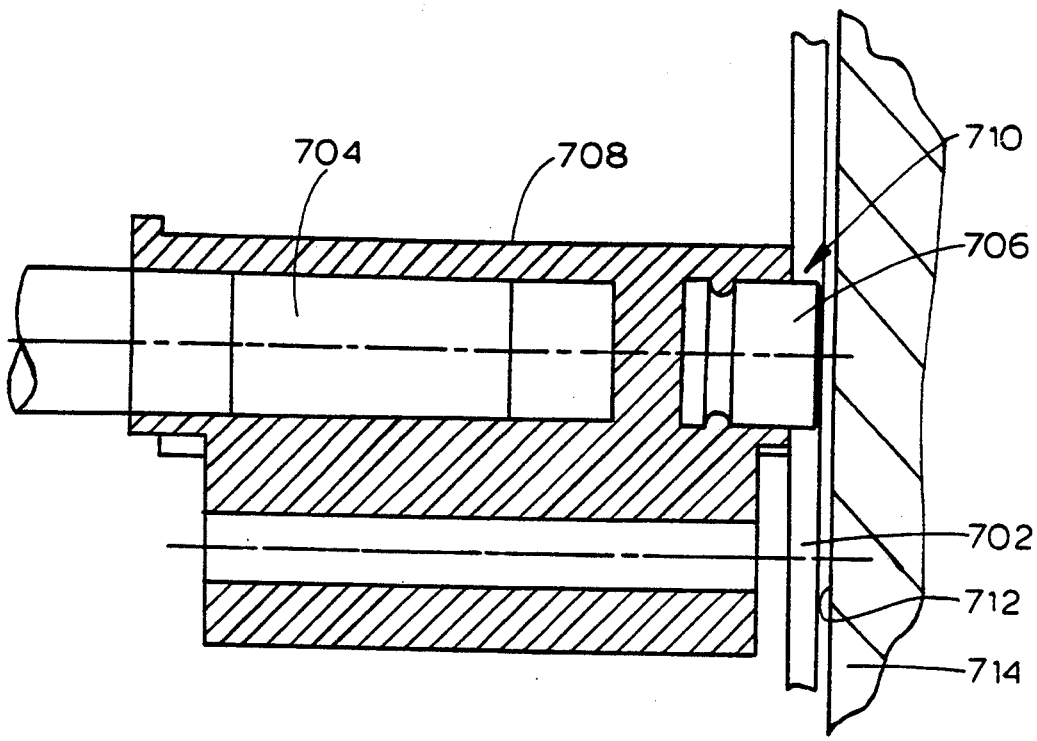
FIG. 64 is a partial sectional view of a crossbar assembly and a cam plate in accordance with the present invention.
Figure 65:
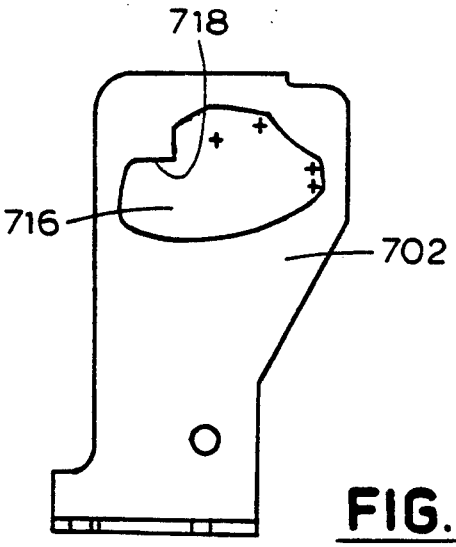
FIG. 65 is an elevational view of a cam plate in accordance with the present invention.

As best shown in FIG. 64, the cam plate 702 is disposed between the modified insulator link 708 and an interior surface 712 of an outside wall 714 which forms a portion of the molded base 24. The cam plate 702 is formed with an irregular-shaped aperture 716 which allows free movement of the crossbar during all anticipated operating conditions of the circuit breaker 20. The irregular-shaped aperture 716 is formed with a knee portion 718- which forms a cam surface. The size and shape, and particularly the active slope of the cam surface must be carefully matched to the selection characteristics of the system to achieve the proper results. If not, the invention will be of limited effectiveness and may impeded or prevent normal closing and/or tripping operations.

Figure 66:
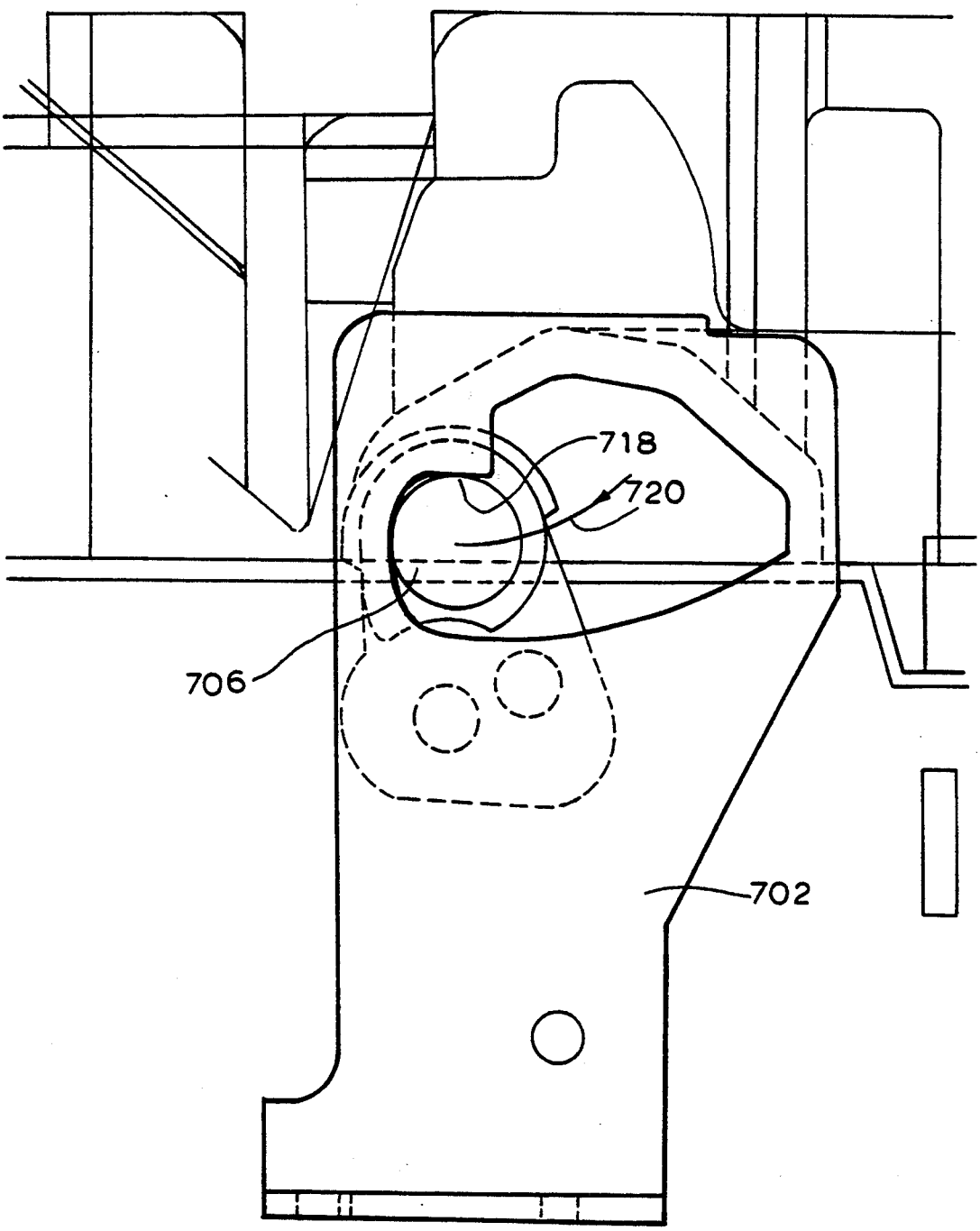
FIG. 66 is a partial elevational view illustrating the path of the crossbar during a closing stroke.

As will be discussed in more detail below, the cam surface 718 compensates for the effect of deflection of the crossbar by deflecting the crossbar upwardly near the end of the closing stroke thereby providing sufficient contact force between the separable main contacts 34 in the remote pole compartment 542 when the circuit breaker is in a closed position. More specifically, with reference to FIG. 66, the range of motion of the crossbar during a closing operation is indicated by the arc 720. During the initial portion of the closing stroke, the crossbar follows its normal path. As the crossbar reaches the end of its closing stroke (e.g., the crossbar extension 706 engages the cam surface 718) the crossbar 704 is deflected upwardly. This upward deflection is controlled and allows for proper contact force between the contact 34 in the remote pole 542. More specifically, the contact force between the separable contacts 34 and the remote pole 542 is dependent in part on the vertical relationship of the crossbar relative to the fixed main contact. In order to create a contact pressure between the contacts 34 when the circuit breaker is in a closed position, it is necessary for the crossbar and the carrier assembly 402 (FIG. 34) to travel to a position in which the contact springs 462 (FIG. 42) between each of the contact arms 408 and 410 is slightly compressed. In known four pole circuit breakers, a generally upward deflection of the crossbar will reduce the overtravel of the carrier assembly 402 thus reducing the contact pressure of the contacts 34 in the remote pole 542. By providing the cam plate 702 the upward deflection is controlled while, at the same time, assuring proper contact pressure between the contacts 34 in the outside pole 542.

Figure 68:
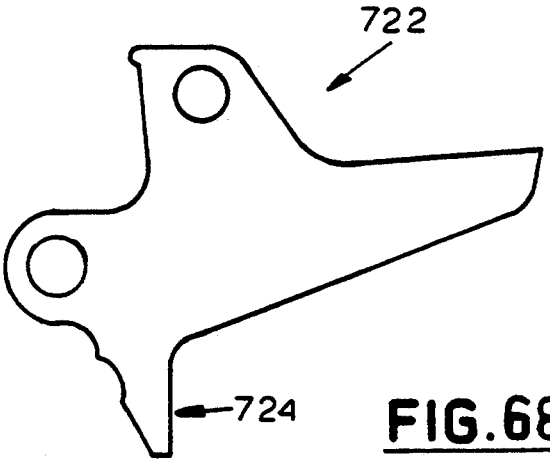
FIG. 68 is an elevational view of a modified cradle in accordance with the present invention.
Figure 67:
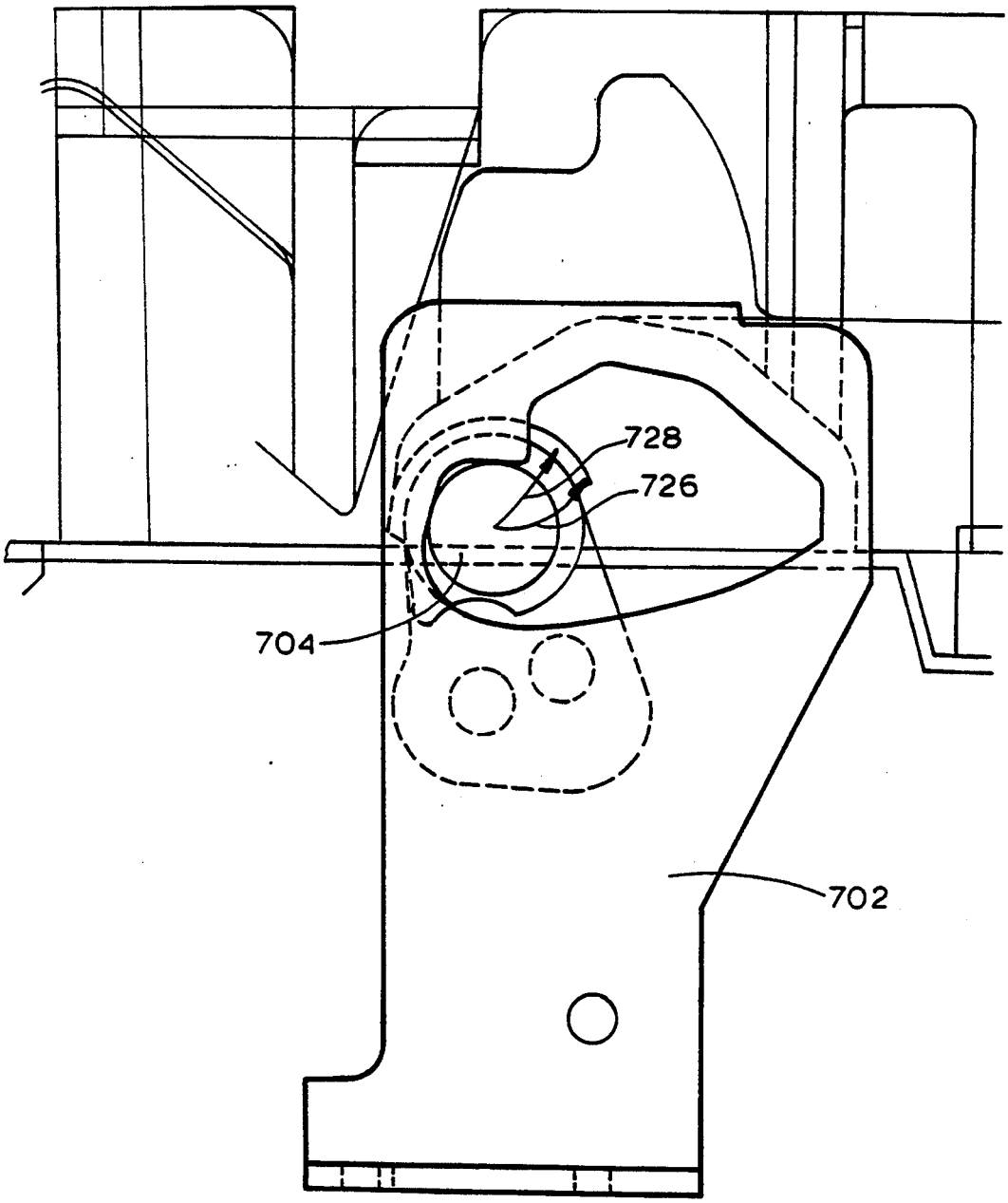
FIG. 67 is similar to FIG. 66 illustrating the path of the crossbar during a tripping stroke.

As previously mentioned, the cam plate 702 alters the normal motion of the crossbar. In order to provide proper operation of the circuit breaker 20 it is necessary to alter the normal travel path of the crossbar during a tripping operation. More specifically, during a tripping operation the normal path of the crossbar would interfere with the cam plate 702. If the crossbar was completely rigid this would prevent the circuit breaker 20 from tripping. However, since the system is flexible due to the flexibility of the crossbar and the deflections in the operating mechanism 88 during a tripping operation, the crossbar extension 706 follows the cam surface 718 for its limited effective stroke until the crossbar extension 706 becomes free of the cam surface 718 and reverts back to its normal motion. In order to insure relatively reliable tripping action it is necessary to alter the path of the crossbar at the start of the tripping stroke. More specifically, because of the normal travel path of the linkages in the operating mechanism 88 during a tripping stroke, a modified cradle 722 with a kicker arm 724 is provided as illustrated in FIG. 68. As shown, the cradle 722 is similar to the cradle 104 (FIG. 2) discussed above but further includes the kicker arm 724. The kicker arm 724 alters the motion at the start of the tripping stroke to assist in preventing impediment of motion and further acts to limit the amount of deflection of the crossbar by following the cam surface. As shown in FIG. 67, an arc 726 illustrates the altered tripping path of the crossbar extension 706 in the remote pole compartment 542. An arc 728 illustrates the altered tripping path at the beginning of the tripping stroke of the crossbar 704 in the pole 538. By controlling the motion of the crossbar 704 due to its flexibility, reliable tripping is assured.

Obviously, any modifications and variations of the present invention are possible in light of the above teachings. Thus, it is to be understood that, within the scope of the appended claims, the invention may be practiced otherwise than as specifically described above.

What is claimed and desired to be secured by letters patent of the United States is:

1. A molded case circuit breaker comprising:

a molded housing;

a plurality of pairs of separable main contacts carried by said housing, each pair defining a movably mounted main contact and a fixed main contact means;

a plurality of movably mounted contact arms for carrying said movably mounted main contacts, rotatably mounted for movement defining a closed position, an open position, a trip position, and a blow open position;

an operating mechanism, operably coupled to said plurality of movably mounted contact arms, for controlling movement of said plurality of movably mounted contact arms defining a closed position, an open position and a trip position; and a line side conductor formed as a generally straight member adjacent said plurality of movably mounted contact arms and defining a contact portion adjacent one end carrying said fixed main contact means and forming a line side terminal on an opposing end, said line side conductor including a predetermined number of cut outs for reversing, relative to the direction of electrical current flow from the line side terminal, the direction of electrical current flow in said contact portion adjacent said plurality of movably mounted contact arms, thereby forming a reverse current loop which generates sufficient magnetic repulsion forces to blow open said plurality of movably mounted contact arms when said electrical current reaches a predetermined magnitude.

2. A molded case circuit breaker as recited in claim 1, wherein said line side conductor is formed as a generally flat rectangular, generally straight member and said contact portion includes a single elongated contact, rigidly secured to said line side conductor, adapted to cooperate with said plurality of movably mounted main contacts forming a plurality of pairs of separable main contacts.

3. A molded case circuit breaker as recited in claim 1, wherein said line side conductor is formed as a generally flat rectangular, generally straight member and said contact potion includes a plurality of contacts, rigidly secured to said line side conductor, adapted to cooperate with said plurality of movably mounted main contacts forming a plurality of pairs of separable main contacts.

4. A molded case circuit breaker as recited in claim 1, further including one or more pairs of arcing contacts, each pair of arcing contacts defining a fixed arcing contact and a movably mounted arcing contact; one or more movably mounted arcing contact arms for carrying said movably mounted arcing contacts, said arcing contact arms operatively coupled to said operating mechanism and means for rigidly carrying said fixed arcing contact relative to said line side conductor.

5. A molded case circuit breaker as recited in claim 4, wherein said fixed arcing contacts is formed as a single elongated contact adapted to cooperate with said one or more movably mounted arcing contact arms forming one or more pairs of arcing contacts.

6. A molded case circuit breaker as recited in claim 1, wherein said line side conductor is formed as a generally flat rectangular, generally straight member defining a longitudinal axis and a transverse axis and said predetermined number of cut outs is one.

7. A molded case circuit breaker as recited in claim 6, wherein said cut out is formed in a generally L-shape defining a short leg portion and a relatively longer leg portion.

8. A molded case circuit breaker as recited in claim 7, wherein said short leg portion of said cut out is disposed generally perpendicular to said longitudinal axis of said line conductor.

9. A molded case circuit breaker as recited in claim 7, wherein said relatively longer leg portion is disposed generally parallel with said longitudinal axis of said line conductor.

10. A molded case circuit breaker as recited in claim 6, wherein said cut out is generally linear.

11. A molded case circuit breaker as recited in claim 10, wherein said linear cut out is disposed at a predetermined angle relative to said longitudinal axis of said line conductor.

12. A molded case circuit breaker as recited in claim 1, further including one or more pairs of arcing contacts, each pair of arcing contacts defining a fixed arcing contact and a movably mounted arcing contact; one or more movably mounted arcing contact arms for carrying said movably mounted arcing contacts, said arcing contact arms operatively coupled to said operating mechanism and means for rigidly carrying said fixed arcing contact relative to said line conductor, wherein said line side conductor is formed as a generally flat rectangular, generally straight member and said one or more fixed arcing contacts are mounted within said contact portion of said line conductor.

13. A molded case circuit breaker as recited in claim 12, wherein each of said pairs of separable main contacts further defines a means for cooperating with said movably mounted main contacts which forms said fixed main contact portion, said cooperating means is mounted within said contact portion of said line conductor.

14. A molded case circuit breaker as recited in claim 12, wherein each of said pairs of separable main contacts further defines a means for cooperating with said movably mounted main contacts which forms said fixed main contact portion, said cooperating means is disposed adjacent said contact portion such that the direction of electrical current flow in said cooperating means is opposite the direction of electrical current flow in said contact portion, thereby forming a reverse current loop which generates sufficient magnetic repulsion forces to blow open only said one or more movably mounted arcing contact arms when said electrical current reaches a predetermined magnitude.

15. A molded case circuit breaker as recited in claim 4, wherein said arcing contacts are disposed adjacent said contact portion such that the direction of electrical current flow into said arcing contacts is opposite the direction of electrical current flow into said contact portion when said circuit breaker is in a closed position.

16. A molded case circuit breaker as recited in claim 6, wherein said cut out is formed in a generally U-shape defining to parallel spaced apart depending leg portions and a bight portion.

17. A molded case circuit breaker as recited in claim 16, wherein said leg portions are generally parallel to said longitudinal axis of said line conductor.

18. A molded case circuit breaker as recited in claim 17, wherein said bight portion is generally parallel to said transverse axis of said line conductor.

19. A molded case circuit breaker as recited in claim 1, wherein said line side conductor is formed as a generally flat rectangular, generally straight member defining a longitudinal axis and a transverse axis and said predetermined number of cut outs is two.

20. A molded case circuit breaker as recited in claim 19, wherein each cut out is formed in a generally L-shape defining a short leg portion and a relatively longer leg portion.

21. A molded case circuit breaker as recited in claim 20, wherein said L-shaped cut outs are disposed on opposing edges of said side conductor such that said relatively longer leg portions are generally parallel with said longitudinal axis and said short leg portions are generally parallel with said transverse axis.

* * * * *